US011885138B2

(12) United States Patent
Kersting

(10) Patent No.: US 11,885,138 B2
(45) Date of Patent: Jan. 30, 2024

(54) CONTROL JOINT

(71) Applicant: Clarkwestern Dietrich Building Systems LLC, West Chester, OH (US)

(72) Inventor: Jeffrey F. Kersting, Cincinnati, OH (US)

(73) Assignee: Clarkwestern Dietrich Building Systems LLC, West Chester, OH (US)

( * ) Notice: Subject to any disclaimer, the term of this patent is extended or adjusted under 35 U.S.C. 154(b) by 6 days.

(21) Appl. No.: 17/523,993

(22) Filed: Nov. 11, 2021

(65) Prior Publication Data

US 2022/0145640 A1 May 12, 2022

Related U.S. Application Data

(60) Provisional application No. 63/112,925, filed on Nov. 12, 2020.

(51) Int. Cl.
*E04F 13/06* (2006.01)

(52) U.S. Cl.
CPC ..... *E04F 13/06* (2013.01); *E04F 2013/066* (2013.01)

(58) Field of Classification Search
CPC .... E04F 13/06; E04F 2013/066; E04B 1/949; E04B 2/7411; E04B 1/947
See application file for complete search history.

(56) References Cited

U.S. PATENT DOCUMENTS

| | | | |
|---|---|---|---|
| 1,029,106 | A | 6/1912 | Collins |
| D47,309 | S | 5/1915 | Terrell |
| 1,204,955 | A | 11/1916 | Day |
| 1,224,077 | A | 4/1917 | Grove et al. |
| 1,337,840 | A | 4/1920 | Hawley |
| 1,389,057 | A | 8/1921 | Lavigue |
| 1,555,392 | A | 9/1925 | Scherer et al. |
| 1,624,121 | A | 4/1927 | Thiem |
| 1,673,971 | A | 6/1928 | Dowell |
| 1,736,873 | A | 11/1929 | Barton |
| 1,853,310 | A | 4/1932 | Land |
| 1,954,847 | A | 4/1934 | Scholer et al. |
| 1,960,137 | A | 5/1934 | Brown |
| 2,023,814 | A | 12/1935 | Lindsey |

(Continued)

FOREIGN PATENT DOCUMENTS

| | | |
|---|---|---|
| AU | 653276 | 9/1994 |
| BE | 1019998 A3 | 3/2013 |

(Continued)

OTHER PUBLICATIONS

"#093 Zinc Control Joint (ZNCJ)," ClarkDietrich, 2015, 1 pg. downloaded Jan. 28, 2016 from http://www.clarkdietrich.com/products/metal-trims-and-finishing-products/093-zinc-control-joint-zncj.

(Continued)

*Primary Examiner* — Theodore V Adamos
(74) *Attorney, Agent, or Firm* — Frost Brown Todd LLP

(57) ABSTRACT

One embodiment of a construction component includes a first flange, a second flange, a flex portion positioned between the first flange and the second flange, a first leg, and a first strip. The first leg extends from the first flange and includes an interior surface facing the flex portion. The first strip may be positioned on a least a portion of the interior surface of the first leg.

25 Claims, 20 Drawing Sheets

(56) References Cited

U.S. PATENT DOCUMENTS 2,105,771 A 1/1938 Holdsworth
2,114,048 A 4/1938 Murray
2,142,305 A 1/1939 Davis
2,167,998 A 8/1939 Reid
2,224,148 A 12/1940 Fischer
2,272,162 A 2/1942 Davis
2,298,251 A 10/1942 Burson
2,350,790 A 6/1944 McCarthy
2,642,632 A 6/1953 Savage
2,679,156 A 5/1954 McFarland
RE24,658 E 6/1959 Hollister
2,922,385 A 1/1960 Murray
3,019,866 A 2/1962 Grabowski
3,041,682 A 7/1962 Alderfer et al.
3,114,219 A 12/1963 Bradley
3,139,703 A 7/1964 Hilt
D200,699 S 3/1965 Pappas
3,192,577 A 7/1965 Barr
3,255,561 A 6/1966 Cable
3,295,268 A 1/1967 Gaither
3,309,826 A 3/1967 Zinn
3,324,615 A 6/1967 Zinn
3,331,176 A 7/1967 Washam
3,358,402 A 12/1967 Sahm
3,398,494 A 8/1968 Larson
3,411,260 A 11/1968 Dill
3,412,512 A 11/1968 Hollister
3,423,893 A 1/1969 Hyatt
3,426,493 A 2/1969 Aspaas
3,440,934 A 4/1969 Dill
3,460,302 A 8/1969 Cooper
3,512,318 A 5/1970 Turner
3,513,114 A 5/1970 Hahn et al.
3,515,373 A 6/1970 Abbe
3,543,460 A 12/1970 Stastny
3,568,391 A 3/1971 Conway
3,606,714 A 9/1971 Arnett
3,667,174 A 6/1972 Arnett
3,712,015 A 1/1973 Nelson
3,754,367 A 8/1973 O'Konski et al.
3,782,680 A 1/1974 Hopkins
3,786,604 A 1/1974 Kramer
3,788,021 A 1/1974 Husler
D230,583 S 3/1974 La Borde
3,837,126 A 9/1974 Voiturier et al.
3,908,328 A 9/1975 Nelsson
3,934,066 A 1/1976 Murch
3,940,899 A 3/1976 Balinski
3,950,912 A 4/1976 Lundberg et al.
3,951,562 A 4/1976 Fyfe
3,956,557 A 5/1976 Hurst
3,964,220 A 6/1976 Rutkowski et al.
3,997,505 A 12/1976 Albright
4,038,791 A 8/1977 Atkinson
4,084,348 A 4/1978 Hast
D250,420 S 11/1978 Ward
4,130,972 A 12/1978 Varlonga
4,189,619 A 2/1980 Pedlow
4,203,264 A 5/1980 Kiefer et al.
4,302,262 A 11/1981 Kay
4,353,192 A 10/1982 Pearson et al.
4,356,672 A 11/1982 Beckman et al.
4,361,994 A 12/1982 Carver
4,364,212 A 12/1982 Pearson et al.
4,374,442 A 2/1983 Hein et al.
4,376,361 A 3/1983 Michael
4,391,074 A 7/1983 Holsman
4,434,592 A 3/1984 Reneault et al.
4,443,991 A 4/1984 Mieyal
4,447,172 A 5/1984 Galbreath
4,485,600 A 12/1984 Olson
4,575,979 A 3/1986 Mariani
4,651,488 A 3/1987 Nicholas et al.
4,660,338 A 4/1987 Wagner
4,785,601 A 11/1988 Tupman
4,805,364 A 2/1989 Smolik
4,825,612 A 5/1989 Tupman
4,854,096 A 8/1989 Smolik
4,866,896 A 9/1989 Shreiner et al.
4,932,183 A 6/1990 Coulston
4,952,615 A 8/1990 Welna
4,967,519 A 11/1990 Sieber
4,993,203 A 2/1991 Tanaka
5,067,297 A 11/1991 Sobol
5,073,430 A 12/1991 Aidan
5,079,880 A 1/1992 Reid
5,081,814 A 1/1992 Singletary et al.
5,127,203 A 7/1992 Paquette
5,127,760 A 7/1992 Brady
5,160,784 A 11/1992 Shmidt et al.
5,245,811 A 9/1993 Knorr
5,248,225 A 9/1993 Rose
5,269,624 A 12/1993 Kramer
5,296,534 A 3/1994 Senuma et al.
5,305,566 A 4/1994 Larkowski
5,313,752 A 5/1994 Hatzinikolas
5,313,755 A 5/1994 Koenig, Jr.
5,338,130 A 8/1994 Baerveldt
5,349,797 A 9/1994 Stultz
5,365,713 A 11/1994 Nicholas et al.
5,375,386 A 12/1994 Goad
5,412,919 A 5/1995 Pellock et al.
5,413,828 A 5/1995 De Keyser
5,419,084 A 5/1995 Sankey et al.
5,423,154 A 6/1995 Maylon et al.
5,430,091 A 7/1995 Mahabir
5,452,551 A 9/1995 Charland et al.
5,471,805 A 12/1995 Becker
5,477,643 A * 12/1995 Koenig, Jr. ..... E04F 13/06 52/471
5,531,051 A 7/1996 Chenier, Jr. et al.
5,552,185 A 9/1996 De Keyser
5,584,152 A 12/1996 Baerveldt
5,625,986 A 5/1997 Mansfield
5,628,857 A 5/1997 Baerveldt
5,630,297 A 5/1997 Rutherford
5,671,967 A 9/1997 Gurganus et al.
5,689,922 A 11/1997 Daudet
5,694,731 A 12/1997 Toensmann et al.
5,699,638 A 12/1997 Maylon
5,729,939 A 3/1998 Di Benedetto
5,755,066 A 5/1998 Becker
5,761,866 A 6/1998 Maylon
5,765,332 A 6/1998 Landin
5,791,111 A 8/1998 Beenders
5,799,456 A 9/1998 Shreiner et al.
5,802,785 A 9/1998 Crook
5,836,135 A 11/1998 Hagan et al.
5,887,395 A 3/1999 Navarro et al.
5,887,400 A 3/1999 Bratek et al.
5,906,080 A 5/1999 diGirolamo et al.
5,913,788 A 6/1999 Herren
5,916,095 A 6/1999 Tamlyn
5,921,041 A 7/1999 Egri, II
5,937,600 A 8/1999 Larson
5,946,870 A 9/1999 Bifano et al.
5,950,385 A 9/1999 Herron
5,953,872 A 9/1999 MacMillian
5,968,615 A 10/1999 Schlappa
5,970,671 A 10/1999 Bifano et al.
5,979,123 A 11/1999 Brockman
5,979,129 A 11/1999 Azar
6,058,668 A 5/2000 Herren
6,070,374 A 6/2000 Bifano et al.
6,110,559 A 8/2000 De Keyser
6,119,416 A 9/2000 Larson
6,119,429 A 9/2000 Bifano et al.
6,125,608 A 10/2000 Charlson
6,131,352 A 10/2000 Barnes et al.
6,134,847 A 10/2000 Bifano et al.
6,141,923 A 11/2000 Habicht et al.
6,161,344 A 12/2000 Blanchett
6,170,207 B1 1/2001 Saindon
6,176,053 B1 1/2001 St. Germain

(56) References Cited

U.S. PATENT DOCUMENTS 6,189,273 B1 * 2/2001 Larson ..... E04F 19/022 52/287.1
6,192,646 B1 2/2001 Grewe et al.
6,207,085 B1 3/2001 Ackerman
6,216,404 B1 4/2001 Vellrath
6,253,516 B1 7/2001 D'Andrea et al.
6,293,064 B1 9/2001 Larson
6,295,776 B1 10/2001 Kunz et al.
6,298,609 B1 10/2001 Bifano et al.
6,305,130 B1 10/2001 Ackerman, Jr.
6,324,797 B1 12/2001 Fago et al.
6,327,826 B1 12/2001 Mann
D456,528 S 4/2002 Maylon et al.
6,374,558 B1 4/2002 Surowiecki
6,385,932 B1 5/2002 Melchiori
D459,007 S 6/2002 Campacci
6,401,427 B1 6/2002 Snyder
6,405,502 B1 6/2002 Cornwall
6,470,638 B1 10/2002 Larson
6,499,262 B1 12/2002 Pinchot et al.
D471,991 S 3/2003 Maylon et al.
6,581,353 B2 6/2003 Augustine
D477,420 S 7/2003 Butcher
6,591,559 B2 7/2003 Contreras et al.
6,609,341 B2 8/2003 Maylon et al.
6,612,087 B2 9/2003 diGirolamo
6,622,432 B2 9/2003 Zacher et al.
6,640,508 B2 11/2003 Lindgren et al.
6,663,159 B2 12/2003 Kinkaide
6,691,476 B1 2/2004 Kunz
6,698,144 B1 3/2004 Larson
6,698,155 B2 3/2004 Menendez
6,706,793 B2 3/2004 Abu-Isa et al.
6,730,381 B2 5/2004 Horacek
6,745,703 B2 6/2004 Torrey et al.
6,747,074 B1 6/2004 Buckingham et al.
6,748,705 B2 6/2004 Orszulak et al.
6,751,919 B2 * 6/2004 Calixto ..... E04B 1/6816 52/471
6,776,423 B1 8/2004 Guht
6,783,345 B2 8/2004 Morgan et al.
6,809,129 B2 10/2004 Abu-Isa
6,848,227 B2 2/2005 Whitty
6,854,237 B2 2/2005 Surowiecki
D503,227 S 3/2005 Rodolfo et al.
D503,469 S 3/2005 Rodolfo et al.
6,948,287 B2 9/2005 Korn
6,948,716 B2 9/2005 Drouin
6,966,945 B1 11/2005 Mazany et al.
6,969,422 B2 11/2005 Mazany et al.
D518,186 S 3/2006 Zarb
7,028,444 B2 4/2006 Wirth
7,043,880 B2 5/2006 Morgan et al.
7,059,092 B2 6/2006 Harkins
7,094,285 B2 8/2006 Mazany et al.
D529,630 S 10/2006 Zarb
7,140,155 B1 11/2006 Nasimov
7,152,385 B2 12/2006 Morgan et al.
7,200,970 B2 4/2007 Koenig, Jr. et al.
7,207,148 B2 4/2007 Surowiecki
7,240,905 B1 7/2007 Stahl, Jr.
D551,783 S 9/2007 Lowman
7,284,355 B2 10/2007 Becker et al.
7,284,357 B2 10/2007 McInerney et al.
7,296,387 B2 11/2007 Milu
D575,139 S 8/2008 LePoire et al.
7,406,805 B1 8/2008 Larson
7,451,573 B2 11/2008 Orszulak et al.
7,479,513 B2 1/2009 Reinheimer et al.
7,526,897 B2 5/2009 Collins
7,617,643 B2 11/2009 Pilz et al.
7,634,883 B1 12/2009 Larson et al.
7,654,049 B2 2/2010 Koenig, Jr. et al.
7,669,383 B2 3/2010 Darnell
7,673,428 B1 3/2010 Smythe
7,681,365 B2 3/2010 Klein
7,735,295 B2 6/2010 Surowiecki
7,752,817 B2 7/2010 Pilz et al.
7,757,450 B2 7/2010 Reyes et al.
7,775,006 B2 8/2010 Giannos
7,797,893 B2 9/2010 Stahl, Sr. et al.
7,810,289 B2 10/2010 Montgomery
7,814,718 B2 10/2010 Klein
7,856,781 B2 12/2010 Hilburn, Jr.
D631,175 S 1/2011 Escribano
7,866,108 B2 1/2011 Klein
7,874,123 B2 1/2011 Mariarz
7,882,672 B2 2/2011 Emblin
7,921,603 B2 4/2011 Darnell
7,921,614 B2 4/2011 Fortin et al.
7,950,198 B2 5/2011 Pilz et al.
8,020,352 B2 9/2011 Ahearn
8,047,550 B2 11/2011 Behrens et al.
8,056,293 B2 11/2011 Klein
8,079,188 B2 12/2011 Swartz et al.
8,079,190 B2 12/2011 Hilburn, Jr.
D652,532 S 1/2012 Letham
D652,955 S 1/2012 Budzik
8,087,205 B2 1/2012 Pilz et al.
D656,603 S 3/2012 Egan et al.
8,132,376 B2 3/2012 Pilz et al.
8,136,314 B2 3/2012 Klein
8,142,879 B2 3/2012 Whitaker et al.
8,151,526 B2 4/2012 Klein
8,181,404 B2 5/2012 Klein
8,230,659 B2 7/2012 Langille et al.
8,245,471 B2 8/2012 Hilburn, Jr.
8,281,552 B2 10/2012 Pilz et al.
8,322,094 B2 12/2012 Pilz et al.
8,347,794 B2 1/2013 Muirhead
8,353,139 B2 1/2013 Pilz et al.
8,375,666 B2 2/2013 Stahl, Jr. et al.
8,413,394 B2 4/2013 Pilz et al.
8,444,790 B2 5/2013 Tong
8,468,759 B2 6/2013 Klein
8,484,916 B2 7/2013 Farag
8,499,512 B2 8/2013 Pilz et al.
8,511,016 B2 8/2013 Smythe, Jr.
8,555,566 B2 10/2013 Pilz et al.
D693,483 S 11/2013 Krieger
8,572,914 B2 11/2013 Burgess
8,584,415 B2 11/2013 Stahl, Jr. et al.
8,584,416 B2 * 11/2013 Chenier ..... E04F 13/06 52/573.1
8,590,231 B2 11/2013 Pilz
8,595,999 B1 12/2013 Pilz et al.
8,596,007 B2 12/2013 Hibbs
8,601,760 B2 12/2013 Hilburn
8,607,519 B2 12/2013 Hilburn
8,615,944 B2 12/2013 Maziarz
8,615,950 B1 12/2013 Gomes
8,640,415 B2 2/2014 Pilz et al.
8,646,235 B2 2/2014 Hilburn, Jr.
D700,717 S 3/2014 Campacci
8,663,774 B2 3/2014 Fernando et al.
8,671,632 B2 * 3/2014 Pilz ..... E04B 1/946 52/302.1
D703,306 S 4/2014 Little et al.
D703,307 S 4/2014 Little et al.
8,720,138 B2 5/2014 Hilburn, Jr.
8,752,354 B2 6/2014 Honey
8,782,977 B2 7/2014 Burgess
D711,556 S 8/2014 Singh
8,793,947 B2 8/2014 Pilz et al.
8,826,599 B2 9/2014 Stahl, Jr.
8,869,491 B2 10/2014 Little et al.
8,875,468 B2 11/2014 Dhinjan
8,910,437 B2 12/2014 Robertson
8,938,882 B2 1/2015 Carlson et al.
8,938,922 B2 1/2015 Pilz et al.
8,938,926 B2 1/2015 Sareyka et al.
8,955,275 B2 2/2015 Stahl, Jr.
8,973,319 B2 3/2015 Pilz et al.
9,045,899 B2 6/2015 Pilz et al.

(56) References Cited

U.S. PATENT DOCUMENTS 9,062,453 B1 6/2015 Maziarz
9,085,907 B2 7/2015 Rutherford
9,127,454 B2 9/2015 Pilz et al.
9,157,232 B2 10/2015 Stahl, Jr.
D742,546 S 11/2015 Singh
9,200,454 B2 12/2015 Little et al.
D750,806 S 3/2016 Singh
9,272,499 B2 3/2016 Veilleux et al.
9,279,040 B2 3/2016 Jin et al.
9,279,247 B2 3/2016 Maziarz
9,284,730 B2 3/2016 Klein
9,290,932 B2 3/2016 Pilz et al.
9,290,934 B2 3/2016 Pilz et al.
9,303,413 B2 4/2016 Koenig, Jr. et al.
9,321,243 B2 4/2016 Fernando et al.
9,371,644 B2 6/2016 Pilz et al.
D761,971 S 7/2016 Apanovich et al.
D762,310 S 7/2016 Apanovich et al.
9,394,423 B2 7/2016 Easteal et al.
9,422,730 B2 8/2016 Curtis et al.
9,428,917 B2 8/2016 Rodler
9,435,114 B1 * 9/2016 Preston ..... E04B 1/6807
D768,877 S 10/2016 Mumford, Sr.
D768,879 S 10/2016 Mumford, Sr.
D768,880 S 10/2016 Mumford, Sr.
D768,881 S 10/2016 Mumford, Sr.
D768,882 S 10/2016 Mumford, Sr.
D769,459 S 10/2016 Mumford, Sr.
D769,460 S 10/2016 Mumford, Sr.
D769,461 S 10/2016 Mumford, Sr.
D769,462 S 10/2016 Mumford, Sr.
9,458,628 B2 10/2016 Pilz et al.
D771,838 S 11/2016 Mumford, Sr.
9,481,998 B2 11/2016 Pilz et al.
9,494,235 B2 11/2016 Winslow et al.
9,506,246 B2 11/2016 Joseph et al.
D774,214 S 12/2016 Mumford, Sr.
9,512,614 B2 12/2016 Klein et al.
9,523,193 B2 12/2016 Pilz
9,540,808 B2 1/2017 Remmele
9,611,640 B2 4/2017 Mayer et al.
9,616,259 B2 4/2017 Pilz et al.
9,637,914 B2 5/2017 Pilz et al.
9,683,364 B2 6/2017 Pilz
D792,609 S 7/2017 Smith et al.
D792,610 S 7/2017 Smith et al.
9,719,253 B2 8/2017 Stahl et al.
9,732,853 B2 8/2017 Kethorn et al.
9,739,052 B2 8/2017 Pilz et al.
9,739,054 B2 8/2017 Pilz et al.
9,752,318 B2 9/2017 Pilz
9,752,327 B2 9/2017 Poradzisz
D800,344 S 10/2017 Reves et al.
D800,345 S 10/2017 Apanovich et al.
D800,346 S 10/2017 Reyes et al.
D800,921 S 10/2017 Reyes et al.
9,879,421 B2 1/2018 Pilz
9,909,298 B2 3/2018 Pilz
9,931,527 B2 4/2018 Pilz et al.
9,995,039 B2 6/2018 Pilz et al.
9,995,040 B2 6/2018 Stahl et al.
10,000,923 B2 6/2018 Pilz
10,011,983 B2 7/2018 Pilz et al.
10,066,385 B2 9/2018 Foerg et al.
10,077,550 B2 9/2018 Pilz
10,184,246 B2 1/2019 Pilz et al.
D841,833 S 2/2019 Apanovich et al.
10,196,811 B2 2/2019 Foerg et al.
D842,496 S 3/2019 Apanovich et al.
D842,497 S 3/2019 Apanovich et al.
D843,015 S 3/2019 Apanovich et al.
10,246,871 B2 4/2019 Pilz
10,267,036 B2 4/2019 Kleinhans et al.
10,273,370 B2 4/2019 Lang
10,323,189 B2 6/2019 Muenzenberger et al.
10,323,411 B2 6/2019 Ackerman et al.
D861,196 S 9/2019 Apanovich et al.
10,406,389 B2 9/2019 Pilz et al.
10,407,899 B2 9/2019 Klein et al.
10,427,337 B2 10/2019 Muenzenberger
10,472,819 B2 11/2019 Klein et al.
10,519,652 B2 12/2019 Klein et al.
10,597,867 B2 3/2020 Hulteen et al.
10,626,598 B2 4/2020 Klein
10,774,528 B2 9/2020 Kleinhans et al.
11,111,666 B2 * 9/2021 Pilz ..... E04B 2/7409
11,141,613 B2 10/2021 Pilz et al.
2003/0051422 A1 3/2003 Maziarz
2003/0177725 A1 9/2003 Gatherum
2004/0045234 A1 3/2004 Morgan et al.
2005/0031843 A1 2/2005 Robinson et al.
2005/0034389 A1 2/2005 Boot
2005/0142359 A1 6/2005 Narum et al.
2005/0172571 A1 8/2005 Koenig, Jr. et al.
2005/0257461 A1 11/2005 Daly, IV
2005/0284030 A1 12/2005 Autovino et al.
2006/0096200 A1 5/2006 Daudet
2006/0254169 A1 11/2006 McFadden
2007/0022685 A1 2/2007 Koenig, Jr. et al.
2007/0062137 A1 3/2007 Maylon
2007/0169428 A1 7/2007 Amster et al.
2007/0180791 A1 8/2007 Amster et al.
2007/0209306 A1 9/2007 Andrews et al.
2008/0016808 A1 1/2008 Pilz
2008/0104918 A1 5/2008 Gleeson et al.
2008/0172967 A1 * 7/2008 Hilburn ..... E04B 1/948
52/396.01
2008/0263971 A1 10/2008 Maziarz
2009/0239067 A1 9/2009 Verlaan
2009/0255619 A1 10/2009 Tong
2011/0088918 A1 4/2011 Gonzales
2011/0214371 A1 9/2011 Klein
2012/0022201 A1 1/2012 Zhvanetskiy et al.
2012/0023846 A1 2/2012 Mattox et al.
2012/0110936 A1 5/2012 Egan et al.
2014/0230359 A1 8/2014 Honey
2014/0245676 A1 9/2014 Maziarz
2014/0260019 A1 9/2014 Conboy
2014/0345886 A1 11/2014 Yano et al.
2015/0135622 A1 5/2015 Muenzenberger et al.
2015/0135631 A1 5/2015 Foerg et al.
2015/0275506 A1 10/2015 Klein et al.
2015/0275507 A1 10/2015 Klein et al.
2015/0275510 A1 10/2015 Klein et al.
2016/0017599 A1 1/2016 Klein et al.
2016/0186481 A1 6/2016 Maziarz
2016/0340908 A1 11/2016 Apanovich et al.
2016/0348357 A1 * 12/2016 Smith ..... E04F 13/06
2017/0022704 A1 1/2017 Bertucelli et al.
2017/0130462 A1 5/2017 Maziarz
2017/0175386 A1 6/2017 Pilz
2017/0234010 A1 8/2017 Klein
2017/0260741 A1 9/2017 Ackerman et al.
2017/0306615 A1 10/2017 Klein et al.
2018/0051470 A1 * 2/2018 Smith ..... E04F 19/062
2018/0171646 A1 6/2018 Stahl et al.
2018/0195282 A1 7/2018 Pilz
2018/0283000 A1 10/2018 Klein
2019/0177970 A1 6/2019 Ackerman et al.
2019/0284799 A1 * 9/2019 Förg ..... E04B 1/948
2021/0148112 A1 5/2021 Klein
2021/0323285 A1 10/2021 Klein
2022/0023684 A1 1/2022 Pilz et al.
2022/0106785 A1 4/2022 Klein

FOREIGN PATENT DOCUMENTS

CA 19534 S 3/1954
CA 22772 S 10/1959
CA 22773 S 10/1959
CA 2082303 A1 5/1993
CA 2192420 A1 6/1998
CA 2230408 A1 8/1999
CA 2234347 A1 10/1999

(56) References Cited

FOREIGN PATENT DOCUMENTS

| | | | |
|---|---|---|---|
| CA | 2259875 | A1 | 10/1999 |
| CA | 2259877 | A1 | 10/1999 |
| CA | 93969 | A | 11/2001 |
| CA | 2394592 | A1 | 1/2004 |
| CA | 107604 | S | 12/2005 |
| CA | 107605 | S | 12/2005 |
| CA | 107606 | S | 12/2005 |
| CA | 107607 | S | 12/2005 |
| CA | 2856523 | A1 | 2/2008 |
| CA | 127416 | S | 9/2009 |
| CA | 2771711 | A1 | 3/2011 |
| CA | 139128 | S | 1/2012 |
| CA | 2816036 | A1 | 5/2012 |
| CA | 2803439 | A1 | 8/2013 |
| CA | 146178 | S | 11/2013 |
| CA | 151311 | S | 8/2014 |
| CA | 2659845 | C | 11/2014 |
| CA | 2849597 | A1 | 12/2014 |
| CA | 2925428 | A1 | 5/2015 |
| CA | 158042 | S | 6/2015 |
| CA | 165350 | S | 8/2016 |
| CA | 165351 | S | 8/2016 |
| DE | 29615211 | U1 | 10/1996 |
| DE | 102013205348 | A1 | 10/2014 |
| EP | 0161532 | A2 | 11/1985 |
| EP | 0324918 | A1 | 7/1991 |
| EP | 0473393 | A1 | 3/1992 |
| EP | 0723064 | A2 | 7/1996 |
| EP | 2 821 207 | A1 | 1/2015 |
| EP | 2 933 312 | A1 | 10/2015 |
| EP | 3 056 626 | A1 | 8/2016 |
| FR | 2742186 | A1 | 6/1997 |
| GB | 361490 | A | 11/1931 |
| GB | 2070114 | A | 9/1981 |
| GB | 2233381 | A | 1/1991 |
| GB | 2284218 | A | 5/1995 |
| GB | 2356885 | A | 6/2001 |
| GB | 2405172 | A | 2/2005 |
| JP | 2002-364087 | A | 12/2002 |
| JP | 53-64003 | B2 | 12/2013 |
| KR | 2010-0106615 | A | 10/2010 |
| NL | 1037340 | C | 4/2011 |
| TW | M 354518 | U | 4/2009 |
| WO | WO 2004/044927 | A1 | 5/2004 |
| WO | WO 2007/012897 | A1 | 2/2007 |
| WO | WO 2012/131284 | A1 | 10/2012 |
| WO | WO 2014/023620 | A1 | 2/2014 |
| WO | WO 2014/154729 | A1 | 10/2014 |
| WO | WO 2015/001001 | A1 | 1/2015 |
| WO | WO 2015/015206 | A1 | 2/2015 |
| WO | WO 2015/071482 | A1 | 5/2015 |
| WO | WO 2015/158651 | A1 | 10/2015 |
| WO | WO 2016/128301 | A1 | 8/2016 |
| WO | WO 2016/128304 | A1 | 8/2016 |
| WO | WO 2016/128552 | A1 | 8/2016 |

OTHER PUBLICATIONS

"#15 Double-V Control Joint," ClarkDietrich, 2015, 1 pg. downloaded Jan. 28, 2016 from http://www.clarkdietrich.com/products/metal-expansion-control-joints/15-double-v-control-joint.

"#15 Zinc Double-V Control Joint," ClarkDietrich, 2015, 1 pg. downloaded Jan. 28, 2016 from http://www.clarkdietrich.com/products/zinc-expansion-control-joints/15-zinc-double-v-control-joint.

"#30 Corner Master™ Control Joint," ClarkDietrich, 2015, 1 pg. downloaded Jan. 29, 2016 from http://www.clarkdietrich.com/products/metal-expansion-control-joints/30-corner-master-control-joint.

"#40 Two-Piece Expansion Joint," ClarkDietrich, 2015, 1 pg. downloaded Jan. 28, 2016 from http://www.clarkdietrich.com/products/metal-expansion-control-joints/40-two-piece-expansion-joint.

"#40 Zinc Two-Piece Expansion Joint," ClarkDietrich, 2015, 1 pg. downloaded Jan. 29, 2016 from http://www.clarkdietrich.com/products/zinc-expansion-control-joints/40-zinc-two-piece-expansion-joint.

"#66N Short Flange Casing Bead", ClarkDietrich, 2015, 1 pg., downloaded Nov. 16, 2015 from http://www.clarkdietrich.com/products/metal-corner-casing-beads/66n-short-flange-casing-bead.

"#66N Zinc Short Flange Casing Bead", ClarkDietrich, 2015, 1 pg., downloaded Nov. 16, 2015 from http://www.clarkdietrich.com/products/zinc-corner-casing-beads/66n-zinc-short-flange-casing-bead.

"#66X Expanded Flange Casing Bead", ClarkDietrich, 2015, 1 pg., downloaded Nov. 16, 2015 from http://www.clarkdietrich.com/products/metal-corner-casing-beads/66x-expanded-flange-casing-bead.

"#66X Zinc Expanded Flange Casing Bead", ClarkDietrich, 2015, 1 pg., downloaded Nov. 16, 2015 from http://www.clarkdietrich.com/products/zinc-corner-casing-beads/66x-zinc-expanded-flange-casing-bead.

"#701A/#801A J-Trim," ClarkDietrich, 2015, 1 pg., downloaded Feb. 16, 2016 from http://www.clarkdietrich.com/products/metal-veneer-plaster-beads-trims/701a-801a-j-trim.

"#701A/#801A Zinc J-Trim," ClarkDietrich, 2015, 1 pg. downloaded Jan. 28, 2016 from http://www.clarkdietrich.com/products/zinc-veneer-plaster-beads-trims/701a-801a-zinc-j-trim.

"#701B/#801B L-Trim," ClarkDietrich, 2015, 1 pg., downloaded Feb. 16, 2016 from http://www.clarkdietrich.com/products/metal-veneer-plaster-beads-trims/701b-801b-l-trim.

"#701B/#801B Zinc L-Trim," ClarkDietrich, 2015, 1 pg. downloaded Jan. 28, 2016 from http://www.clarkdietrich.com/products/zinc-veneer-plaster-beads-trims/701b-801b-zinc-l-trim.

"#XJ15 Double-J Control Joint," ClarkDietrich, 2015, 1 pg. downloaded Jan. 28, 2016 from http://www.clarkdietrich.com/products/metal-expansion-control-joints/xj15-double-j-control-joint.

"#XJ15 Zinc Double-J Control Joint," ClarkDietrich, 2015, 1 pg. downloaded Jan. 28, 2016 from http://www.clarkdietrich.com/products/zinc-expansion-control-joints/xj15-zinc-double-j-control-joint.

""F" Beads," Vinyl Corp., 2015, 1 pg. downloaded Jan. 28, 2016 from http://www.vinylcorp.com/products/drywall-veneer/beads-trims/f-beads.

""F" Control Joints (Perforated Flanges)," Vinyl Corp., 2015, 1 pg. downloaded Jan. 28, 2016 from http://www.vinylcorp.com/products/drywall-veneer/control-joints/f-control-joints-perforated-flanges.

""F" Control Joints (Unperforated Flanges)," Vinyl Corp., 2015, 1 pg. downloaded Jan. 28, 2016 from http://www.vinylcorp.com/products/drywall-veneer/control-joints/f-control-joints-unperforated-flanges.

""J" Beads," Vinyl Corp., 2015, 1 pg. downloaded Jan. 28, 2016 from http://www.vinylcorp.com/products/drywall-veneer/beads-trims/j-beads.

""L" Beads (L-Bead Perforated)," Vinyl Corp., 2015, 1 pg. downloaded Jan. 28, 2016 from http://www.vinylcorp.com/products/drywall-veneer/beads-trims/l-beads-l-bead-perforated.

"2" J-Weep Low Back," ClarkDietrich, 2015, 1 pg. downloaded Jan. 28, 2016 from http://www.clarkdietrich.com/products/metal-weep-sill-screeds/2-j-weep-low-back.

"3-½" J-Weep High Back," ClarkDietrich, 2015, 1 pg. downloaded Jan. 28, 2016 from http://www.clarkdietrich.com/products/metal-weep-sill-screeds/3-1-2-j-weep-high-back.

"Adjustable Corner Trim," Vinyl Corp., 2015, 1 pg. downloaded Jan. 28, 2016 from http://www.vinylcorp.com/products/drywall-veneer/beads-trims/adjustable-corner-trim.

"Angled Casing Beads", Vinyl Corp., 2015, 1 pg., downloaded Nov. 16, 2015 from http://www.vinylcorp.com/products/stucco-plaster/casing-beads/angled-casing-beads.

"Archmaker™ Casing Beads", Vinyl Corp., 2015, 1 pg., downloaded Nov. 16, 2015 from http://www.vinylcorp.com/products/stucco-plaster/casing-beads/archmaker-casing-beads.

"Archmaker™/ Bandmaker™ Casing Beads", Vinyl Corp., 2015, 1 pg., downloaded Nov. 16, 2015 from http://www.vinylcorp.com/products/stucco-plaster/casing-beads/archmaker-bandmaker-casing-beads.

(56) References Cited

OTHER PUBLICATIONS

"Backer Rod Products," Best Materials discount warehouse, Mar. 2016, 9 pgs., (https://web.archive.org/web/20160301082146/https://www.bestmaterials.com/Backer_Rod.aspx).
"BackerBead™ Drip Flashing—3½" Flange," ClarkDietrich, Dec. 2017, 2 pgs., (https://web.archive.org/web/20171210150830/http://www.vinylcorp.com/products/stucco-plaster/casing-beads/backerbead™-drip-flashing-3-12-flange).
"BackerBead™," Vinyl Corp., 2015, 1 pg. downloaded Dec. 6, 2016 from http://www.vinylcorp.com/products/stucco-plaster/casing-beads/backerbead%E2%84%A2.
"Bandmaker Series Casing Beads", Vinyl Corp., 2015. 1 pg, downloaded Nov. 16, 2015 from http://www.vinylcorp.com/products/stucco-plaster/casing-beads/bandmaker-series-casing-beads.
"BlazeFrame (CJB): "CJB" (Control Joint Backer)," Product Submittal Sheet, ClarkDietrich, May 30, 2014, 1 pg.
"BM 66 Series 1-Piece Bandmaker", Vinyl Corp., 2015, 1 pg., downloaded Nov. 16, 2015 from http://www.vinylcorp.com/products/stucco-plaster/casing-beads/bm-66-series-1-piece-bandmaker.
"Bullnose Casing Beads", Vinyl Corp., 2015, 1 pg., downloaded Nov. 16, 2015 from http://www.vinylcorp.com/products/stucco-plaster/casing-beads/bullnose-casing-beads.
"Casing Beads (with Weep Holes for ½" Sheathing)", Vinyl Corp., 2015, 1 pg., downloaded Nov. 16, 2015 from http://www.vinylcorp.com/products/stucco-plaster/casing-beads/casing-beads-weep-holes-12-sheathing.
"Casing Beads / Plaster Stops", Vinyl Corp., 2015, 1 pg., downloaded Nov. 16, 2015 from http://www.vinylcorp.com/products/stucco-plaster/casing-beads/casing-beads-plaster-stops.
"Casing Beads with Reveal", Vinyl Corp., 2015, 1 pg., downloaded Nov. 16, 2015 from http://www.vinylcorp.com/products/stucco-plaster/casing-beads/casing-beads-reveal.
"Casing Beads with Weep Holes", Vinyl Corp., 2015, 1 pg., downloaded Nov. 16, 2015 from http://www.vinylcorp.com/products/stucco-plaster/casing-beads/casing-beads-weep-holes.
"Caulking Tips: Use Backer Rod," Sashco, Inc., Oct. 2017, 3 pgs., (http://blog.sashco.com/blog/use-less-caulking-save-money).
"Ceiling Mounted Deflection Bead," Trim-Tex Drywall Products, Jun. 2016, 1 pg. (https://web.archive.org/web/20160619064021/https://www.trim-tex.com/products/overview/commercial-beads/deflection-beads/ceiling-mounted-deflection-bead/).
"Ceiling Trim Surface Mount (L-Bead Perforated)," Vinyl Corp., 2015, 1 pg. downloaded Jan. 28, 2016 from http://www.vinylcorp.com/products/drywall-veneer/beads-trims/ceiling-trim-surface-mount-1-bead-perforated.
"Ceiling Trims (L-Bead Perforated)," Vinyl Corp., 2015, 1 pg. downloaded Jan. 28, 2016 from http://www.vinylcorp.com/products/drywall-veneer/beads-trims/ceiling-trims-1-bead-perforated.
"CEMCO Hotrod Type-X Compressible Firestopping," CEMCO, Product Data Sheet, May 2019, 1 pg. (https://cemcosteel.com/steel-framing/head-wall/hot-rod-type-x).
"CEMCO Smoke and Sound Stop," CEMCO, Product Data Sheet, Aug. 2017, 1 pg. (https://cemcosteel.com/steel-framing/head-wall/fas-fas%c2%ae-track-1000-and-dda%e2%84%a2-head-wall-systems/smoke-and-sound-stop).
"Control Joints & Reveal Combinations," Vinyl Corp., 2015, 2 pgs. downloaded Jan. 28, 2016 from http://www.vinylcorp.com/products/stucco-plaster/control-joints/control-joints-reveal-combinations.
"Control Joints (Perforated Flanges)," Vinyl Corp., 2015, 1 pg. downloaded Jan. 28, 2016 from http://www.vinylcorp.com/products/drywall-veneer/control-joints/control-joints-perforated-flanges.
"Control Joints (Surface Application with Removable Tape," Vinyl Corp., 2015, 1 pg. downloaded Jan. 28, 2016 from http://www.vinylcorp.com/products/drywall-veneer/control-joints/control-joints-surface-application-removable-tape.
"Control Joints (Unperforated Flanges)," Vinyl Corp., 2015, 1 pg. downloaded Jan. 28, 2016 from http://www.vinylcorp.com/products/drywall-veneer/control-joints/control-joints-unperforated-flanges.
"Control Joints (with removable tape)," Vinyl Corp., 2015, 1 pg. downloaded Jan. 28, 2016 from http://www.vinylcorp.com/products/stucco-plaster/control-joints/control-joints-removable-tape.
"Control Joints," Vinyl Corp., 2015, 1 pg. downloaded Jan. 28, 2016 from http://www.vinylcorp.com/products/stucco-plaster/control-joints/control-joints.
"Corner Control Joints (with Removable Tape)," Vinyl Corp., 2015, 1 pg. downloaded Jan. 28, 2016 from http://www.vinylcorp.com/products/stucco-plaster/control-joints/corner-control-joints-removable-tape.
"Corner Expansion Joints," Vinyl Corp., 2015, 1 pg. downloaded Jan. 28, 2016 from http://www.vinylcorp.com/products/stucco-plaster/miscellaneous-accessories/corner-expansion-joints.
"D-66 Drop Plaster Stop," Vinyl Corp., 2015, 1 pg., downloaded Nov. 16, 2015 from http://www.vinylcorp.com/products/stucco-plaster/casing-beads/d-66-drop-plaster-stop.
"DEFS" F"Control Joints (w-Removable Tape)," Vinyl Corp., 2015, 1 pg. downloaded Jan. 28, 2016 from http://www.vinylcorp.com/products/eifs-defs/defs-control-joints/defs-f-control-joints-w-removable-tape.
"DEFS 45 Degree L-Bead," Vinyl Corp., 2015, 1 pg. downloaded Jan. 28, 2016 from http://www.vinylcorp.com/products/eifs-defs/defs-1-beads/defs-45-degree-l-bead.
"DEFS Casing Beads (w-Drip)," Vinyl Corp., 2015, 1 pg. downloaded Jan. 28, 2016 from http://www.vinylcorp.com/products/eifs-defs/defs-casing-beads/defs-casing-beads-w-drip.
"DEFS Casing Beads (w-Weep)," Vinyl Corp., 2015, 1 pg. downloaded Jan. 28, 2016 from http://www.vinylcorp.com/products/eifs-defs/defs-casing-beads/defs-casing-beads-w-weep.
"DEFS Casing Beads," Vinyl Corp., 2015, 1 pg. downloaded Jan. 28, 2016 from http://www.vinylcorp.com/products/eifs-defs/defs-casing-beads/defs-casing-beads.
"DEFS Control Joints (w-Removable Tape)," Vinyl Corp., 2015, 1 pg. downloaded Jan. 28, 2016 from http://www.vinylcorp.com/products/eifs-defs/defs-control-joints/defs-control-joints-w-removable-tape.
"DEFS L Stop Casing Beads (w-Splice)," Vinyl Corp., 2015, 1 pg. downloaded Jan. 28, 2016 from http://www.vinylcorp.com/products/eifs-defs/defs-l-beads/defs-l-stop-casing-beads-w-splice.
"DEFS L Stop Casing Beads," Vinyl Corp., 2015, 1 pg. downloaded Jan. 28, 2016 from http://www.vinylcorp.com/products/eifs-defs/defs-l-beads/defs-l-stop-casing-beads.
"DEFS Weeped Starter Strip/Casing Beads (w-Drip)," Vinyl Corp., 2015, 1 pg., downloaded Feb. 16, 2016 from http://vinylcorp.com/products/eifs-defs/defs-starter-strip/defs-weeped-starter-stripcasing-beads.
"Double Ground (Bandmaker™ Series)", Vinyl Corp., 2015, 1 pg., downloaded Nov. 16, 2015 from http://www.vinylcorp.com/products/stucco-plaster/casing-beads/double-ground-bandmaker-series.
"Drip Casing Bead," Vinyl Corp., 2014, 1pg., downloaded Feb. 5, 2018 from http://www.vinylcorp.com/products/stucco-plaster/drip-screed-reveals/drip-casing-beads.
"Drip Casing Bead," Vinyl Corp., 2015, 1 pg. downloaded Jan. 28, 2016 from http://www.vinylcorp.com/products/eifs-defs/eifs-casing-beads/drip-casing-bead.
"DS15 Drip," Vinyl Corp., 2015, 1 pg. downloaded Feb. 17, 2016 from http://www.vinylcorp.com/products/stucco-plaster/miscellaneous-accessories/angle-clips.
"DX Expansion Joint," Vinyl Corp., 2015, 1 pg. downloaded Jan. 28, 2016 from http://www.vinylcorp.com/products/drywall-veneer/miscellaneous-accessories/dx-expansion-joint.
"E-Flange™ Casing Bead, PVC Casing Bead with Embeddable Flange Design," ClarkDietrich, Product Submittal Sheet, Dec. 2020, 1 pg., downloaded Feb. 4, 2021 from E-Flange™ Casing Bead | ClarkDietrich_Building_Systems.
"E-Flange™ Control Joint, PVC Control Joint with Embeddable Flange Design," ClarkDietrich, Product Submittal Sheet, Dec. 2020, 1 pg. downloaded Feb. 4, 2021 from E-Flange™ Control Joint | ClarkDietrich Building Systems.
"Expansion Joints (Slip Joint)," Vinyl Corp., 2015, 1 pg. downloaded Jan. 28, 2016 from http://www.vinylcorp.com/products/stucco-plaster/expansion-joints/expansion-joints-slip-joint.

(56) References Cited

OTHER PUBLICATIONS

"E-Z Bead™ Vinyl Casing Bead," AMICO Building Products, Mar. 2016, 3 pgs., (https://web.archive.org/web/20160331140912/http://amico-lath.com/e-z-bead.htm).
"F Control Joints (with removable tape)," Vinyl Corp., 2015, 1 pg. downloaded Jan. 28, 2016 from http://www.vinylcorp.com/products/stucco-plaster/control-joints/f-control-joints-removable-tape.
"F" Series Control Joint and Vent, ClarkDietrich, 2020, 1 pg., downloaded Jul. 12, 2022 from https://www.clarkdietrich.com/products/f-series-control-joint-and-vent#description.
"FAS-093X, Fire Rated Control Joint, Drywall or veneer plaster fire rated control joint," ClarkDietrich, Product Submittal Sheet, Jan. 2020, 1 pg. downloaded Feb. 4, 2021 from FAS-093X_Fire_Rated_Control_Joint_| _ClarkDietrich_Building_Systems.
"FAS-093X-V (Vinyl) Fire Rated Control Joint," CEMCO, Spec Sheet, Sep. 3, 2019, 1 pg., downloaded Feb. 24, 2021 from FAS 093X-V (Vinyl) Fire-Rated Control Joint | CEMCO (cemcosteel.com).
"Female & Male Casing Expansion Joint Components," Vinyl Corp., 2015, 2 pgs. downloaded Jan. 28, 2016 from http://www.vinylcorp.com/products/stucco-plaster/miscellaneous-accessories/female-male-casing-expansion-joint-components.
"Female Casing Expansion Joint," ClarkDietrich, 2015, 1 pg. downloaded Jan. 28, 2016 from http://www.clarkdietrich.com/products/vinyl-expansion-control-joints/female-casing-expansion-joint.
"Inside Corner Control Joints," Vinyl Corp., 2015, 1 pg. downloaded Jan. 28, 2016 from http://www.vinylcorp.com/products/stucco-plaster/control-joints/inside-corner-control-joints.
"Installation Between Tees," Vinyl Corp., 2015, 1 pg. downloaded Jan. 28, 2016 from http://www.vinylcorp.com/products/acoustical-ceiling/vce-expansion-joints/installation-between-tees.
"Installation Between Wall & Tees," Vinyl Corp., 2015, 1 pg. downloaded Jan. 28, 2016 from http://www.vinylcorp.com/products/acoustical-ceiling/vce-expansion-joints/installation-between-wall-tees.
"Installation Drywall to Drywall," Vinyl Corp., 2015, 1 pg. downloaded Jan. 28, 2016 from http://www.vinylcorp.com/products/acoustical-ceiling/vce-expansion-joints/installation-drywall-drywall.
"Installation on Wall to Drywall," Vinyl Corp., 2015, 1 pg. downloaded Jan. 28, 2016 from http://www.vinylcorp.com/products/acoustical-ceiling/vce-expansion-joints/installation-wall-drywall.
"Long Flange Casing Beads/Plaster Stops," Vinyl Corp., 2015, 1 pg., downloaded Nov. 16, 2015 from http://www.vinylcorp.com/products/stucco-plaster/casing-beads/long-flange-casing-beads-plaster-stops.
"Male Casing Expansion Joint," ClarkDietrich, 2015, 1 pg. downloaded Jan. 29, 2016 from http://www.clarkdietrich.com/products/vinyl-expansion-control-joints/male-casing-expansion-joint.
"Mid Wall Control Joints," Vinyl Corp., 2015, 1 pg. downloaded Jan. 28, 2016 from http://www.vinylcorp.com/products/stucco-plaster/control-joints/mid-wall-control-joints.
"Mini Control Joints," Vinyl Corp., 2015, 1 pg. downloaded Jan. 28, 2016 from http://www.vinylcorp.com/products/stucco-plaster/control-joints/mini-control-joints.
"Muddable "J" Beads (with removable leg)," Vinyl Corp., 2015, 1 pg. downloaded Jan. 28, 2016 from http://www.vinylcorp.com/products/drywall-veneer/beads-trims/muddable-j-beads-removable-leg.
"Muddable "J" Beads," Vinyl Corp., 2015, 1 pg. downloaded Jan. 28, 2016 from http://www.vinylcorp.com/products/drywall-veneer/beads-trims/muddable-j-beads.
"Muddable "J" Beads," Vinyl Corp., 2015, 1 pg. downloaded Jan. 28, 2016 from http://www.vinylcorp.com/products/eifs-defs/defs-j-beads/muddable-j-beads.
"PB Control Joint," Vinyl Corp., 2015, 1 pg. downloaded Jan. 28, 2016 from http://www.vinylcorp.com/products/eifs-defs/eifs-control-joints/pb-control-joint.
"PB Header Weeped Starter Strip," Vinyl Corp., 2015, 1 pg., downloaded Feb. 16, 2016 from http://vinylcorp.com/products/eifs-defs/eifs-starter-strips/pb-header-weeped-starter-strip.
"PB Standard Starter Strip/Casing Beads (3/32" Finish)," Vinyl Corp., 2015, 1 pg., downloaded Feb. 16, 2016 from http://vinylcorp.com/products/eifs-defs/eifs-starter-strips/pb-standard-starter-stripcasing-beads-332-finish.
"PB Starter Strip (Back Weep Holes 3/32" Finish)," Vinyl Corp., 2015, 1 pg., downloaded Feb. 16, 2016 from http://vinylcorp.com/products/eifs-defs/eifs-starter-strips/pb-starter-strip-back-weep-332-finish.
"PB Starter Strip (Front & Back Weep Holes 3/32" Finish)," Vinyl Corp., 2015, 1 pg., downloaded Feb. 16, 2016 from http://vinylcorp.com/products/eifs-defs/eifs-starter-strips/pb-starter-strip-front-back-weep-332-finish.
"PB Starter Strip (Front Weep Holes 3/32" Finish)," Vinyl Corp., 2015, 1 pg., downloaded Feb. 16, 2016 from http://vinylcorp.com/products/eifs-defs/eifs-starter-strips/pb-starter-strip-front-weep-332-finish.
"PB Starter Strip/Casing Beads (1/16" Finish)," Vinyl Corp., 2015, 1 pg., downloaded Feb. 16, 2016 from http://vinylcorp.com/products/eifs-defs/eifs-starter-strips/pb-starter-stripcasing-beads-116-finish.
"PB Starter Strip/Casing Beads (w-Drip & Weep 1/16" Finish)," Vinyl Corp., 2015, 1 pg., downloaded Feb. 16, 2016 from http://vinylcorp.com/products/eifs-defs/eifs-starter-strips/pb-starter-stripcasing-beads-w-drip-weep-116-finish.
"PB Starter Strip/Casing Beads (w-Drip 1/16" Finish)," Vinyl Corp., 2015, 1 pg., downloaded Feb. 16, 2016 from http://vinylcorp.com/products/eifs-defs/eifs-starter-strips/pb-starter-stripcasing-beads-w-drip-116-finish.
"Penetration Sealant Recommendations, Exterior Systems 600-300," Northwest Wall and Ceiling Bureau, Dec. 2005, 1 pg., (http://web.nweb.org/CWT/External/WCPages/WCWebContent/WebContentPage.aspx?ContentID=116).
"PM "F" Control Joints (w-Removable Tape ¼" & ⅜" Finish)," Vinyl Corp., 2015, 1 pg. downloaded Jan. 28, 2016 from http://www.vinylcorp.com/products/eifs-defs/eifs-control-joints/f-control-joints-w-removable-tape-14-38-finish.
"PM Casing Bead," Vinyl Corp., 2015, 1 pg. downloaded Jan. 28, 2016 from http://www.vinylcorp.com/products/eifs-defs/eifs-casing-beads/pm-casing-beads.
"PM Control Joint (⅜" Finish Systems)," Vinyl Corp., 2015, 1 pg. downloaded Jan. 28, 2016 from http://www.vinylcorp.com/products/eifs-defs/eifs-control-joints/pm-control-joint-38-finish-systems.
"PM Control Joints (Surface Application w-Removable Tape)," Vinyl Corp., 2015, 1 pg. downloaded Jan. 28, 2016 from http://www.vinylcorp.com/products/eifs-defs/eifs-control-joints/pm-control-joint-surface-application-w-removable-tape.
"PM Starter Strip (Reinforced)," Vinyl Corp., 2015, 1 pg., downloaded Feb. 16, 2016 from http://vinylcorp.com/products/eifs-defs/eifs-starter-strips/pm-starter-strip-reinforced.
"PM Starter Strip/Casing Beads (w-Front Weep Holes)," Vinyl Corp., 2015, 1 pg., downloaded Feb. 16, 2016 from http://www.vinylcorp.com/products/eifs-defs/eifs-starter-strips/pm-starter-stripcasing-bead-w-front-weep-holes.
"PM Starter Strip/Casing Beads," Vinyl Corp., 2015, 1 pg., downloaded Feb. 16, 2016 from http://vinylcorp.com/products/eifs-defs/eifs-starter-strips/pm-starter-stripcasing-bead.
"PS26—"CJB" profiles for Protection of Control Joints," Safti-Seal, Product Profile dimensions, 1 pg., downloaded Feb. 4, 2021 from Product Profile Dimensions (saftiseal.com).
"Single V Hump Screed," Vinyl Corp., 2015, 1 pg. downloaded Jan. 28, 2016 from http://www.vinylcorp.com/products/stucco-plaster/control-joints/single-v-hump-screed.
"Step Bead," Vinyl Corp., 2015, 2 pgs., downloaded Nov. 16, 2015 from http://www.vinylcorp.com/products/stucco-plaster/casing-beads/step-bead.
"Track Within a Track Deflection Assembly," Industry Technical Note, Cold Formed Steel Construction, Steel Stud Manufactures Association (SSMA), Apr. 2000, 4 pgs. (http://www.customstud.com/pdfs/Tech_Notes_Details.pdf).

(56) References Cited

OTHER PUBLICATIONS

"Vinyl 093 Control Joint (VCJT)," ClarkDietrich, 2015, 1 pg. downloaded Jan. 28, 2016 from http://www.clarkdietrich.com/products/vinyl-trims-and-finishing-products/vinyl-093-control-joint-vcjt.
"Vinyl Casing Bead/Plaster Stop," ClarkDietrich, 2015, 1 pg., downloaded Nov. 16, 2015 from http://www.clarkdietrich.com/products/vinyl-corner-casing-beads/vinyl-casing-bead-plaster-stop.
"Vinyl Control Joint W/Tape," ClarkDietrich, 2015, 1 pg. downloaded Jan. 28, 2016 from http://www.clarkdietrich.com/products/vinyl-expansion-control-joints/vinyl-control-joint-w-tape.
"Vinyl Control Joint," ClarkDietrich, 2015, 1 pg. downloaded Jan. 28, 2016 from http://www.clarkdietrich.com/products/vinyl-expansion-control-joints/vinyl-control-joint.
"Wall Mounted Deflection Bead," Trim-Tex Drywall Products, Jul. 2016, 1 pg. (https://web.archive.org/web/20160710062112/https://www.trim-tex.com/products/overview/commercial-beads/deflection-beads/wall-mounted-deflection-bead/).
"Weeped Starter Track," Vinyl Corp., 2014, 1 pg., downloaded Feb. 5, 2018 from http://www.vinylcorp.com/products/eifs-defs/eifs-starter-tracks/weeped-starter-track.
"Wide Expansion Joints (Slip Joint)," Vinyl Corp., 2015, 1 pg. downloaded Jan. 28, 2016 from http://www.vinylcorp.com/products/stucco-plaster/expansion-joints/wide-expansion-joints-slip-joint.
"XL Long Flange Casing Beads/ Plaster Stops", Vinyl Corp., 2015, 1 pg., downloaded Nov. 16, 2015 from http://www.vinylcorp.com/products/stucco-plaster/casing-beads/xl-long-flange-casing-beads-plaster-stops.
"Zinc Control Joints," ClarkDietrich, 2015, 1 pg. downloaded Jan. 28, 2016 from http://www.clarkdietrich.com/products/zinc-expansion-control-joints/zinc-control-joints.
3M Fire Protection Products, "Applicators and Specifiers Guide, 3M™ Expantrol™ Flexible Intumescent Strip E-FIS," p. xviii, and "Article Information Sheet," 2014, downloaded from https://www.3m.com/3M/en_US/company-us/all-3m-products/~/3M-Expantrol-Flexible-Intumescent-Strip-E-FIS/?N=5002385+3293123900&rt=rud, 4 pgs.
CEMCO, "FAS Reveal—18 Mil," Product Data Sheet, Aug. 29, 2016, 1 pg.
CEMCO, "FAS-RBR (Rated Base Reveal)," Product Data Sheet, Sep. 2016, 1 pg. (https://cemcosteel.com/steel-framing/fas-wall-products/fas-rated-base-reveal-rbr).
CEMCO, "FAS-RBR Strap (Rated Base Reveal)," Product Data Sheet, Sep. 2016, 1 pg. (https://cemcosteel.com/steel-framing/fas-wall-products/fas-rbr-strap).
Control Joint Gasket (CJG) & Fire Rated Gasket (FRG), Fire, Smoke & Sound Rating—Zinc or Vinyl Control & Mullion Joints, SaftiSeal, 2018, 2 pgs., downloaded Jul. 12, 2022 from https://www.saftiseal.com/documents/FlyerCJGchartcombo.pdf.
Control Joint with Removable Tape, ClarkDietrich, 2020, 1 pg., downloaded Jul. 12, 2022 from https://www.clarkdietrich.com/products/control-joint-removable-tape#description.
Control Joint, ClarkDietrich, 2020, 1 pg., downloaded Jul. 12, 2022 from https://www.clarkdietrich.com/products/control-joint#description.
EcoStud, "EcoStud® Track and Stud System," Drawing No. 11-5031-4, dated May 11, 2011. downloaded Aug. 28, 2017 from http://ecostud.com/sites/default/files/track_11-5031-4.pdf, 1 pg.
EcoStud, "EcoStud® Track and Stud System," Drawing No. 11-5043-1, dated May 11, 2011, downloaded Aug. 28, 2017 from http://ecostud.com/sites/default/files/stud_11-5043-1.pdf, 1 pg.
EcoStud, "Product Details," downloaded Aug. 28, 2017 from http://ecostud.com/product-details, 1 pg.
EIFS/DEFS Control Joint w/Removable Tape, ClarkDietrich, 2019, 1 pg., downloaded Jul. 12, 2022 from https://www.clarkdietrich.com/products/eifs-defs-control-joint-w-removable-tape#description.
Factory Fabricated Vinyl Control Joints, ClarkDietrich, 2020, 1 pg., downloaded Jul. 12, 2022 from https://www.clarkdietrich.com/products/factory-fabricated-vinyl-control-joints#resources.
Fire Rated Gasket—"FGR" Flex Lock Edge Joint Protection, SaftiSeal, 2018, 2 pgs., downloaded Jul. 12, 2022 from https://www.saftiseal.com/documents/Flyer-FRG-222.pdf.
Grainger, "STI—Fire Barrier Foil Tape, 2" Width," 2015, downloaded from https://web.archive.org/web/20151001140949/https://www.grainger.com/product/STI-Fire-Barrier-Foil-Tape-4MM48, 2 pgs.
Inside Control Joint (With Removable Tape), ClarkDietrich, 2020, 1 pg., downloaded Jul. 12, 2022 from https://www.clarkdietrich.com/products/inside-control-joint-removable-tape#description.
International Fireproof Technology, Inc. (IFTI), "HITS—High Intumescent Sheet—Paint to Protect," Information and Data Sheet, 2017, downloaded from https://www.painttoprotect.com/hits-intumescent-sheet/ 4 pgs.
International Fireproof Technology, Inc. (IFTI), "INFS0812 Intumescent Strip," Information and Data Sheet, 2018, https://www.painttoprotect.com/infs0812-intumescent-strip/ 5 pgs.
Mid Wall Weep Screed—M Style, ClarkDietrich, 2020, 1 pg., downloaded Jul. 12, 2022 from https://www.clarkdietrich.com/products/mid-wall-weep-screed-m-style#description.
Mid Wall Weep Screed with Weed Holes/Tape, ClarkDietrich, 2020, 1 pg., downloaded Jul. 12, 2022 from https://www.clarkdietrich.com/products/mid-wall-weep-screed-weep-holes-tape#description.
NOMACO, "NOMAFLEX® Polypropylene Joint Filler," 2016, downloaded from https://www.nomaco.com/wp-content/uploads/2016/09/cp_0030_nomaflex_0916.pdf, 2 pgs.
Product Catalog, Vinyl Corp., 2004, Miami, FL.
Safti-Seal "FSB" (Flat Strap Backer), SaftiSeal, 2018, 3 pgs., downloaded Jul. 12, 2022 from https://www.saftiseal.com/documents/FlyerFSBcombo.pdf.
Soffit Vent Control Joint Combination, ClarkDietrich, 2020, 2 pgs., downloaded Jul. 12, 2022 from https://www.clarkdietrich.com/products/soffit-vent-control-joint-combination#description.
STI Product Data Sheet, SpeedFlex © Series TTG Track Top Gasket, FOD-5181-0434, 2016, 1 pg.
Stockton Products, DRM-RR: Wall Reveal—Rated Reveal™, 2021, downloaded from www.stocktonproducts.com/datasheets/DRM-RR.pdf, 1 pg.
Stucco Drywall Insulated Exteriors Accessories, Vinyl Corp., 1988, pp. 1-10, Miami.
Stucco Drywall Insulated Exteriors Accessories, Vinyl Corp., 1989, pp. 1-11, Miami, FL.
Stucco Plaster Veneer Drywall Insulated Wall & Ceiling Accessories, Vinyl Corp., 1990, pp. 1-15, Miami.
Vinyl 3-½" Drip Screed W/Weep Holes and Tape, 2020, 1 pg., downloaded Jul. 12, 2022 from https://www.clarkdietrich.com/products/vinyl-3-1-2-drip-screed-w-weep-holes-and-tape#description.
Zinc Control Joints #38, #50 & #75, ClarkDietrich, 2020, 1 pg., downloaded Jul. 12, 2022 from https://www.clarkdietrich.com/products/zinc-control-joints-38-50-75#description.
Letter dated May 20, 2015 to Ryan Smith, Vinyl Corp., from John F.A. Earley III, Esq., Law Offices of Harding, Earley, Follmer & Frailey, P.C., re: Infringement of U.S. Pat. Nos. 8,615,944 and 7,874,123, 19 pgs.
Letter dated Jun. 9, 2015 to John F.A. Earley, III, Esq., Law Offices of Harding, Earley, Follmer & Frailey, P.C., from Ann Schoen, Esq., Frost Brown Todd LLC, re: U.S. Pat. Nos. 8,615,944 and 7,874,123, 5 pgs . . . .
Letter dated Mar. 10, 2016 to Ann Schoen, Esq., Frost Brown Todd LLC, from M. Joseph Clement, Esq., Wisler Pearlstine, LLP, re: EZ Bead U.S. Pat. Nos. 8,615,944; 7,874,123; and 9,279,247; and U.S. Appl. No. 1/259,499, 16 pgs.
Letter dated Mar. 25, 2016 to M. Joseph Clement, Esq., Wisler Pearlstine, LLP, from Ann Schoen, Esq., Frost Brown Todd LLC, re: U.S. Pat. Nos. 9,279,247; 8,615,944; and 7,874,123, 2 pgs.
UL Certification, System No. HW-D-0277, XHBN.HW-D-0277, Joint Systems, Effective Apr. 20, 2010, 3 pgs.
UL Certification, System No. HW-S-0004, XHBN.HW-S-0004, Joint Systems, Effective Sep. 8, 2004, 2 pgs.
Canadian Office Action, Application for Registration of an Industrial Design Examiner's Report dated Sep. 20, 2018 for Application No. CA 178,867 S, 4 pgs.

(56) References Cited

OTHER PUBLICATIONS

Canadian Industrial Design Certificate of Registration dated Dec. 2018 for Registration No. CA 178,867 S; titled: L-Bead with a Backing Strip; applicant: Clarkwestern Dietrich Building Systems, LLC; 15 pgs.
Canadian Filing Certificate dated Dec. 20, 2017 for CA 2,989,713; titled: Finishing Accessory with Backing Strip; applicant: Clarkwestern Dietrich Building Systems, LLC; 1 pg.
European Union Certificate of Registration for the Registered Community Design No. 004558666-0001, Registered Dec. 20, 2017, on behalf of Clarkwestern Dietrich Building Systems LLC, 9 pgs.
European Union Certificate of Registration for the Registered Community Design No. 004558666-0002, Registered Dec. 20, 2017, on behalf of Clarkwestern Dietrich Building Systems LLC, 9 pgs.
European Union Certificate of Registration for the Registered Community Design No. 004558666-0003, Registered Dec. 20, 2017, on behalf of Clarkwestern Dietrich Building Systems LLC, 9 pgs.
European Union Certificate of Registration for the Registered Community Design No. 004558666-0004, Registered Dec. 20, 2017, on behalf of Clarkwestern Dietrich Building Systems LLC, 9 pgs.
U.S. Office Action dated Feb. 22, 2017 for U.S. Appl. No. 15/083,724, 14 pgs.
U.S. Appl. No. 10/602,198, filed Jun. 24, 2003, by Collins et al., entitled: Jamb and Header Surround for Masonry Wall.
U.S. Appl. No. 11/259,499, filed Oct. 26, 2005, by Maziarz, entitled: Stop Bead for Separating Stucco Material From a Frame of a Window or Door.
U.S. Appl. No. 60/637,379, filed Dec. 20, 2004 by Klein.
U.S. Appl. No. 60/954,029, filed Aug. 6, 2007 by Pilz.
U.S. Appl. No. 60/957,434, filed Aug. 22, 2007 by Pilz.
U.S. Appl. No. 60/997,521, filed Oct. 4, 2007 by Klein.
U.S. Appl. No. 61/007,439, filed Dec. 13, 2007 by Klein.
U.S. Appl. No. 61/021,418, filed Jan. 16, 2008 by Pilz.
U.S. Appl. No. 61/244,277, filed Sep. 21, 2009 by Pilz.
U.S. Appl. No. 61/253,059, filed Oct. 19, 2009 by Gonzales.
U.S. Appl. No. 61/379,047, filed Sep. 1, 2010 by Pilz.
U.S. Appl. No. 61/461,383, filed Jan. 18, 2011 by Burgess.
U.S. Appl. No. 61/510,634, filed Jul. 22, 2011 by Burgess.
U.S. Appl. No. 61/589,188, filed Jan. 20, 2012 by Pilz.
U.S. Appl. No. 61/905,706, filed Nov. 18, 2013 by Foerg et al.
U.S. Appl. No. 61/905,711, filed Nov. 18, 2013 by Muenzenberger et al.
U.S. Appl. No. 61/972,943, filed Mar. 31, 2014 by Klein et al.
U.S. Appl. No. 61/972,956, filed Mar. 31, 2014 by Klein et al.
U.S. Appl. No. 61/972,969, filed Mar. 31, 2014 by Klein et al.
U.S. Appl. No. 61/996,866, filed May 16, 2014 by Stahl et al.
U.S. Appl. No. 61/998,187, filed Jun. 23, 2014 by Stahl et al.
U.S. Appl. No. 62/026,974, filed Jul. 21, 2014 by Klein et al.
U.S. Appl. No. 62/026,993, filed Jul. 21, 2014 by Klein et al.
U.S. Appl. No. 62/104,627, filed Jan. 16, 2015 by Pilz.
U.S. Appl. No. 62/313,606, filed Mar. 25, 2016 by Pilz et al.
U.S. Appl. No. 62/389,856, filed Mar. 11, 2016 by Ackerman et al.
U.S. Appl. No. 62/391,984, filed May 16, 2016 by Ackerman et al.
U.S. Appl. No. 62/436,937, filed Dec. 20, 2016 by Stahl.
U.S. Appl. No. 62/509,400, filed May 22, 2017 by Stahl et al.

* cited by examiner

CONTROL JOINT

PRIORITY

This application claims priority to U.S. Provisional Pat. App. No. 63/112,925, entitled "Control Joint," filed on Nov. 12, 2020, the disclosure of which is incorporated by reference herein.

BACKGROUND

A control joint is a type of framing accessory used in the construction industry, particularly as part of wall assemblies. Traditionally, control joints have been used to "break up" vast expanses of drywall in wall assemblies, which can be prone to cracking. Building codes recommend the use of a control joint in conjunction with a gap in the drywall to allow the whole assembly to flex and move, thus avoiding or at least reducing cracking and the drywall being compromised. Control joints are typically made out of pure zinc alloy or a plastic, such as polyvinyl chloride (PVC). FIGS. 1-3 illustrate a conventional control joint (10) and corresponding conventional wall assemblies (20, 30) that include control joint (10).

As shown, control joint (10) includes a pair of flanges (12, 14) attached to and extending from either side of a flex portion (16). Flex portion (16) is configured to allow control joint (10) to flex in order to allow the wallboard panels (24, 26) to move relative to each other (e.g., wallboard panels (24, 26) could move closer to each other and close gap (22) or wallboard panels (24, 26) could move away from each other and widen gap (22)). Wallboard panels (24, 26) may comprise drywall, cement board, or any other material suitable to serve as a panel in the wall assembly. In this embodiment, control joint (10) also includes a removable protective strip (18) positioned over flex portion (16). Protective strip (18) may be configured to help prevent material, such as joint compound, plaster, paint or other similar finishing materials, from entering flex portion (16) during installation of control joint (10). Once control joint (10) is installed, then protective strip (18) may be removed leaving flex portion (16) substantially free of material that could negatively impact the performance or aesthetic appearance of control joint (10).

As shown in FIG. 2, control joint (10) is installed as part of wall assembly (20). Wall assembly (20) may comprise a header track, a footer track, a plurality of vertically oriented studs extending between the header track and footer track, and at least two adjacent drywall or wallboard panels (24, 26) supported by the plurality of studs. Specifically, control joint (10) is installed within gap (22) between wallboard panels (24, 26). Control joint (10) is installed such that flex portion (16) is positioned within gap (22) and flanges (12, 14) are positioned against an outer surface (24*a*, 26*a*) of a respective drywall panel (24, 26). Control joint 10 may be attached to drywall panels (24, 26) via fasteners, adhesive, or any other suitable means or methods known in the industry. After installation, flanges (12, 14) may be coated with a finishing material such as joint compound and/or paint. The openings in each of the respective flanges (12, 14) may facilitate application of the finishing material.

FIG. 3 depicts another exemplary wall assembly (30) that includes a pair of control joints (10) installed on either side of wall assembly (30) within a respective gap (32) between respective pairs of wallboard panels (34, 36). FIG. 3 also depicts a pair of vertical metal studs (38) that are part of wall assembly (30).

While a variety of control joints have been made and used, it is believed that no one prior to the inventors has made or used an invention as described herein.

BRIEF DESCRIPTION OF THE DRAWINGS

It is believed the present invention will be better understood from the following description of certain examples taken in conjunction with the accompanying drawings, in which like reference numerals identify the same elements and in which.

Figure 1:
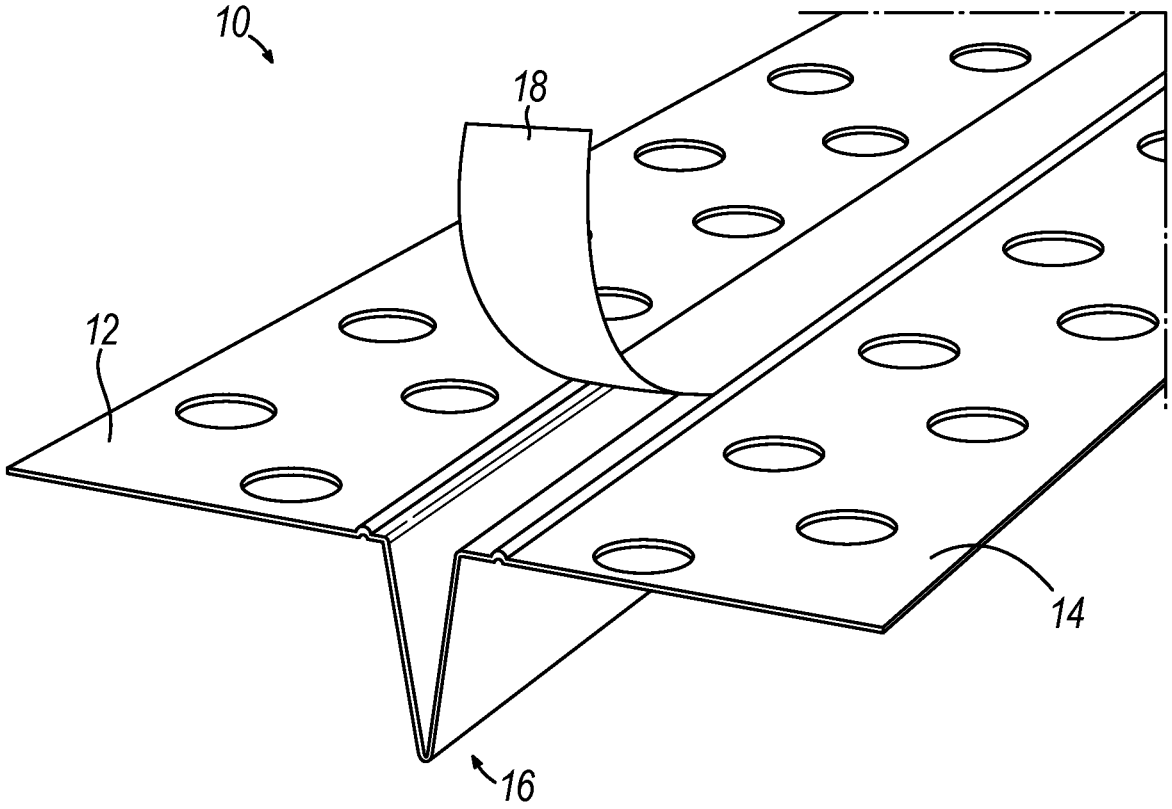
FIG. 1 PRIOR ART
FIG. 1 depicts a perspective view of a prior art control joint.
Figure 2:
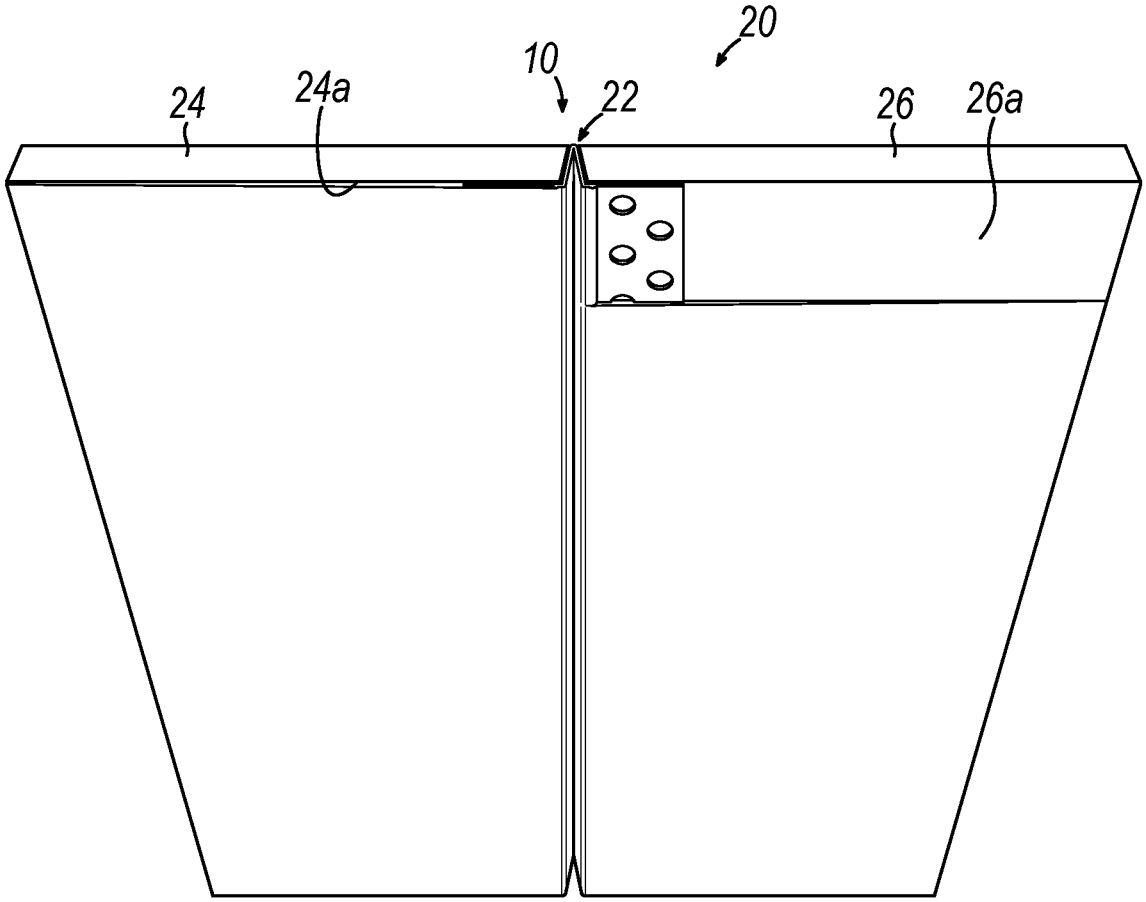
FIG. 2 PRIOR ART
FIG. 2 depicts a front perspective view of an exemplary wall assembly that includes the control joint of FIG. 1.
Figure 3:
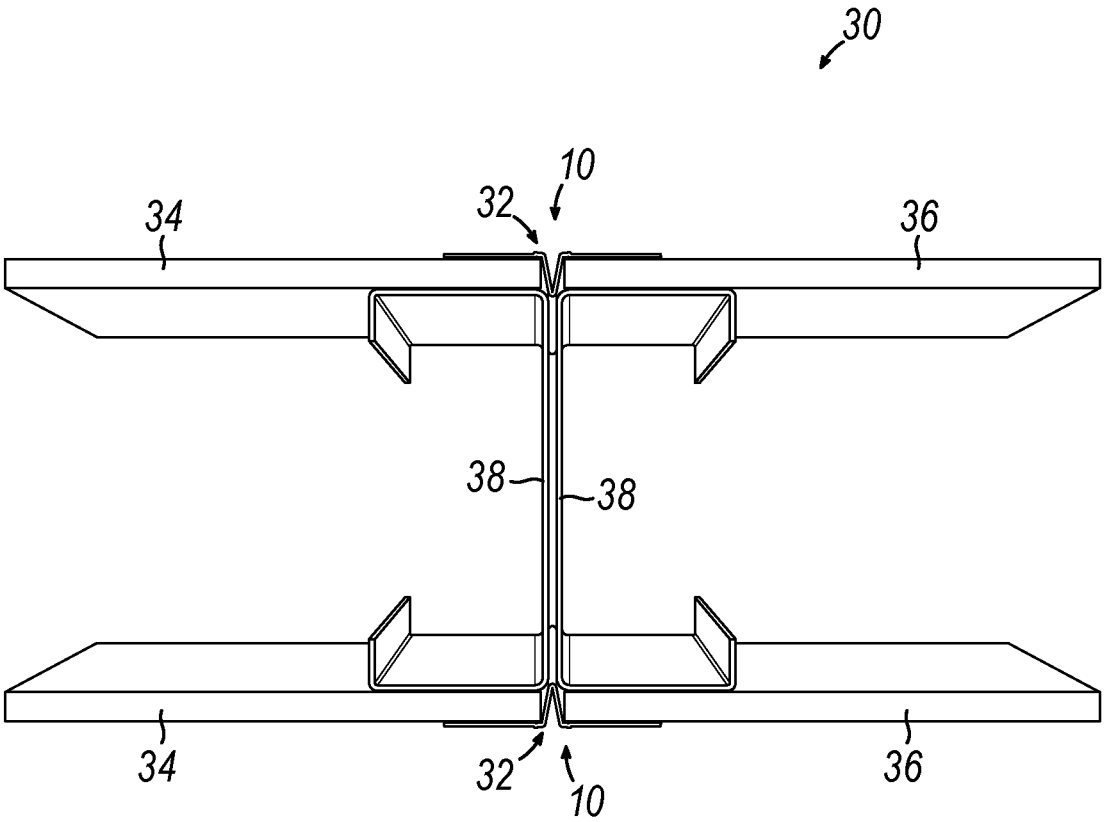
FIG. 3 PRIOR ART
FIG. 3 depicts a top view of another exemplary wall assembly that includes the control joint of FIG. 1.
Figure 4:
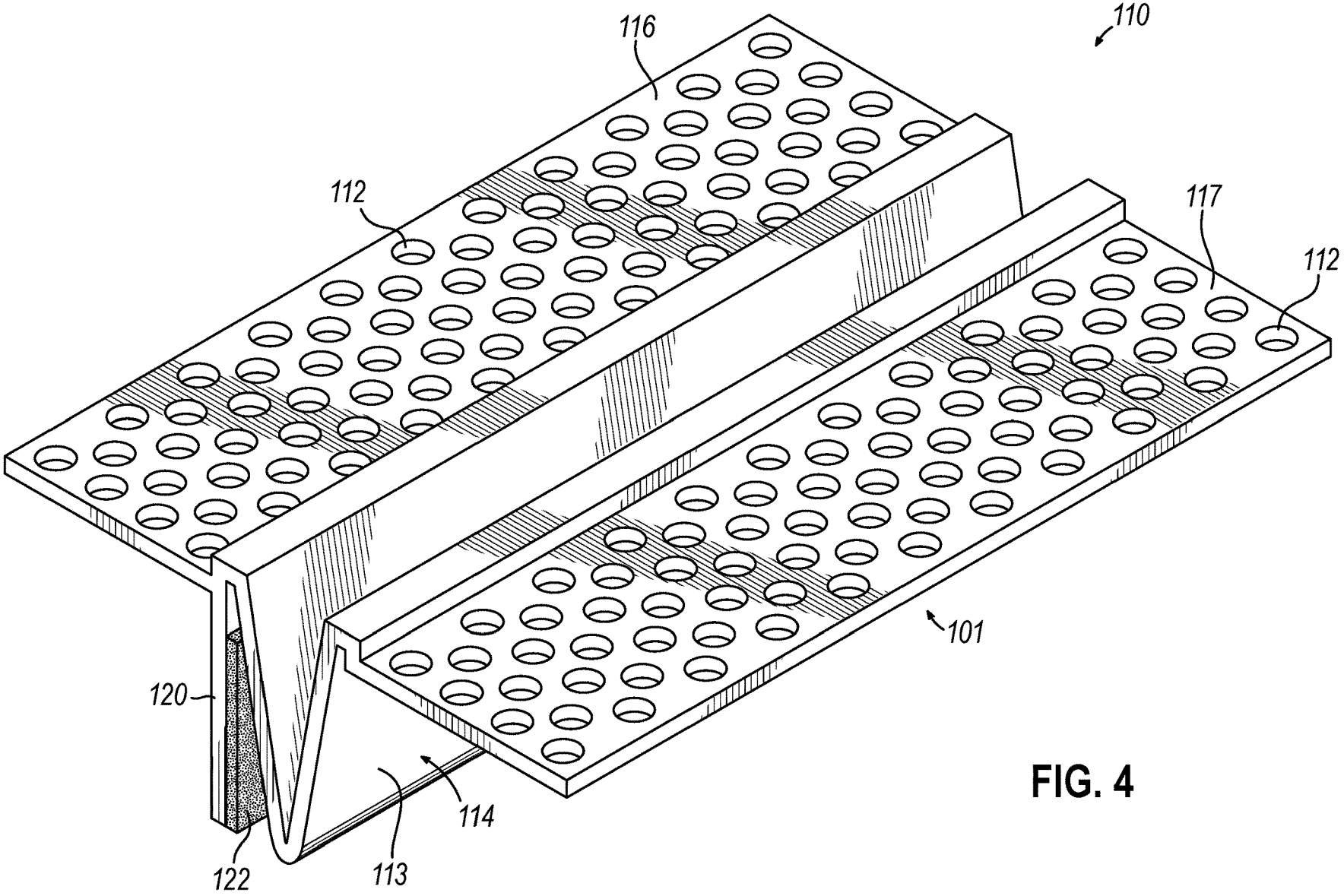
FIG. 4 depicts a perspective view of an exemplary control joint.
Figure 5:
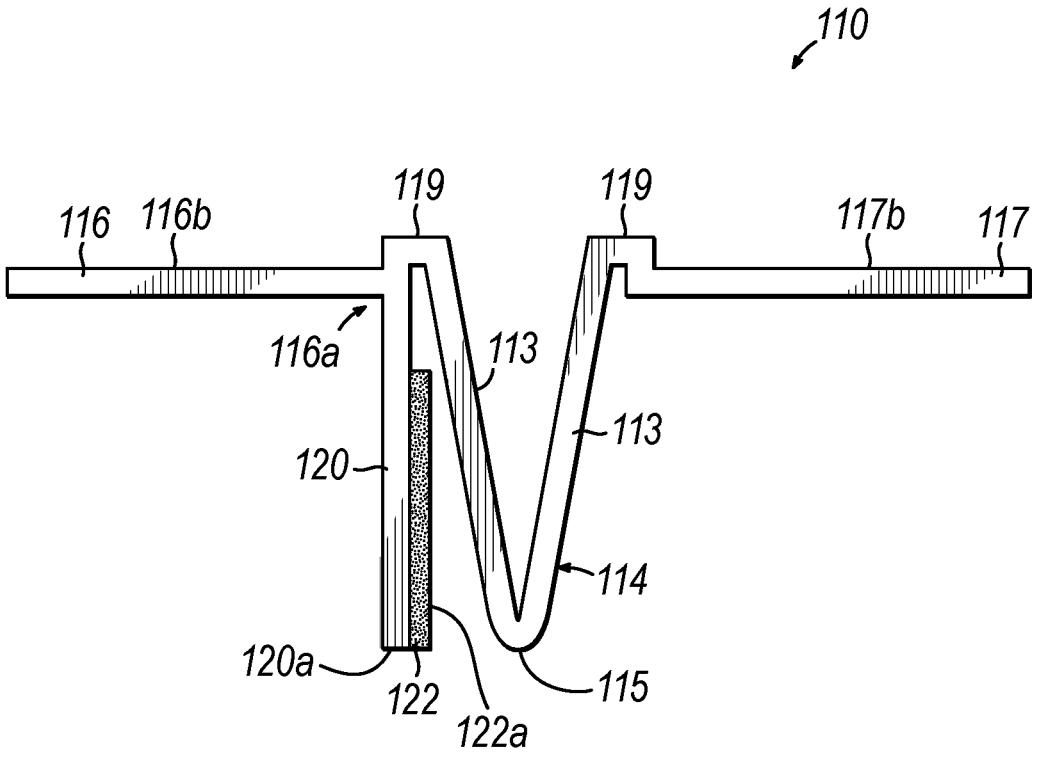
FIG. 5 depicts a front elevational view of the control joint of FIG. 4.
Figure 6:
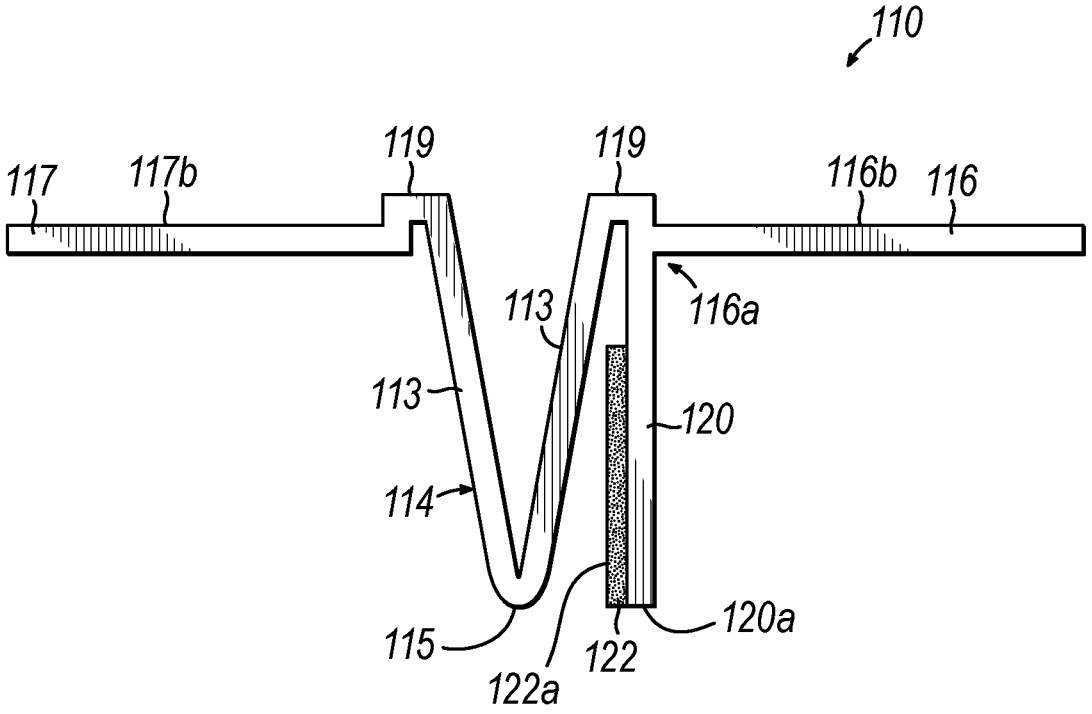
FIG. 6 depicts a rear elevational view of the control joint of FIG. 4.
Figure 7:
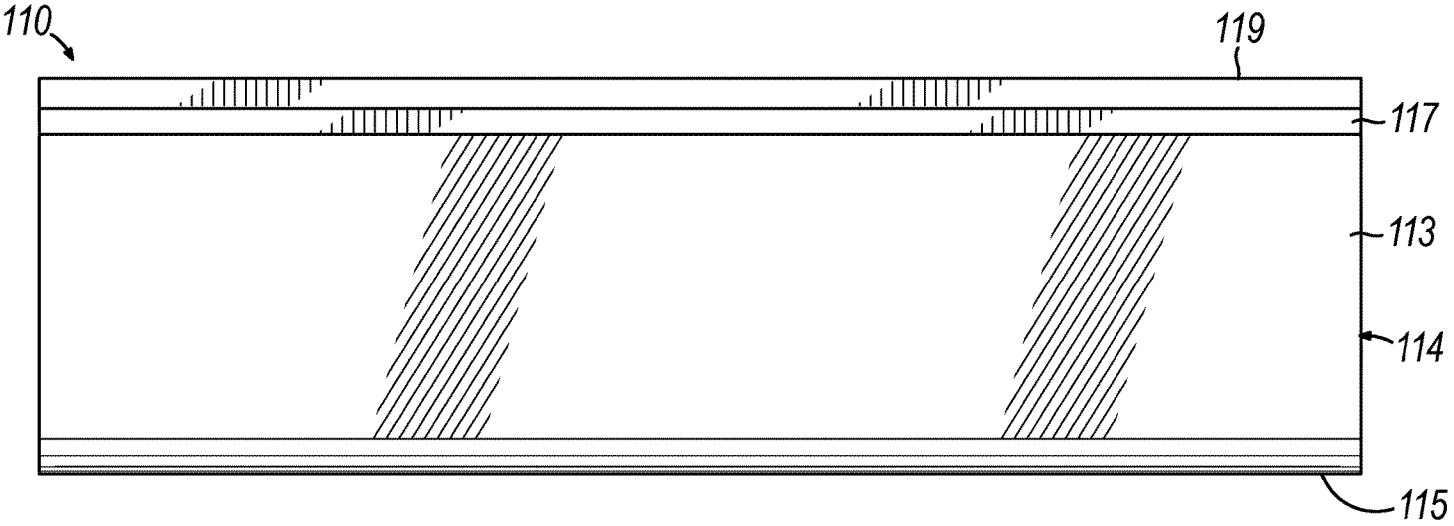
FIG. 7 depicts a right side elevational view of the control joint of FIG. 4.
Figure 8:
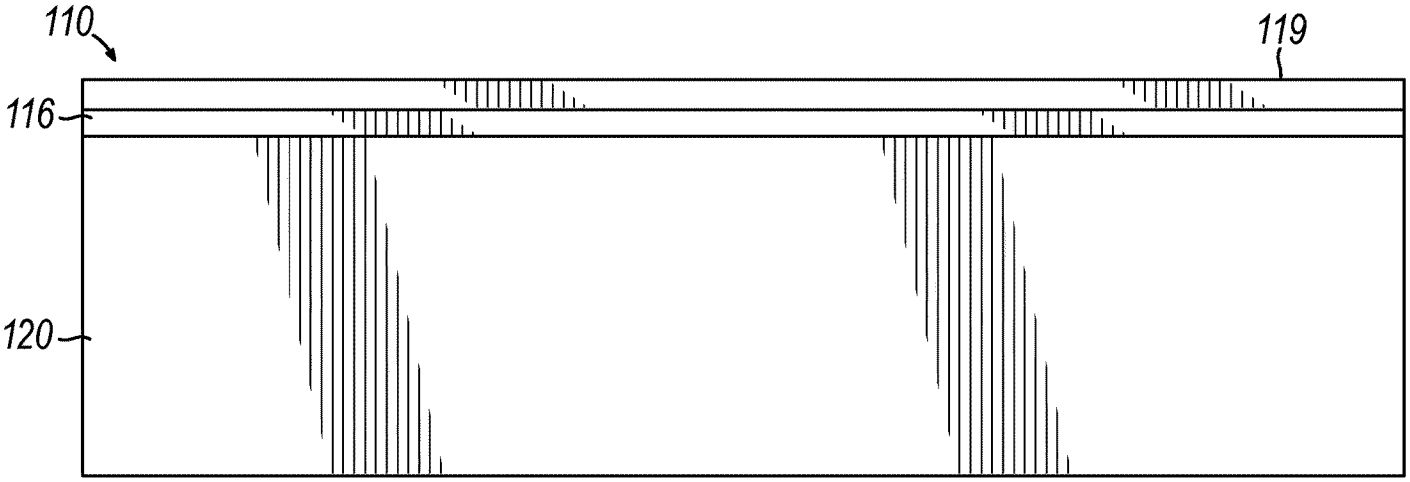
FIG. 8 depicts a left side elevational view of the control joint of FIG. 4.
Figure 9:
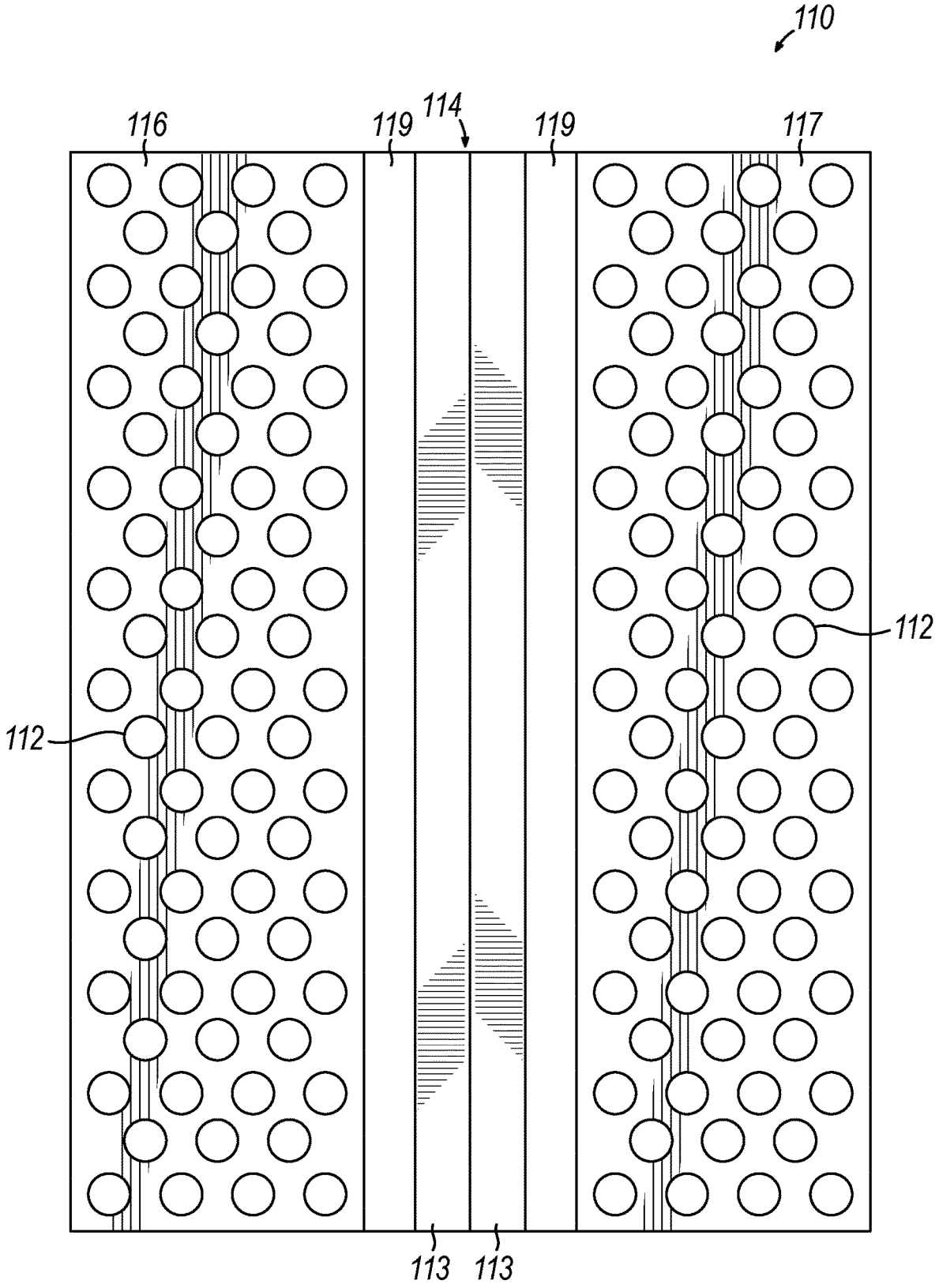
FIG. 9 depicts a top plan view of the control joint of FIG. 4.
Figure 10:
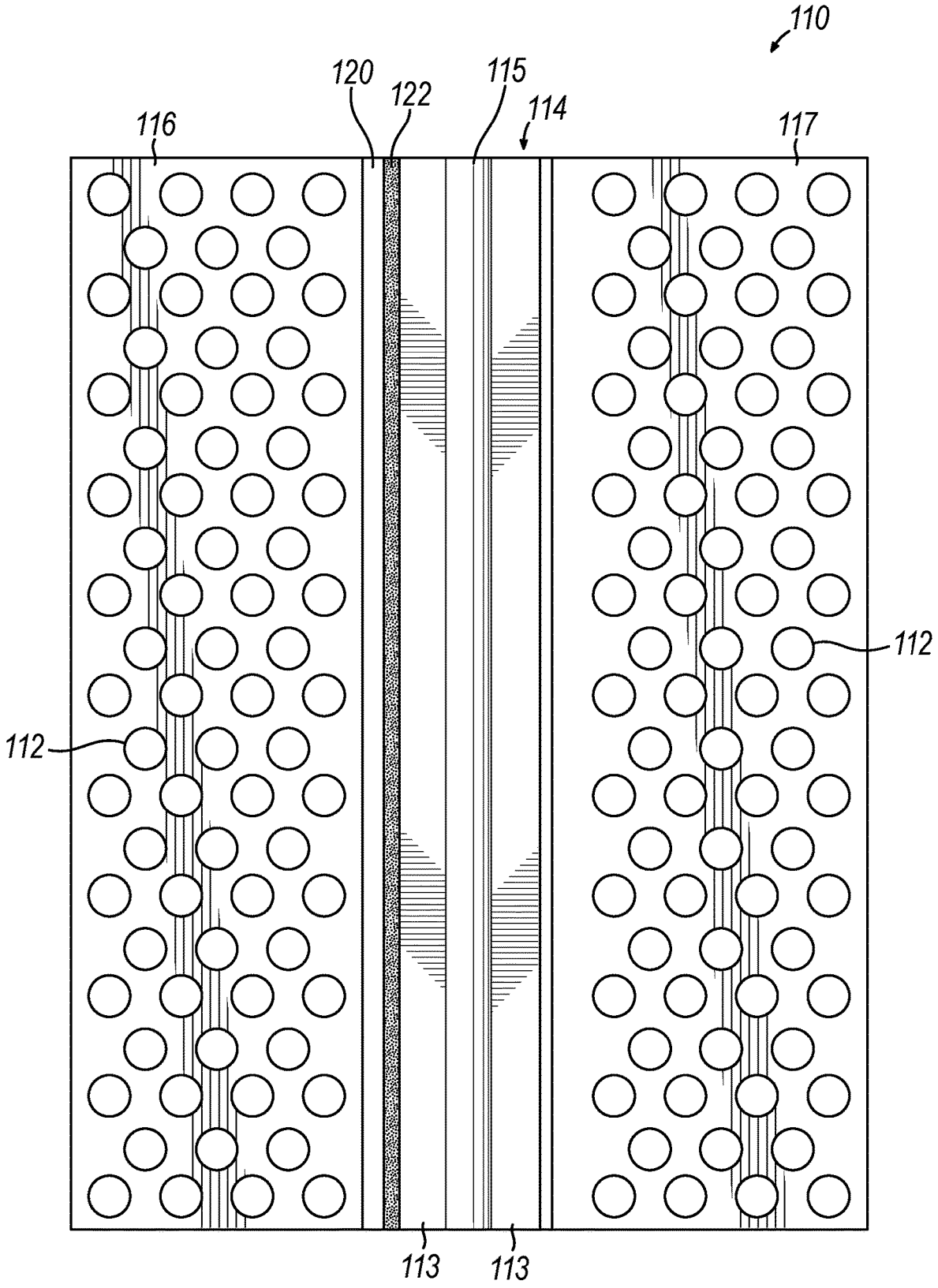
FIG. 10 depicts a bottom plan view of the control joint of FIG. 4.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

It will be appreciated that any one or more of the teachings, expressions, embodiments, versions, examples, etc. described herein may be combined with any one or more of the other teachings, expressions, embodiments, versions, examples, etc. that are described herein. The following-described teachings, expressions, embodiments, versions, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Figure 11:
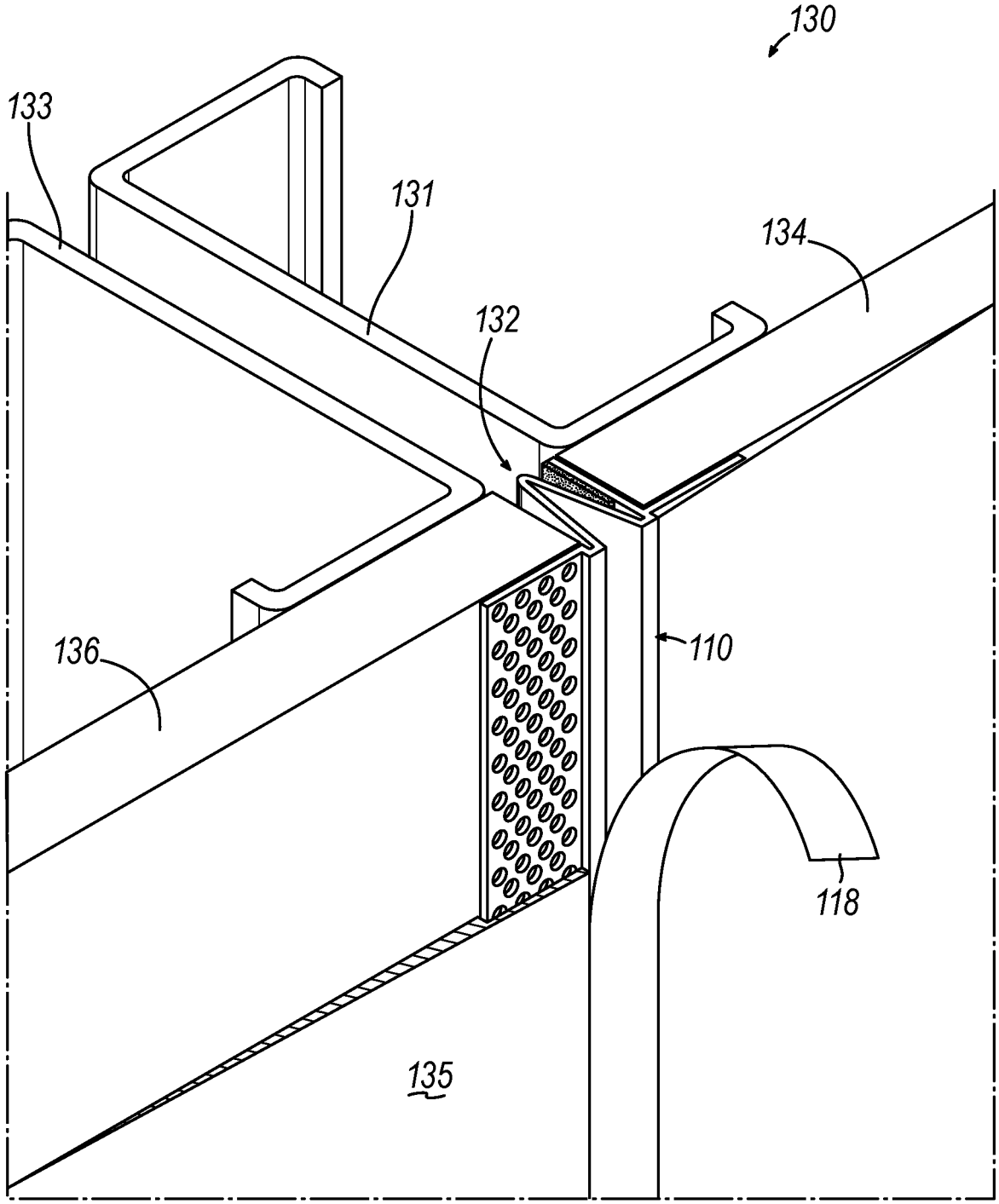
FIG. 11 depicts a front perspective view of an exemplary wall assembly that includes the control joint of FIG. 4.
Figure 12:
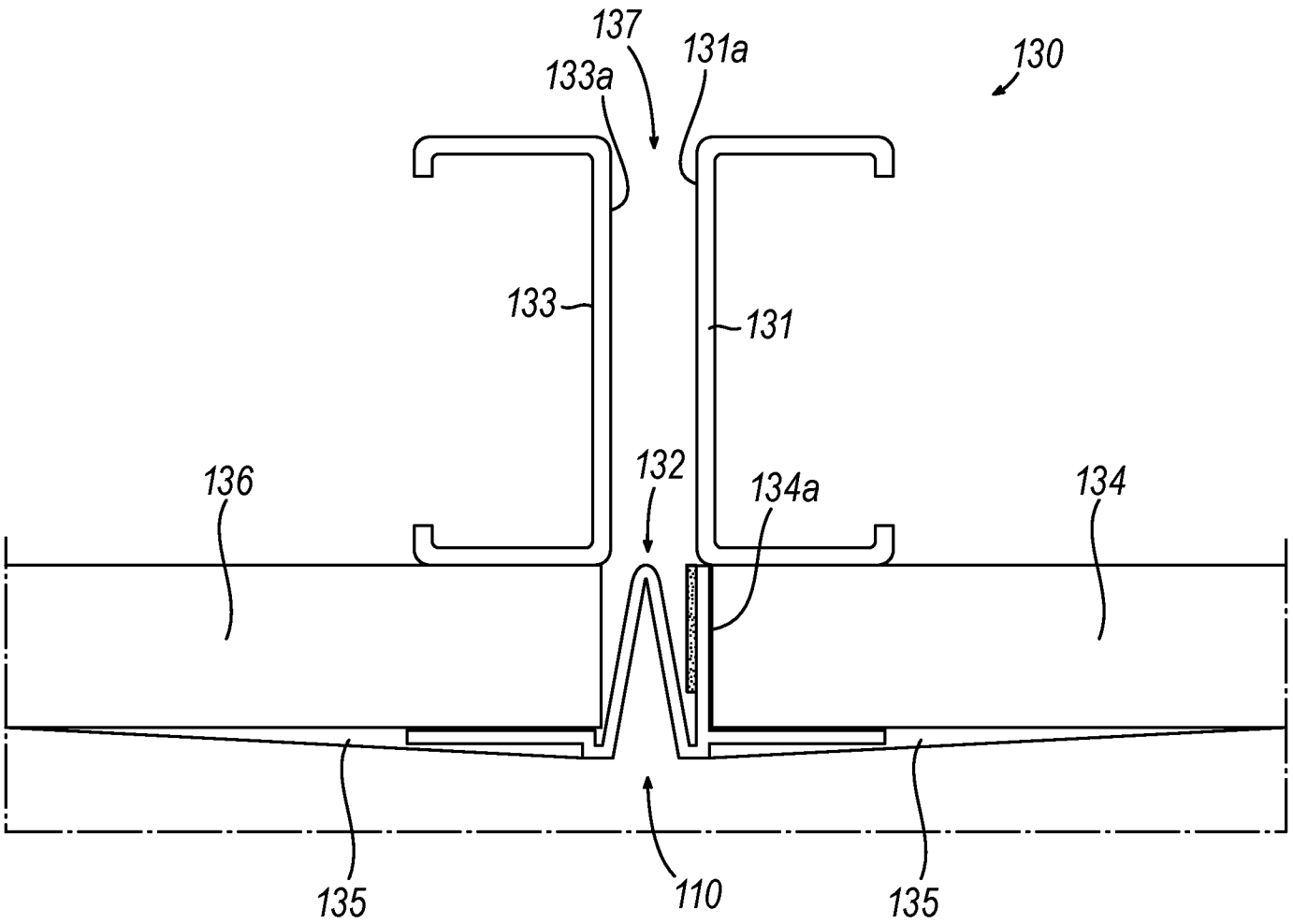
FIG. 12 depicts a top plan view of the wall assembly of FIG. 11.
Figure 13:
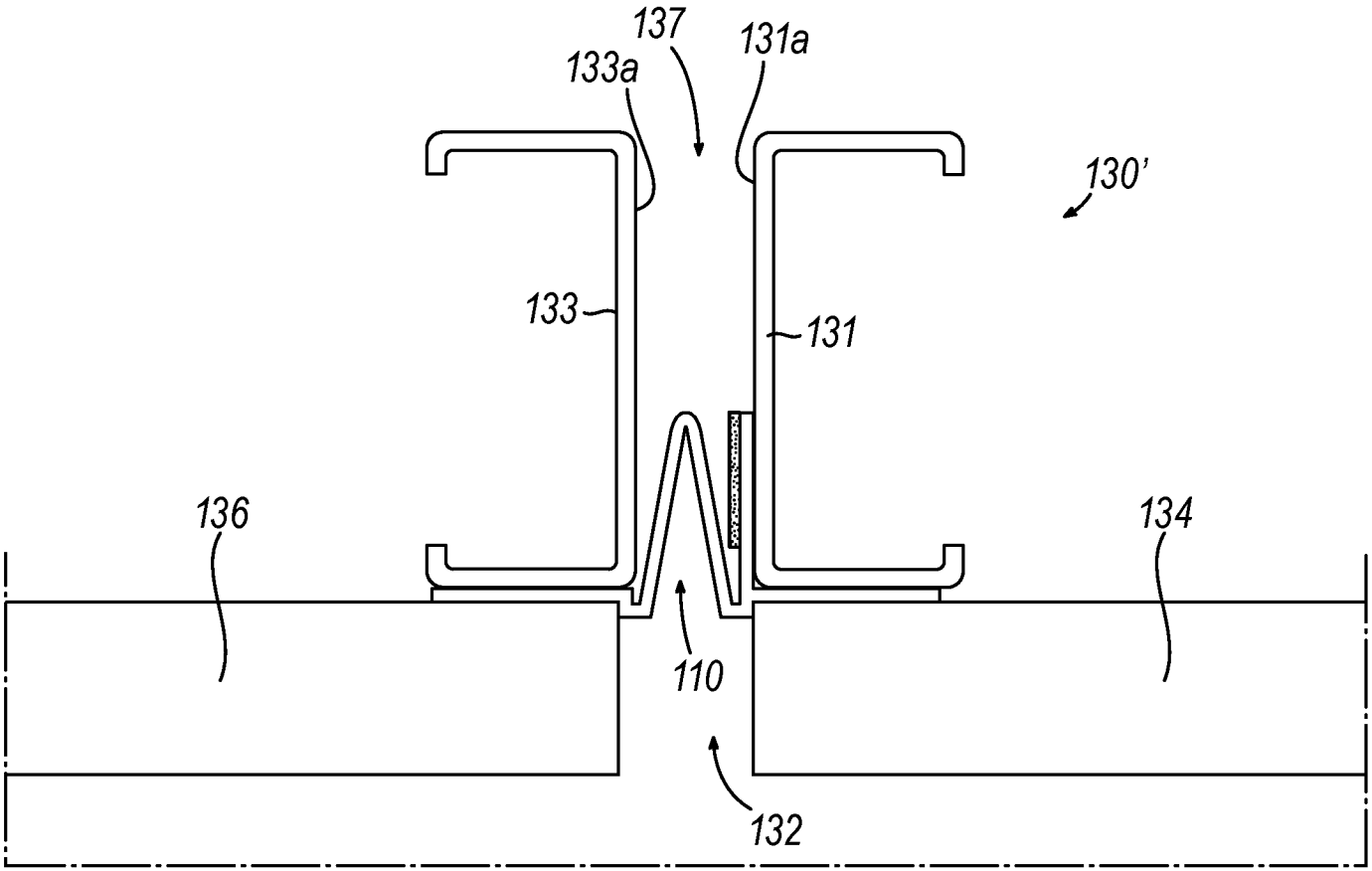
FIG. 13 depicts a top plan view of another exemplary wall assembly that includes the control joint of FIG. 4.

FIGS. 4-10 show one embodiment of a control joint (110) configured to provide stress relief and assist in controlling cracking in large areas of wallboard. FIGS. 11-12 depict a wall assembly (130) that includes control joint (110) positioned between two wallboard panels (134, 136) and FIG. 13 depicts a wall assembly (130') that includes control joint (110) positioned between two studs (131, 133). As shown, control joint (110) comprises a body (101) comprising a pair of flanges (116, 117), a flex portion (114) positioned between flanges (116, 117), and a first leg (120) extending from an interior edge (116*a*) of flange (116). A piece of removable tape (118) may be initially positioned over the recess of flex portion (114). As shown, each flange (116, 117) is perforated such that it includes a plurality of openings (112) that extend through the respective flange (116, 117) from an upper surface to a lower surface of the flange (116, 117). In such an embodiment, the openings (112) may be any shape and/or configuration suitable to facilitate attachment of flanges (116, 117) to an underlying substrate and/or application of a finishing material, such as joint compound, veneer plaster, etc. In some embodiments, one or both flanges may be solid (i.e., substantially free of any openings or perforations). In the illustrated embodiment, flanges (116, 117) each include an outer portion (116*b*, 117*b*) and a lip (119). As shown, each outer portion (116*b*, 117*b*) extends from a respective lip (119) to a free end of the respective flange (116, 117). Each lip (119) is attached to a first end of a respective sidewall (113) of flex portion (114). A first portion of each lip (119) may extend in a plane that is substantially parallel relative to outer portions (116*b*, 117*b*) of flanges (116, 117), while a second portion of each lip (119) may extend from the first portion toward base member (115) in a plane that is substantially perpendicular relative to outer portions (116*b*, 117*b*) of flanges (116, 117).

In the illustrated embodiment, flex portion (114) comprises a V-shape. Flex portion (114) may comprise other shapes in other embodiments, such as a U-shape or other shapes suitable to provide the desired flexing capability. As shown, flex portion (114) includes a pair of angled sidewalls (113) connected at the respective second ends of each sidewall (113) by a curved base member (115). In some embodiments, the depth of flex portion (114) (i.e., the dimension from the plane containing outer portions (116*b*, 117*b*) of flanges (116, 117) to the bottom of base member (115)) may be substantially equal to the thickness of a single drywall panel (e.g., from about 0.5 inches to about 0.625 inches). Other suitable depths of flex portion (114) may be used depending on the particular application and in light of the teachings herein, including but not limited to a depth that is substantially equal to the thickness of two or more drywall panels.

In the illustrated embodiment, first leg (120) extends from flange (116) toward base member (115) in a plane that is substantially perpendicular relative to outer portion (116*b*) of flange (116). Specifically, first leg (120) extends from interior edge (116*a*) of flange (116) in the same direction as flex portion (114). As shown, first leg (120) and the adjacent sidewall (113) of flex portion (114) are arranged such that an acute angle is formed between first leg (120) and the adjacent sidewall (113) of flex portion (114). In some embodiments, the length of first leg (120) (i.e., the dimension from lip (119) to the distal end (120*a*) of first leg (120)) may be substantially equal to the thickness of a single drywall panel (e.g., from about 0.5 inches to about 0.625 inches). Other suitable lengths of first leg (120) may be used depending on the particular application and in light of the teachings herein, including but not limited to a length that is substantially equal to the thickness of two or more drywall panels. In some embodiments, the length of first leg (120) may be substantially equal to the depth of flex portion (114).

As shown, first leg (120) includes a fire resistant material strip (122) positioned on a portion of an interior surface of first leg (120) (i.e., the surface of first leg (120) facing flex portion (114)) such that the exposed or interior surface (122*a*) of fire resistant material strip (122) is facing flex portion (114). In some embodiments, fire resistant material strip (122) may cover a portion of the interior surface of first leg (120), while in other embodiments, fire resistant material strip (122) may cover the entire interior surface of first leg (120) from the distal end (120*a*) of first leg (120) to lip (119). In some embodiments, no portion of fire resistant material strip (122) is positioned on flex portion (114). In those embodiments, flex portion (114) may be substantially free of fire resistant material.

Figure 14:
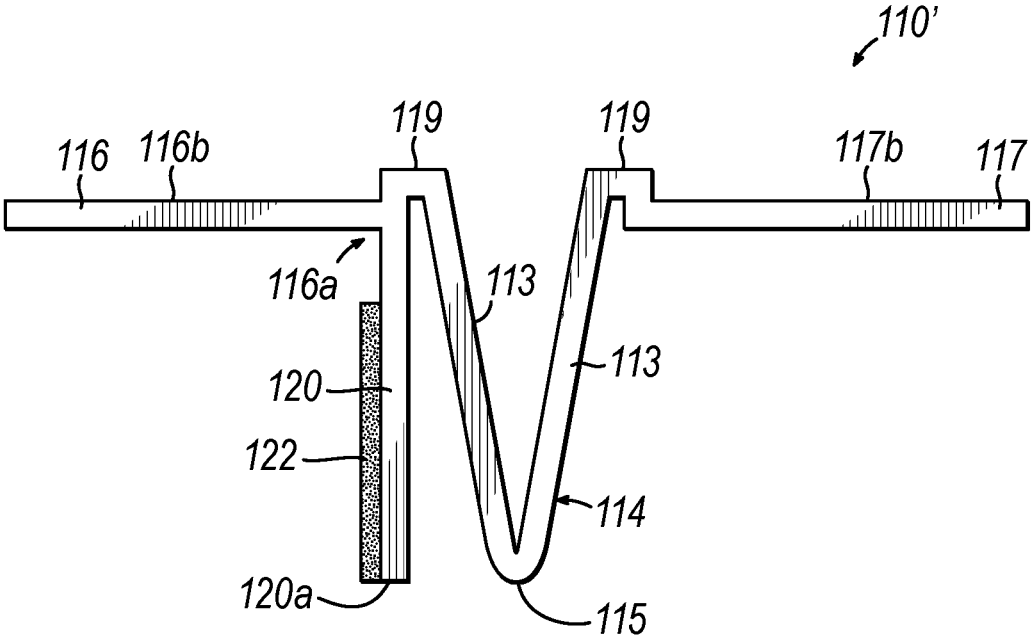
FIG. 14 depicts a front elevational view of another exemplary control joint.
Figure 15:
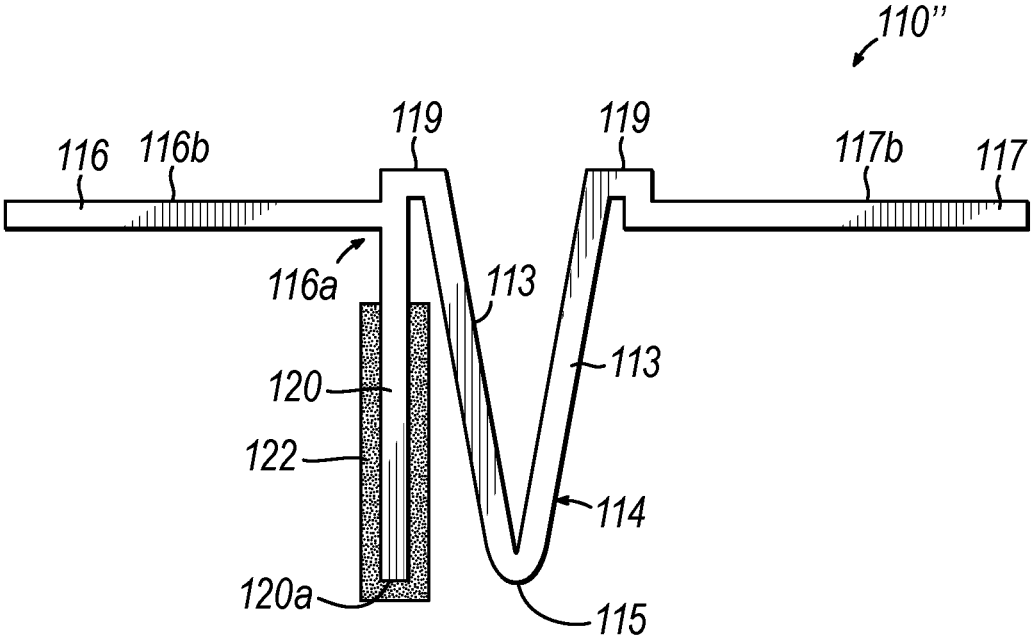
FIG. 15 depicts a front elevational view of another exemplary control joint.

In some embodiments, fire resistant material strip (122) may be positioned on at least a portion of an exterior surface of first leg (120) (i.e., the surface of first leg (120) facing away from flex portion (114)). An example of this type of control joint is control joint (110') shown in FIG. 14. In this embodiment, the exposed or exterior surface of strip (122) is facing away from flex portion (114). Still other embodiments may comprise one or more fire resistant material strips on at least a portion of both the interior surface and exterior surface of first leg (120). In some of those embodiments, the control joint (110") may comprise a fire resistant material strip (122) that wraps around the distal end (120*a*) of the first leg (120) so that the fire resistant material strip (122) extends onto both the interior and exterior surfaces of the first leg (120), while in other embodiments, the control joint (110) may comprise two or more fire resistant material strips (122), wherein at least one such strip (122) is positioned on the interior surface of the first leg (120) and at least one other strip (122) is positioned on the exterior surface of the first leg (120). An example of a control joint with a fire resistant material strip (122) that wraps around the distal end (120*a*) of the first leg (120) is control joint (110") shown in FIG. 15. In some embodiments, in order to minimize the amount of fire resistant material needed, which may reduce the cost to produce control joint (110), flex portion (114) may be substantially free from fire resistant material.

Fire resistant material strip (122) can be attached or applied to first leg (120) with adhesive, mechanical fasteners, or any other suitable method of attachment. In some embodiments where the strip (122) is attached with adhesive, the adhesive may be fire resistant or, in other words, able to maintain its adhesive qualities at elevated temperatures by incorporating fire resistant properties. In some embodiments, fire resistant material strip (122) may be painted on, sprayed on or otherwise applied to first leg (120).

Fire resistant material strip (122) comprises a material configured to slow or stop the spread of fire and/or smoke. In some embodiments, the fire resistant material strip (122) may comprise intumescent material that expands, and, in some embodiments chars, in response to being subjected to elevated temperatures in order to resist fire. By way of example only, the intumescent material may be configured to expand when it is exposed to temperatures at or above about 300 degrees Fahrenheit. In other examples, the intumescent material may fully intumesce when exposed to temperatures at or above about 375 degrees Fahrenheit. The amount of intumescent material included in fire resistant material strip (122) may be sufficient to substantially seal gap (132) in assembly (130) (described below). In other embodiments, strip (122) may comprise non-intumescent fire resistant material, such as mineral wool. In still other embodiments, strip (122) may comprise a combination of both intumescent material and non-intumescent fire resistant material.

In some embodiments where fire resistant material strip (122) comprises intumescent material, strip (122) may comprise an intumescent tape that includes a layer of intumescent material with an adhesive layer on one side to allow the strip to be attached to an underlying surface (e.g., the interior surface of first leg (120)). One example of this type of material is BlazeSeal, sold by Rectorseal of Houston, Texas. In other embodiments where the fire resistant material strip comprises intumescent material, the strip may comprise an intumescent paint, caulk, or other similar intumescent material capable of being applied or attached to first leg (120). The intumescent material could be any material suitable to expand and substantially seal gap (132) (described below) when exposed to elevated temperatures.

In some embodiments, fire resistant material strip (122) may comprise a combination of a foam material, including but not limited to open cell foam or closed cell foam, and an intumescent material. In some of these embodiments, the foam material and intumescent material may be positioned in layers arranged on top of each other or arranged in a side-by-side orientation. In embodiments where the foam material and intumescent material are positioned in layers arranged on top of each other, in some embodiments, the fire resistant material strip (122) may be oriented so that the foam material is positioned between first leg (120) and the intumescent material, while in other embodiments, the fire resistant material strip (122) may be oriented so that the intumescent material is positioned between first leg (120) and the foam material. In other embodiments, the intumescent material may be infused in or otherwise incorporated within the foam material such that they comprise a single layer of material that includes both foam and intumescent material.

In other embodiments, the strip may comprise a foam material, including but not limited to open cell foam or closed cell foam, by itself, without any intumescent material. In such an embodiment, the foam may comprise fire resistant material or non-fire resistant material. The foam material may provide sound insulating properties. In other words, the strip may comprise foam material configured to inhibit sound from traveling through the strip. For example, the strip may comprise a foam material that has a density sufficient to allow the inclusion of the control joint in the wall assembly to increase the sound transmission class (STC) rating of the wall assembly. By way of example only, the foam material may have a density of about 3.0 lbs. per cubic foot to about 4.0 lbs. per cubic foot. In an embodiment where the strip comprises a foam material with no intumescent material, the foam material may be large enough to substantially surround the flex portion of the control joint and substantially fill the gap between the inner surface of the first leg and the edge of the opposing wallboard panel.

As shown in FIGS. 11-12, wall assembly (130) comprises a pair of vertically oriented studs (131, 133) and a pair of wallboard panels (134, 136), which may be supported by studs (131, 133). As is well understood within the art, wall assembly (130) may also comprise other typical wall components, such as a header track and a footer track installed opposite one another that receive studs (131, 133). In the illustrated embodiment, control joint (110) may be installed in wall assembly (130) by positioning flex portion (114) in a gap (132) between two wallboard panels (134, 136) such that first leg (120) is positioned between interior edge (134*a*) of adjacent wallboard panel (134) and flex portion (114). In addition, in the embodiment shown in FIGS. 11-12, control joint (110) is installed in wall assembly (130) such that flanges (116, 117) are positioned over the outer surface of each wallboard panel (134, 136). In some embodiments, flanges (116, 117) may be in contact with the outer surface of a respective wallboard panel (134, 136). First leg (120) may be configured to facilitate installation of control joint (110) by helping the user locate control joint (110) within wall assembly (130) by positioning first leg (120) adjacent to interior edge (134*a*) of wallboard panel (134). In some embodiments, the exterior surface of first leg (120) may be adjacent to and in contact with interior edge (134*a*) of wallboard panel (134), while in other embodiments, the exterior surface of first leg (120) may be adjacent to and spaced apart from interior edge (134*a*) of wallboard panel (134). Flex portion (114) can vary in width in different embodiments to create different sized reveals and/or accommodate different sized gaps within various wall assemblies.

After control joint (110) is installed in wall assembly (130), finishing material (135), such as joint compound or veneer plaster, can then be applied over flanges (116, 117) for a flush finish if desired. In embodiments where one or both flanges (116, 117) contain a plurality of openings (112), the openings (112) may facilitate application of the finishing material. Control joint (110) and removable tape (118) may be configured to prevent staining of the flex portion (114). For example, tape (118) may remain attached to control joint (110) while one or both of the wallboard panels (134, 136) are being finished (e.g., painted, plastered, etc.) so that excess finishing material (135) (paint, plaster, joint compound, etc.) may be applied to tape (118) instead of onto flex portion (114). After the finishing of wallboard panels (134, 136) is completed, then tape (118) can be removed to provide a clean finish to the joint between wallboard panels (134, 136).

As shown in FIG. 13, in some other embodiments, control joint (110) may be installed between studs (131, 133) behind wallboard panels (134, 136). In such embodiments, control joint (110) may be installed in wall assembly (130') by positioning flex portion (114) in a gap (137) between studs (131, 133) such that first leg (120) is positioned between the interior surface (131*a*) of the web of adjacent stud (131) and flex portion (114). In addition, in such an embodiment, control joint (110) may be installed in wall assembly (130') such that flanges (116, 117) are positioned over the outer surface of a respective leg of each stud (131, 133). In some embodiments, flanges (116, 117) may be in contact with the outer surface of a respective leg of a corresponding stud (131, 133). First leg (120) of control joint (110) may be configured to facilitate installation of control joint (110) by helping the user locate control joint (110) within wall assembly (130') by positioning first leg (120) adjacent to interior surface (131*a*) of the web of adjacent stud (131). In some embodiments, the exterior surface of first leg (120) may be adjacent to and in contact with interior surface (131*a*) of the web of adjacent stud (131), while in other embodiments, the exterior surface of first leg (120) may be adjacent to and spaced apart from interior surface (131*a*) of the web of adjacent stud (131). In these embodiments, the fire resistant material strip (122) may comprise intumescent material suitable to expand and substantially seal gap (137) when exposed to elevated temperatures. In addition, in these embodiments, another control joint, such as control joint (110, 210) or a prior art or conventional control joint, may then be installed between wallboard panels (134, 136) on the outer surface of wallboard panels (134, 136) and in gap (132) as shown in FIG. 2, 3, 11, 12, 19, or 20, although this is not necessarily required.

In the illustrated embodiment, control joint (110) is shown being installed in a vertically oriented gap between wallboard panels (134, 136). It will be appreciated based on the teachings herein that control joint (110) may also be installed in a horizontally oriented gap between two adjacent wallboard panels in other wall assemblies.

As shown, body (101) of control joint (110) comprises a pair of flanges (116, 117), a flex portion (114) positioned between flanges (116, 117), lips (119), and a first leg (120) extending from an interior edge (116*a*) of flange (116). In some embodiments, flanges (116, 117), flex portion (114), and first leg (120) may be of unitary construction such that they are formed from a single integral piece of material. In some embodiments, the components of body (101) may be extruded or coextruded together. However, in other embodiments, one or more of flanges (116, 117), flex portion (114), and first leg (120) may comprise non-integral, separate components that are attached to each other. It will thus be appreciated that body (101) may have a unitary construction or be comprised of various components attached together to collectively form body (101). In some embodiments, body (101), including one or more of flanges (116, 117), flex portion (114), and first leg (120), may comprise polyvinyl chloride (PVC), steel, aluminum or any other suitable material, including but not limited to other suitable plastics, metals, paper products, and composites. In some embodiments, flanges (116, 117), flex portion (114), and first leg (120), may all comprise the same material, while in other embodiments flanges (116, 117), flex portion (114), and first leg (120) may comprise two or more different materials.

Some embodiments of body (101) may include materials having fire resistant and/or intumescent properties. In some embodiments, at least one portion of body (101) may comprise material having fire resistant and/or intumescent properties and at least one other portion of body (101) may comprise material that does not have fire resistant and/or intumescent properties, such that body (101) includes both fire resistant portions and non-fire resistant portions. In other embodiments, the entire body (101) may comprise material having fire resistant and/or intumescent properties. By way of example only, in some embodiments at least a portion of body (101) may comprise material having fire resistant and/or intumescent properties, such as the material described in U.S. Patent Publication No. 2016/0348357 (Smith et al.), published on Dec. 1, 2016, the disclosure of which is incorporated by reference herein. In some embodiments, body (101) may comprise material that contains graphite, sodium silicates, other additives, or combinations thereof. In some embodiments, body (101) may comprise a nanocomposite material with fire resistant properties, including but not limited to IntuPlas and/or BernoGraph, which are sold by Pyrophobic Systems Ltd. of Barrie, Ontario, Canada. By way of example only, body (101) may comprise a material having a composition such as those described in US. Pub. No. 2012/0022201, published Jan. 26, 2012, to Zhvanetskiy et al., the disclosure of which is incorporated herein by reference. Other examples of materials that could be used for body (101) include but are not limited to: Charmor™ which is sold by Perstorp Holding AB of Malmo, Sweden; Delphi Intumescent Material, which is sold by Delphi Automotive LLC of Gillingham, Kent, United Kingdom; intumescent PVC materials sold by Dugdale Limited of Sowerby Bridge, West Yorkshire, United Kingdom; PVC granules sold by Hangzhou Juntai Plastic Products Co., Ltd. of Hangzhou, Zheijang, China; and FireCarb, which is sold by LKAB Minerals AB of Lulea, Sweden.

Figure 16:
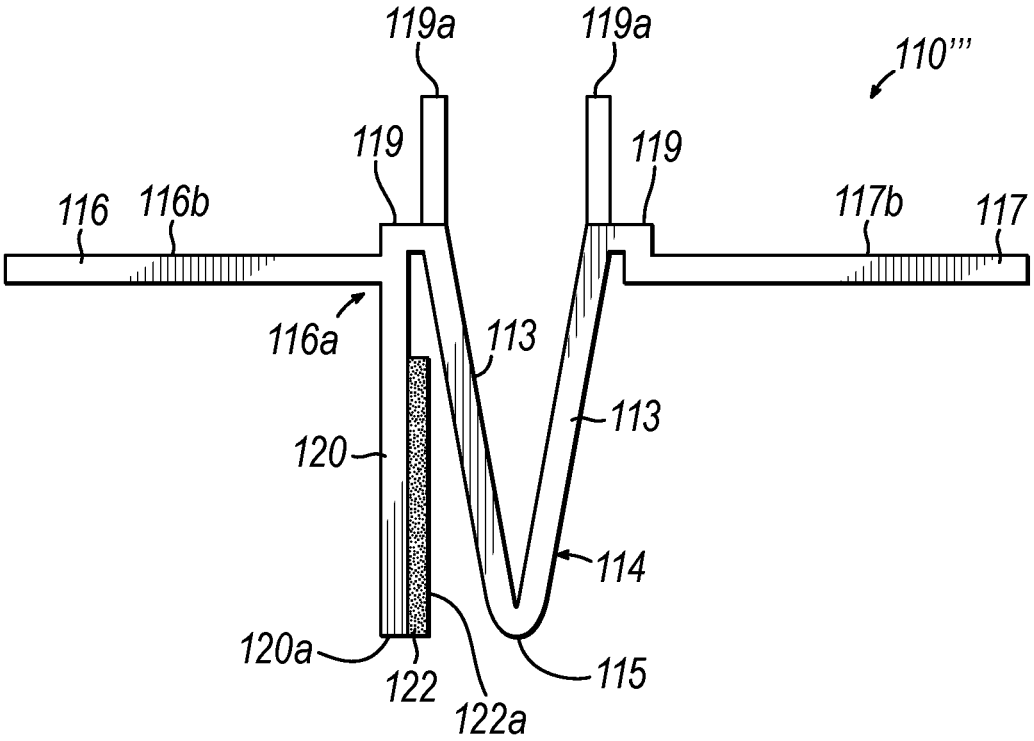
FIG. 16 depicts a front elevational view of another exemplary control joint.

FIG. 16 depicts an alternate embodiment of a control joint (110''') that is similar to control joint (110) described above, except that control joint (110''') includes a pair or removable legs (119*a*) that extend from the lip (119) on each side of control joint (110'''). Removable legs (119*a*) may extend along a portion of or the entire longitudinal length of control joint (110'''). In other embodiments, including those where one or both lips (119) are omitted, removable legs (119*a*) may extend from flanges (116, 117) at any suitable location, length, and/or orientation. In some embodiments, removable legs (119*a*) may be integrally attached to a respective lip (119) or flange (116, 117) via extrusion of control joint (110''') during the manufacturing process. In the illustrated embodiment, removable legs (119*a*) of control joint (110''') are configured to inhibit any finishing material, such as joint compound, veneer plaster, paint, or other similar materials applied to flanges (116, 117) from being inadvertently applied to the flex portion (114) of control joint (110'''). While the embodiment illustrated in FIG. 16 includes two removable legs (119*a*), it will be appreciate that other embodiments can include any suitable number of removable legs (119*a*), including one removable leg or three or more removable legs. Although removable legs (119*a*) are illustrated on control joint (110'''), it will be appreciated that one or more removable legs may be incorporated into other any of the other types of control joints described herein as well.

Control joint (110''') and removable legs (119*a*) may be configured to prevent staining of the flex portion (114). For example, removable legs (119*a*) may remain attached to control joint (110''') while one or both of the wallboard panels (134, 136) are being finished (e.g., painted, plastered, etc.) so that excess finishing material (135) (paint, plaster, joint compound, etc.) may be applied to removable legs (119*a*) instead of onto flex portion (114). After the finishing of wallboard panels (134, 136) is completed, then removable legs (119*a*) can be removed to provide a clean finish to the joint between wallboard panels (134, 136). While removable legs (119*a*) are shown having a rectangular cross-section, it will be appreciated that removable legs (119*a*) may have any other cross-section suitable to help prevent of finishing material from being applied to flex portion (114) and facilitate gripping and removal of removable legs (119*a*). In some embodiments, removable legs (119*a*) may be used instead of removable tape (118), while in other embodiments removable legs (119*a*) may be used in conjunction with removable tape (118).

Control joint (110''') may include a frangible connection extending between each lip (119) and its respective removable leg (119*a*). More particularly, the frangible connection may comprise a thin and/or weakened section of material configured to selectively fracture upon being manipulated by a user. A user may thus separate a removable leg (119*a*) from its respective lip (119) by grasping removable leg (119*a*) at any location along the longitudinal length of removable leg (119*a*) (e.g., a proximal end, a distal end, and/or a middle portion) and applying sufficient force to pull removable leg (119*a*) in a direction generally away from lip (119) (e.g., an upward force, a downward force, a rightward force, or an angled force generally away from lip (119)). As used herein, the term "fracture" generally refers to the failure of the material itself such that the material may crack, rip, and/or tear for separation of removable leg (119*a*) from control joint (110'''). The term "fracture" is not intended to unnecessarily limit the invention described herein. In instances where lip (119) is omitted from control joint (110'''), the frangible connection may be positioned along removable leg (119*a*) such that the portion of removable leg (119*a*) connecting to a respective flange (116, 117) has a thin and/or weakened material configured to selectively fracture in response to application of sufficient force.

In some embodiments, removable legs (119*a*) may include one or more apertures and/or perforations along the frangible connection between each removable leg (119*a*) and its respective lip (119) to further weaken the frangible connection. In these embodiments, the apertures and/or perforations along the frangible connection are configured to facilitate removal of removable leg (119*a*). It will be appreciated that such apertures and/or perforations are not required, but may be desirable to ease removal of removable leg (119*a*) depending on the material(s) from which control joint (110''') may be manufactured. The apertures and/or perforations may be sized and shaped to enhance the ease in removing removable leg (119*a*) while still inhibiting a finishing material that is applied to flanges (116, 117) from contacting flex portion (114), as described above.

Removable legs (119*a*) may be configured to be gripped directly by hand by the user for removal from a respective lip (119). However, the user may alternatively grip removable leg (119*a*) indirectly with a tool, including but not limited to, a pair of pliers or other suitable gripping devices, to manipulate removable leg (119*a*) relative to its respective lip (119). In this instance, applying a necessary force to removable leg (119*a*) via the tool may be operable to fracture the frangible connection and thereby separate removable leg (119*a*) from lip (119). Other methods and/or tools for separating removable legs (119*a*) from control joint (110''') may also be used. By way of example only, removable legs (119*a*) may be removed from its respective lip (119) by cutting removable leg (119*a*) along the frangible connection with a knife, scissors, boxcutter, and/or other various suitable cutting means. Other embodiments of control joints may include alternative connections between removable legs (119*a*) and lips (119) other than a frangible connection. As merely an illustrative example, an adhesive connection or mechanical connection may be employed to removably connect removable legs (119*a*) to lips (119) of control joint (110''').

Figure 17:
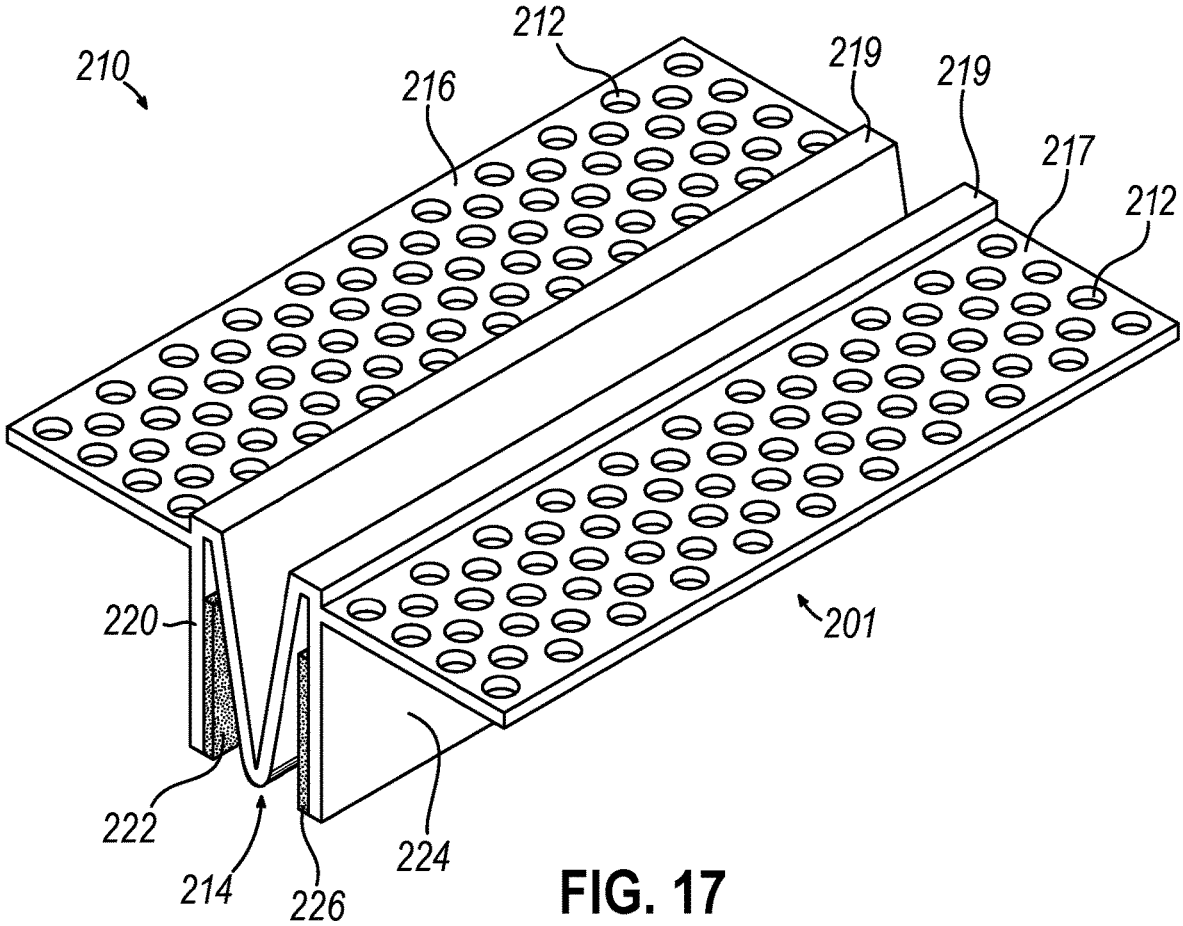
FIG. 17 depicts perspective view of another exemplary control joint.
Figure 18:
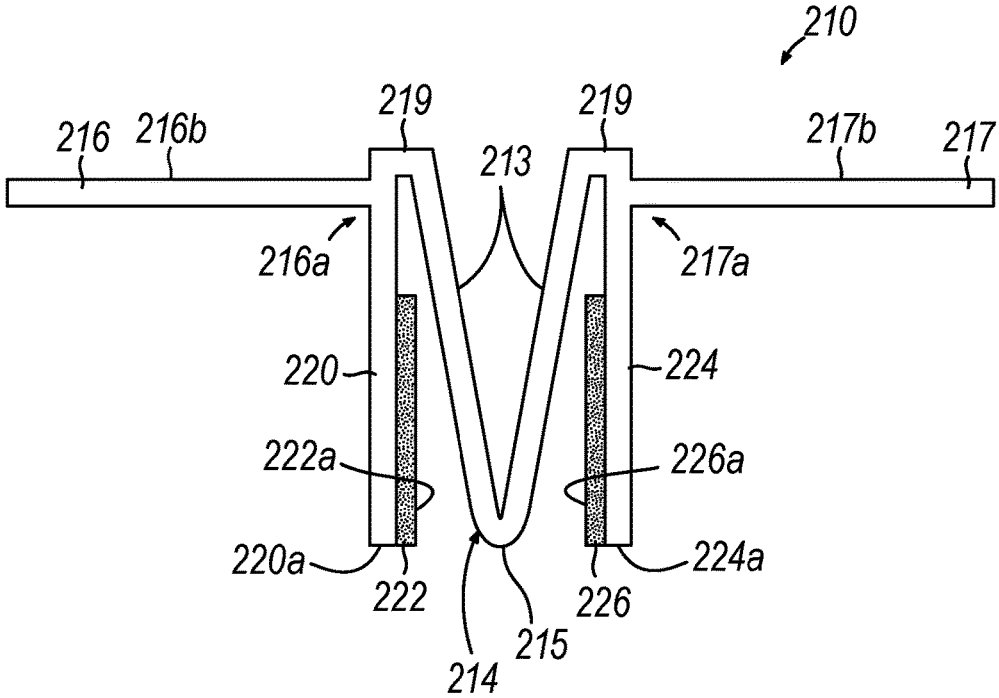
FIG. 18 depicts a front elevational view of the control joint of FIG. 17.
Figure 19:
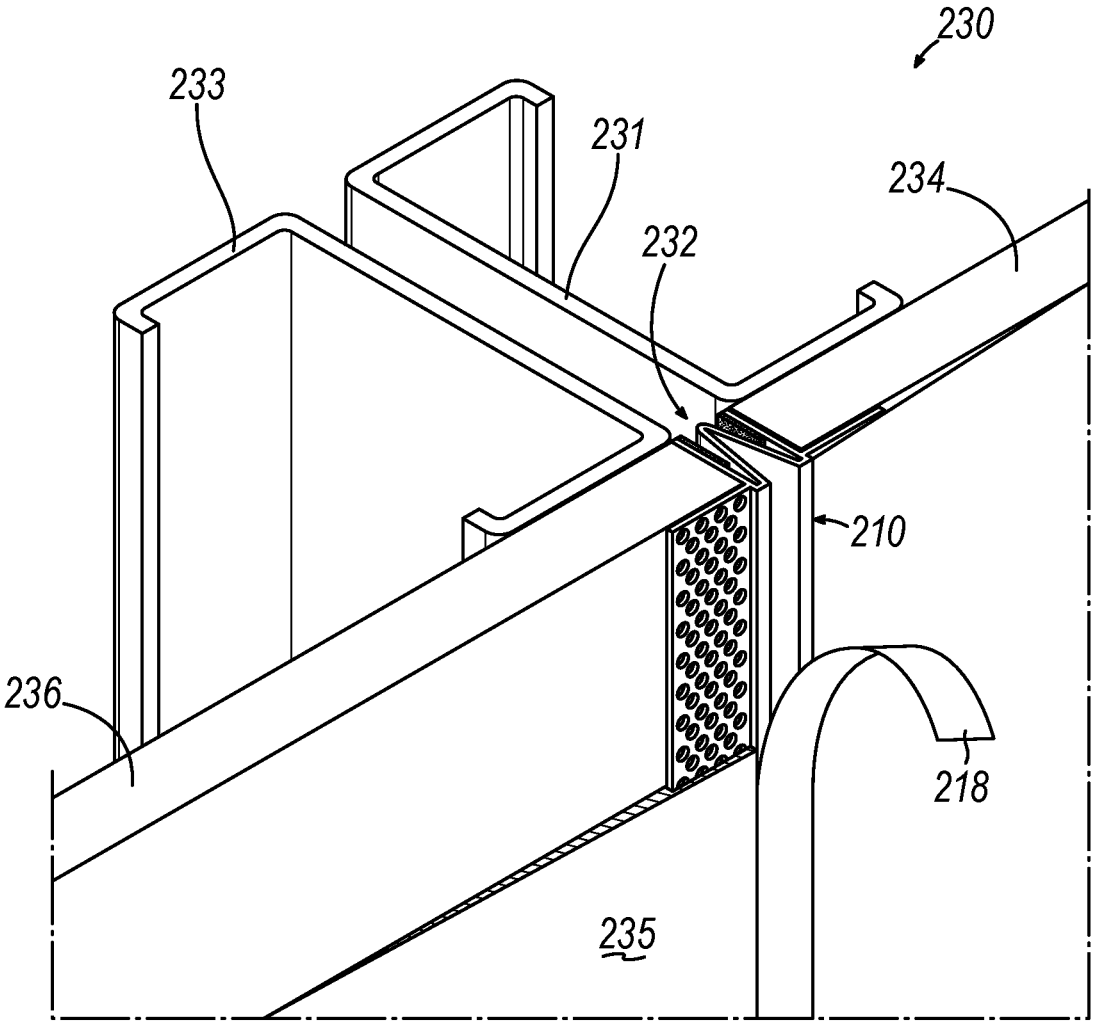
FIG. 19 depicts a front perspective view of an exemplary wall assembly that includes the control joint of FIG. 17.
Figure 20:
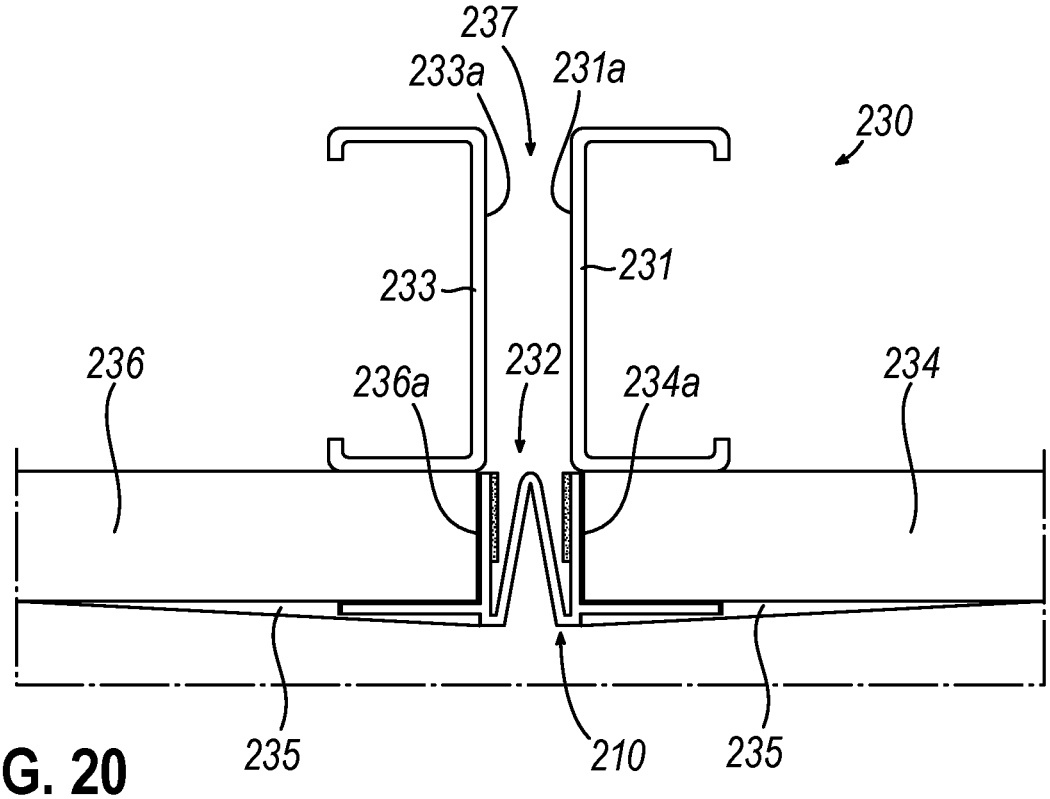
FIG. 20 depicts a top plan view of the wall assembly of FIG. 19.
Figure 21:
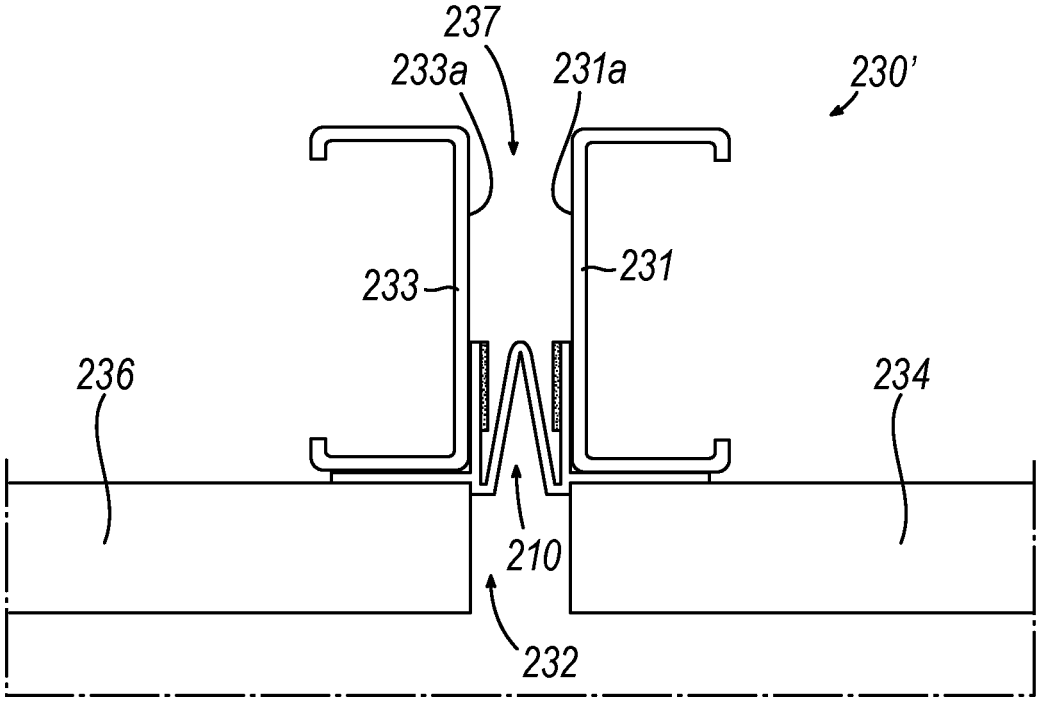
FIG. 21 depicts a top plan view of another exemplary wall assembly that includes the control joint of FIG. 17.

FIGS. 17-18 show another embodiment of a control joint (210) configured to provide stress relief and assist in controlling cracking in large areas of wallboard. FIGS. 19-20 depict a wall assembly (230) that includes control joint (210) positioned between two wallboard panels (234, 236) and FIG. 21 depicts a wall assembly (230') that includes control joint (210) positioned between two studs (231, 233). As shown, control joint (210) comprises a body (201) comprising a pair of flanges (216, 217), a flex portion (214) positioned between flanges (216, 217), a first leg (220) extending from an interior edge (216*a*) of flange (216), and a second leg (224) extending from an interior edge (217*a*) of flange (217). A piece of removable tape (218) may be initially positioned over the recess of flex portion (214). As shown, each flange (216, 217) is perforated such that it includes a plurality of openings (212) that extend through the respective flange (216, 217) from an upper surface to a lower surface of the flange (216, 217). In such an embodiment, the openings (212) may be any shape and/or configuration suitable to facilitate attachment of flanges (216, 217) to an underlying substrate and/or application of a finishing material, such as joint compound, veneer plaster, etc. In some embodiments, one or both flanges may be solid (i.e., substantially free of any openings or perforations). In the illustrated embodiment, flanges (216, 217) each include an outer portion (216*b*, 217*b*) and a lip (219). As shown, each outer portion (216*b*, 217*b*) extends from a respective lip (219) to a free end of the respective flange (216, 217). Each lip (219) is attached to a first end of a respective side wall (213) of flex portion (214). A first portion of each lip (219) may extend in a plane that is substantially parallel relative to outer portions (216*b*, 217*b*) of flanges (216, 217), while a second portion of each lip (219) may extend from the first portion toward base member (215) in a plane that is substantially perpendicular relative to outer portions (216*b*, 217*b*) of flanges (216, 217).

In the illustrated embodiment, flex portion (214) comprises a V-shape. Flex portion (214) may comprise other shapes in other embodiments, such as a U-shape or other shapes suitable to provide the desired flexing capability. As shown, flex portion (214) includes a pair of angled side walls (213) and a curved base member (215), similar to sidewalls (113) and base member (115) described above. In some embodiments, the depth of flex portion (214) (i.e., the dimension from the plane containing outer portions (216*b*, 217*b*) of flanges (216, 217) to the bottom of base member (215)) may be substantially equal to the thickness of a single drywall panel (e.g., from about 0.5 inches to about 0.625 inches). Other suitable depths of flex portion (214) may be used depending on the particular application and in light of the teachings herein, including but not limited to a depth that is substantially equal to the thickness of two or more drywall panels.

In the illustrated embodiment, first leg (220) and second leg (224) extend from flanges (216, 217) toward base member (215) in a plane that is substantially perpendicular relative to outer portions (216*b*, 217*b*) of flanges (216, 217). Specifically, first leg (220) extends from interior edge (216*a*) of flange (216) and second leg (224) extends from interior edge (217*a*) of flange (217). In this embodiment, first leg (220) and second leg (224) extend in the same direction as flex portion (214) and are substantially parallel relative to each other. As shown, first leg (220) and the adjacent sidewall (213) of flex portion (214) are arranged such that an acute angle is formed between first leg (220) and the adjacent sidewall (213) of flex portion (214). Similarly, as shown, second leg (224) and the adjacent sidewall (213) of flex portion (214) are arranged such that an acute angle is formed between second leg (224) and the adjacent sidewall (213) of flex portion (214). In some embodiments, the length of first leg (220) and second leg (224) (i.e., the dimension from lip (219) to the distal end (220*a*, 224*a*) of first leg (220) and second leg (224)) may be substantially equal to the thickness of a single drywall panel (e.g., from about 0.5 inches to about 0.625 inches). Other suitable lengths of first leg (220) and second leg (224) may be used depending on the particular application and in light of the teachings herein, including but not limited to a length that is substantially equal to the thickness of two or more drywall panels. In some embodiments, the lengths of first leg (220) and second leg (224) may be substantially equal to the depth of flex portion (214). In the illustrated embodiment, first leg (220) and second leg (224) have substantially the same length, but in other embodiments first leg (220) and second leg (224) may have different lengths.

As shown, legs (220, 224) each include a fire resistant material strip (222, 226) positioned on a portion of an interior surface of a respective leg (220, 224) (i.e., the surface of leg (220, 224) facing flex portion (214)) such that the exposed or interior surfaces (222*a*, 226*a*) of fire resistant material strips (222, 226) are facing flex portion (214). In some embodiments, fire resistant material strips (222, 226) may cover a portion of the interior surface of legs (220, 224), while in other embodiments, fire resistant material strips (222, 226) may cover the entire interior surface of legs (220, 224) from the distal end (220*a*, 224*a*) of a respective leg (220, 224) to a corresponding lip (219). In some embodiments, no portion of fire resistant material strips (222, 226) is positioned on flex portion (214). In those embodiments, flex portion (214) may be substantially free of fire resistant material.

In some embodiments, fire resistant material strips (222, 226) may be positioned on at least a portion of an exterior surface of a respective leg (220, 224) (i.e., the surface of a leg (220, 224) facing away from flex portion (214)). Still other embodiments may comprise one or more fire resistant material strips (222, 226) on at least a portion of both the interior surface and exterior surface of a respective leg (220, 224). In some of those embodiments, the control joint (210) may comprise a fire resistant material strip (222, 226) that wraps around the distal end (220*a*, 224*a*) of a respective leg (220, 224) so that the fire resistant material strip extends onto both the interior and exterior surfaces of the leg (220, 224), while in other embodiments, the control joint (210) may comprise two or more fire resistant material strips (222, 226) on a respective leg (220, 224), wherein at least one such strip (222, 226) is positioned on the interior surface of the respective leg (220, 224) and at least one other strip (222, 226) is positioned on the exterior surface of the respective leg (220, 224). In the illustrated embodiment, the number, size, and positioning of fire resistant material strips (222, 226) on legs (220, 224) are the same. In other embodiments, the number, size, and/or positioning of fire resistant material strip (222) on first leg (220) may be different than the number, size, and/or positioning of fire resistant material strip (226) on second leg (224). In some embodiments, one leg (220, 224) may include a fire resistant material strip (222, 226), while the other leg (220, 224) does not include a fire resistant material strip (222, 226). In still other embodiments, one leg (220, 224) may include a fire resistant material strip (222, 226), while the other leg (220, 224) includes a strip comprising material that is not fire resistant. In some embodiments, in order to minimize the amount of fire resistant material needed, which may reduce the cost to produce control joint (210), flex portion (214) may be substantially free from fire resistant material.

Fire resistant material strips (222, 226) can be attached or applied to a respective leg (220, 224) with adhesive, mechanical fasteners, or any other suitable method of attachment. In some embodiments where the strip (222, 226) is attached with adhesive, the adhesive may be fire resistant or, in other words, able to maintain its adhesive qualities at elevated temperatures by incorporating fire resistant properties. In some embodiments, fire resistant material strips (222, 226) may be painted on, sprayed on or otherwise applied to a respective leg (220, 224). In some embodiments, fire resistant material strips (222, 226) may be attached or applied to a respective leg (220, 224) in the same manner, while in other embodiments, fire resistant material strips (222, 226) may be attached or applied to a respective leg (220, 224) in different manners.

Fire resistant material strips (222, 226) comprise a material configured to slow or stop the spread of fire and/or smoke. Similar to fire resistant material strip (122) described above, in some embodiments, the fire resistant material strips (222, 226) may comprise intumescent material. The amount of intumescent material included in fire resistant material strips (222, 226) may be sufficient to substantially seal gap (232) in assembly (230) (described below). In some embodiments, fire resistant material strips (222, 226) may comprise the same fire resistant material, while in other embodiments, fire resistant material strips (222, 226) may comprise different fire resistant material. By way of example only, in some embodiments, one fire resistant material strip (222, 226) may comprise intumescent material, while the other fire resistant material strip (222, 226) may comprise non-intumescent fire resistant material, such as mineral wool. In still other embodiments, both strips (222, 226) may comprise non-intumescent fire resistant material, while in other embodiments one of or both strips (222, 226) may comprise a combination of both intumescent material and non-intumescent fire resistant material.

Similar to fire resistant material strip (122) described above, fire resistant material strips (222, 226) may comprise an intumescent tape, paint, caulk, or other similar intumescent material capable of being applied or attached to a respective leg (220, 224). The intumescent material could be any material suitable to expand and substantially seal gap (232) (described below) when exposed to elevated temperatures. Also similar to fire resistant material strip (122), fire resistant material strips (222, 226) may comprise a combination of a foam material, including but not limited to open cell foam or closed cell foam, and an intumescent material. In some embodiments, fire resistant material strips (222, 226) may comprise the same type of intumescent material, while in other embodiments, fire resistant material strips (222, 226) may comprise different types of intumescent material. By way of example only, in some embodiments, one fire resistant material strip (222, 226) may comprise intumescent tape and the other fire resistant material strip (222, 226) may comprise intumescent paint.

In some embodiments where at least one strip (222, 226) includes both foam material and intumescent material, the foam material and intumescent material may be positioned in layers arranged on top of each other or arranged in a side-by-side orientation. In embodiments where the foam material and intumescent material are positioned in layers arranged on top of each other, in some embodiments, one or both of the fire resistant material strips (222, 226) may be oriented so that the foam material is positioned between the respective leg (220, 224) and the intumescent material, while in other embodiments, one or both of the fire resistant material strips (222, 226) may be oriented so that the intumescent material is positioned between the respective leg (220, 224) and the foam material. In other embodiments, the intumescent material in one or both strips (222, 226) may be infused in or otherwise incorporated within the foam material such that they comprise a single layer of material that includes both foam and intumescent material.

In other embodiments, one or both of the strips may comprise a foam material, including but not limited to open cell foam or closed cell foam, by itself, without any intumescent material. In such an embodiment, the foam may comprise fire resistant material or non-fire resistant material. The foam material may provide sound insulating properties. In other words, the strip may comprise foam material configured to inhibit sound from traveling through the strip. For example, one or both of the strips may comprise a foam material that has a density sufficient to allow the inclusion of the control joint in the wall assembly to increase the sound transmission class (STC) rating of the wall assembly. By way of example only, the foam material may have a density of about 3.0 lbs. per cubic foot to about 4.0 lbs. per cubic foot. In an embodiment where one or both of the strips comprise a foam material with no intumescent material, the foam material may be large enough to substantially surround the flex portion of the control joint and substantially fill the gap between the inner surface of the first leg and inner surface of the second leg.

As shown in FIGS. 19-20, wall assembly (230) comprises a pair of vertically oriented studs (231, 233) and a pair of wallboard panels (234, 236), which may be supported by studs (231, 233). As is well understood within the art, wall assembly (230) may also comprise other typical wall components, such as a header track and a footer track installed opposite one another that receive studs (231, 233). In the illustrated embodiment, control joint (210) may be installed in wall assembly (230) by positioning flex portion (214) in a gap (232) between two wallboard panels (234, 236) such that first leg (220) is positioned between interior edge (234*a*) of adjacent wallboard panel (234) and flex portion (214) and second leg (224) is positioned between interior edge (236*a*) of adjacent wallboard panel (236) and flex portion (214). In addition, in the embodiment shown in FIGS. 19-20, control joint (210) is installed in wall assembly (230) such that flanges (216, 217) are positioned over the outer surface of each wallboard panel (234, 236). In some embodiments, flanges (216, 217) may be in contact with the outer surface of a respective wallboard panel (234, 236). Legs (220, 224) may be configured to facilitate installation of control joint (210) by helping the user locate control joint (210) within wall assembly (230) by positioning first leg (220) adjacent to interior edge (234*a*) of wallboard panel (234) and/or positioning second leg (224) adjacent to interior edge (236*a*) of wallboard panel (236). In some embodiments, the respective exterior surface of legs (220, 224) may be adjacent to and in contact with a respective interior edge (234*a*, 236*a*) of the corresponding wallboard panel (234, 236), while in other embodiments, the respective exterior surface of legs (220, 224) may be adjacent to and spaced apart from a respective interior edge (234*a*, 236*a*) of the corresponding wallboard panel (234, 236). Flex portion (214) can vary in width in different embodiments to create different sized reveals and/or accommodate different sized gaps within various wall assemblies.

After control joint (210) is installed in wall assembly (230), finishing material (235), such as joint compound or veneer plaster, can then be applied over flanges (216, 217) for a flush finish if desired. In embodiments where one or both flanges (216, 217) contain a plurality of openings (212), the openings (212) may facilitate application of the finishing material. Control joint (210) and removable tape (218) may be configured to prevent staining of the flex portion (214). For example, tape (218) may remain attached to control joint (210) while one or both of the wallboard panels (234, 236) are being finished (e.g., painted, plastered, etc.) so that excess finishing material (235) (paint, plaster, joint compound, etc.) may be applied to tape (218) instead of onto flex portion (214). After the finishing of wallboard panels (234, 236) is completed, then tape (218) can be removed to provide a clean finish to the joint between wallboard panels (234, 236).

As shown in FIG. 21, in some other embodiments, control joint (210) may be installed between studs (231, 233) behind wallboard panels (234, 236). In such embodiments, control joint (210) may be installed in wall assembly (230') by positioning flex portion (214) in a gap (237) between studs (231, 233) such that first leg (220) is positioned between the interior surface (231*a*) of the web of adjacent stud (231) and flex portion (214) and second leg (224) is positioned between interior surface (233*a*) of the web of adjacent stud (233) and flex portion (214). In addition, in such an embodiment, control joint (210) may be installed in wall assembly (230') such that flanges (216, 217) are positioned over the outer surface of a respective leg of each stud (231, 233). In some embodiments, flanges (216, 217) may be in contact with the outer surface of a respective leg of a corresponding stud (231, 233). Legs (220, 224) of control joint (210) may be configured to facilitate installation of control joint (210) by helping the user locate control joint (210) within wall assembly (230') by positioning first leg (220) adjacent to interior surface (231*a*) of the web of stud (231) and/or positioning second leg (224) adjacent to interior surface (233*a*) of the web of stud (233). In some embodiments, the respective exterior surface of legs (220, 224) may be adjacent to and in contact with a respective interior surface (231*a*, 233*a*) of the web of the corresponding stud (231, 233), while in other embodiments, the respective exterior surface of legs (220, 224) may be adjacent to and spaced apart from a respective interior surface (231*a*, 233*a*) of the web of the corresponding stud (231, 233). In these embodiments, one or both of the fire resistant material strips (222, 226) may comprise intumescent material suitable to expand and substantially seal gap (237) when exposed to elevated temperatures. In addition, in these embodiments, another control joint, such as control joint (110, 210) or a prior art or conventional control joint, may then be installed between wallboard panels (234, 236) on the outer surface of wallboard panels (234, 236) and in gap (232) as shown in FIG. 2, 3, 11, 12, 19, or 20, although this is not necessarily required.

In the illustrated embodiment, control joint (210) is shown being installed in a vertically oriented gap between wallboard panels (234, 236). It will be appreciated based on the teachings herein that control joint (210) may also be installed in a horizontally oriented gap between two adjacent wallboard panels in other wall assemblies.

As shown, body (201) of control joint (210) comprises a pair of flanges (216, 217), a flex portion (214) positioned between flanges (216, 217), a first leg (220) extending from an interior edge (216*a*) of flange (216), and a second leg (224) extending from an interior edge (217*a*) of flange (217). In some embodiments, flanges (216, 217), flex portion (214), first leg (220), and second leg (224) may be of unitary construction such that they are formed from a single integral piece of material. In some embodiments, the components of body (201) may be extruded or coextruded together. However, in other embodiments, one or more of flanges (216, 217), flex portion (214), first leg (220), and second leg (224) may comprise non-integral, separate components that are attached to each other. It will thus be appreciated that body (201) may have a unitary construction or be comprised of various components attached together to collectively form body (201). In some embodiments, body (201), including one or more of flanges (216, 217), flex portion (214), first leg (220), and second leg (224), may comprise polyvinyl chloride (PVC), steel, aluminum or any other suitable material, including but not limited to other suitable plastics, metals, paper products, and composites. In some embodiments, flanges (216, 217), flex portion (214), first leg (220), and second leg (224), may all comprise the same material, while in other embodiments flanges (216, 217), flex portion (214), first leg (220), and second leg (224) may comprise two or more different materials.

Similar to body (101) described above, some embodiments of body (201) may include materials having fire resistant and/or intumescent properties. In some embodiments, at least one portion of body (201) may comprise material having fire resistant and/or intumescent properties and at least one other portion of body (201) may comprise material that does not have fire resistant and/or intumescent properties, such that body (201) includes both fire resistant portions and non-fire resistant portions. In other embodiments, the entire body (201) may comprise material having fire resistant and/or intumescent properties.

Figure 22:
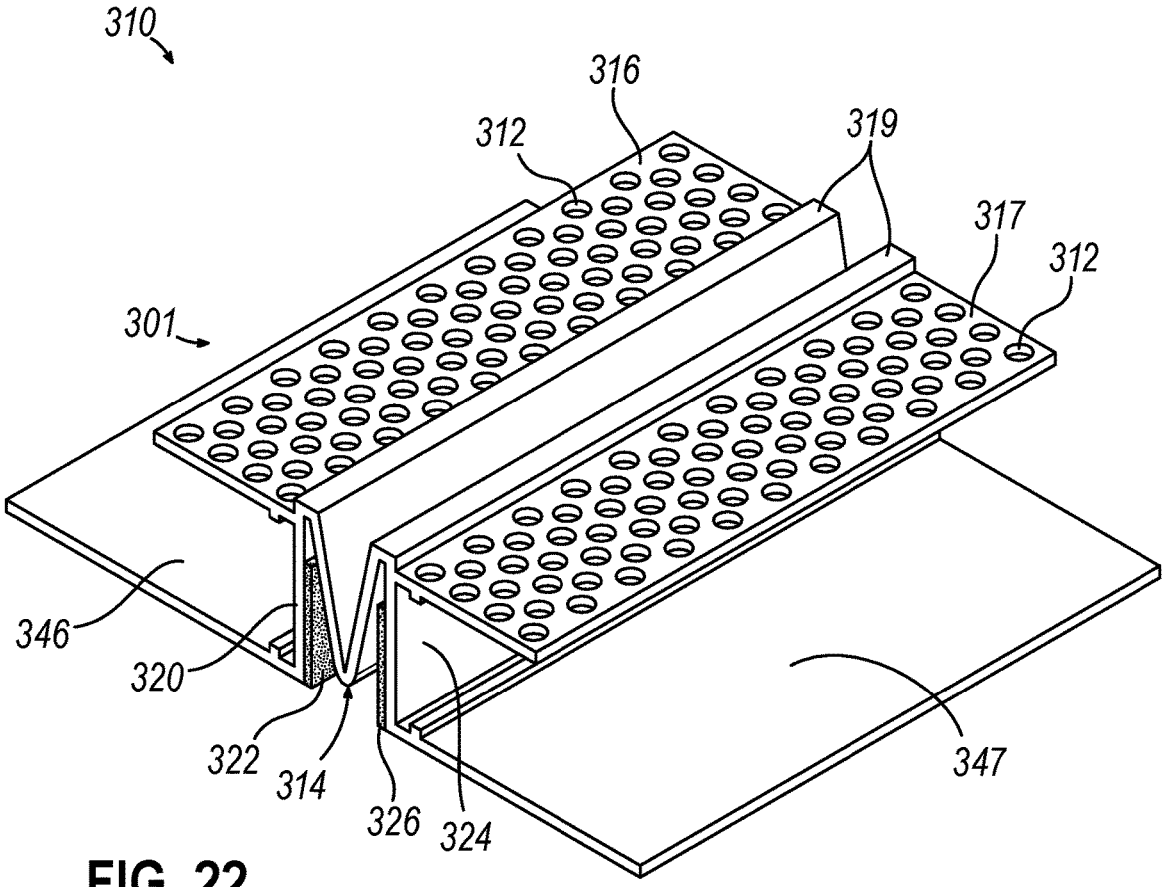
FIG. 22 depicts perspective view of another exemplary control joint.
Figure 23:
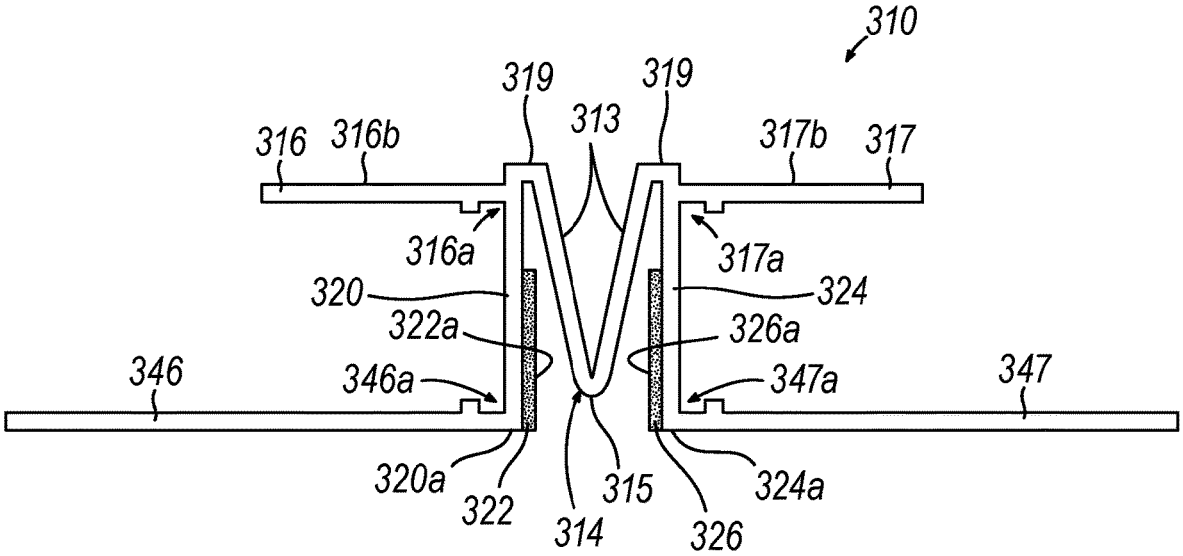
FIG. 23 depicts a front elevational view of the control joint of FIG. 22.
Figure 24:
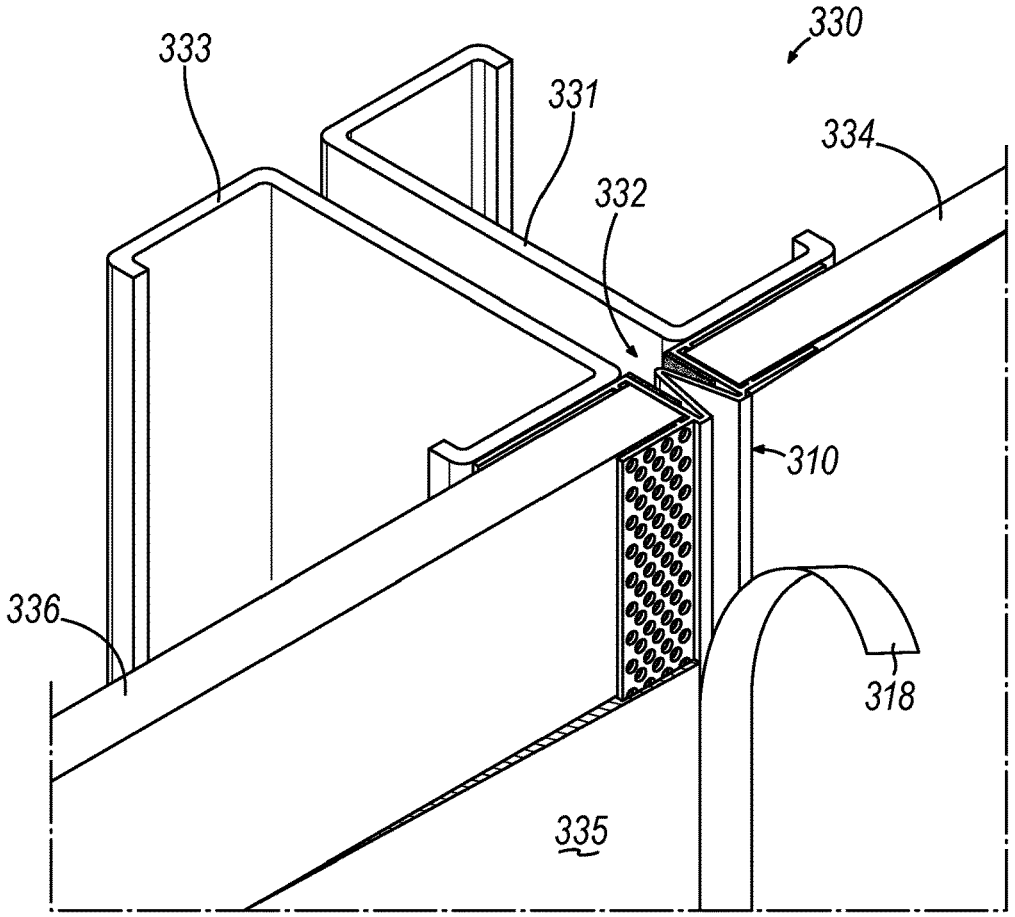
FIG. 24 depicts a front perspective view of an exemplary wall assembly that includes the control joint of FIG. 22.
Figure 25:
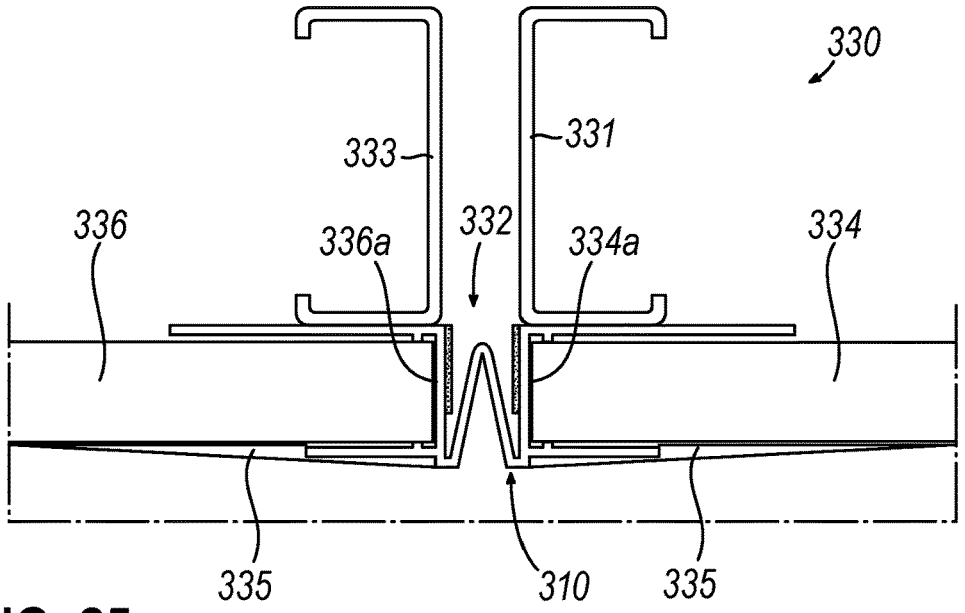
FIG. 25 depicts a top plan view of the wall assembly of FIG. 24.

FIGS. 22-23 show another embodiment of a control joint (310) configured to provide stress relief and assist in controlling cracking in large areas of wallboard. FIGS. 24-25 depict a wall assembly (330) that includes control joint (310) positioned between two wallboard panels (334, 336). As shown, control joint (310) comprises a body (301) comprising a pair of upper flanges (316, 317), a pair of lower flanges (346, 347), a flex portion (314) positioned between upper flanges (316, 317) and lower flanges (346, 347), a first leg (320) extending from an interior edge (316*a*) of upper flange (316), and a second leg (324) extending from an interior edge (317*a*) of flange (317). A piece of removable tape (318) may be initially positioned over the recess of flex portion (314). As shown, each upper flange (316, 317) is perforated such that it includes a plurality of openings (312) that extend through the respective upper flange (316, 317) from an upper surface to a lower surface of the upper flange (316, 317). In such an embodiment, the openings (312) may be any shape and/or configuration suitable to facilitate attachment of upper flanges (316, 317) to an underlying substrate and/or application of a finishing material, such as joint compound, veneer plaster, etc. In some embodiments, one or both upper flanges may be solid (i.e., substantially free of any openings or perforations). In the illustrated embodiment, upper flanges (316, 317) each include an outer portion (316*b*, 317*b*) and a lip (319). As shown, each outer portion (316*b*, 317*b*) extends from a respective lip (319) to a free end of the respective flange (316, 317). Each lip (319) is attached to a first end of a respective side wall (313) of flex portion (314). A first portion of each lip (319) may extend in a plane that is substantially parallel relative to outer portions (316*b*, 317*b*) of upper flanges (316, 317), while a second portion of each lip (319) may extend from the first portion toward base member (315) in a plane that is substantially perpendicular relative to outer portions (316*b*, 317*b*) of upper flanges (316, 317).

As shown in FIGS. 22-23, lower flange (346) is attached to a distal end (320*a*) of first leg (320) and extends away from first leg (320) in a plane that is substantially parallel to outer portion (316*b*) of upper flange (316). Similarly, lower flange (347) is attached to a distal end (324*a*) of second leg (324) and extends away from second leg (324) in a plane that is substantially parallel to outer portion (317*b*) of upper flange (317). In this embodiment, lower flanges (346, 347) are longer than upper flanges (316, 317) (i.e., lower flanges (346, 347) extend beyond the free ends of upper flanges (316, 317)). In other embodiments, lower flanges (346, 347) may be the same length or shorter than upper flanges (316, 317).

In the illustrated embodiment, flex portion (314) comprises a V-shape. Flex portion (314) may comprise other shapes in other embodiments, such as a U-shape or other shapes suitable to provide the desired flexing capability. As shown, flex portion (314) includes a pair of angled side walls (313) and a curved base member (315), similar to sidewalls (113) and base member (115) described above. In some embodiments, the depth of flex portion (314) (i.e., the dimension from the plane containing outer portions (316*b*, 317*b*) of flanges (316, 317) to the bottom of base member (315)) may be substantially equal to the thickness of a single drywall panel (e.g., from about 0.5 inches to about 0.625 inches). Other suitable depths of flex portion (314) may be used depending on the particular application and in light of the teachings herein, including but not limited to a depth that is substantially equal to the thickness of two or more drywall panels.

In the illustrated embodiment, first leg (320) and second leg (324) extend between upper flanges (316, 317) and lower flanges (346, 347) in a plane that is substantially perpendicular relative to outer portions (316*b*, 317*b*) of flanges (316, 317) and lower flanges (346, 347). Specifically, first leg (320) extends from interior edge (316*a*) of upper flange (316) to interior edge (346*a*) of lower flange (346) and second leg (324) extends from interior edge (317*a*) of upper flange (317) to interior edge (347*a*) of lower flange (347). In this embodiment, first leg (320) and second leg (324) extend in the same direction as flex portion (314) and are substantially parallel relative to each other. As shown, first leg (320) and the adjacent sidewall (313) of flex portion (314) are arranged such that an acute angle is formed between first leg (320) and the adjacent sidewall (313) of flex portion (314). Similarly, as shown, second leg (324) and the adjacent sidewall (313) of flex portion (314) are arranged such that an acute angle is formed between second leg (324) and the adjacent sidewall (313) of flex portion (314). In some embodiments, the length of first leg (320) and second leg (324) (i.e., the dimension from lip (319) to the distal end (320*a*, 324*a*) of first leg (320) and second leg (324)) may be substantially equal to the thickness of a single drywall panel (e.g., from about 0.5 inches to about 0.625 inches). Other suitable lengths of first leg (320) and second leg (324) may be used depending on the particular application and in light of the teachings herein, including but not limited to a length that is substantially equal to the thickness of two or more drywall panels. In some embodiments, the lengths of first leg (320) and second leg (324) may be substantially equal to the depth of flex portion (314).

As shown, legs (320, 324) each include a fire resistant material strip (322, 326) positioned on a portion of an interior surface of a respective leg (320, 324) (i.e., the surface of leg (320, 324) facing flex portion (314)) such that the exposed or interior surfaces (322*a*, 326*a*) of fire resistant material strips (322, 326) are facing flex portion (314). In some embodiments, fire resistant material strips (322, 326) may cover a portion of the interior surface of legs (320, 324), while in other embodiments, fire resistant material strips (322, 326) may cover the entire interior surface of legs (320, 324) from the distal end (320*a*, 324*a*) of a respective leg (320, 324) to a corresponding lip (319). In some embodiments, no portion of fire resistant material strips (322, 326) is positioned on flex portion (314). In those embodiments, flex portion (314) may be substantially free of fire resistant material.

In some embodiments, fire resistant material strips (322, 326) may be positioned on at least a portion of an exterior surface of a respective leg (320, 324) (i.e., the surface of a leg (320, 324) facing away from flex portion (314)). Still other embodiments may comprise one or more fire resistant material strips (322, 326) on at least a portion of both the interior surface and exterior surface of a respective leg (320, 324). In some of those embodiments, the control joint (310) may comprise a fire resistant material strip (322, 326) that wraps around the distal end (320*a*, 324*a*) of a respective leg (320, 324) so that the fire resistant material strip extends onto both the interior and exterior surfaces of the leg (320, 324), while in other embodiments, the control joint (310) may comprise two or more fire resistant material strips (322, 326) on a respective leg (320, 324), wherein at least one such strip (322, 326) is positioned on the interior surface of the respective leg (320, 324) and at least one other strip (322, 326) is positioned on the exterior surface of the respective leg (320, 324). In the illustrated embodiment, the number, size, and positioning of fire resistant material strips (322, 326) on legs (320, 324) are the same. In other embodiments, the number, size, and/or positioning of fire resistant material strip (322) on first leg (320) may be different than the number, size, and/or positioning of fire resistant material strip (326) on second leg (324). In some embodiments, one leg (320, 324) may include a fire resistant material strip (322, 326), while the other leg (320, 324) does not include a fire resistant material strip (322, 326). In still other embodiments, one leg (320, 324) may include a fire resistant material strip (322, 326), while the other leg (320, 324) includes a strip comprising material that is not fire resistant. In some embodiments, in order to minimize the amount of fire resistant material needed, which may reduce the cost to produce control joint (310), flex portion (314) may be substantially free from fire resistant material.

Fire resistant material strips (322, 326) can be attached or applied to a respective leg (320, 324) with adhesive, mechanical fasteners, or any other suitable method of attachment. In some embodiments where the strip (322, 326) is attached with adhesive, the adhesive may be fire resistant or, in other words, able to maintain its adhesive qualities at elevated temperatures by incorporating fire resistant properties. In some embodiments, fire resistant material strips (322, 326) may be painted on, sprayed on or otherwise applied to a respective leg (320, 324). In some embodiments, fire resistant material strips (322, 326) may be attached or applied to a respective leg (320, 324) in the same manner, while in other embodiments, fire resistant material strips (322, 326) may be attached or applied to a respective leg (320, 324) in different manners.

Fire resistant material strips (322, 326) comprise a material configured to slow or stop the spread of fire and/or smoke. Similar to fire resistant material strip (122) described above, in some embodiments, the fire resistant material strips (322, 326) may comprise intumescent material. The amount of intumescent material included in fire resistant material strips (322, 326) may be sufficient to substantially seal gap (332) in assembly (330) (described below). In some embodiments, fire resistant material strips (322, 326) may comprise the same fire resistant material, while in other embodiments, fire resistant material strips (322, 326) may comprise different fire resistant material. By way of example only, in some embodiments, one fire resistant material strip (322, 326) may comprise intumescent material, while the other fire resistant material strip (322, 326) may comprise non-intumescent fire resistant material, such as mineral wool. In still other embodiments, both strips (322, 326) may comprise non-intumescent fire resistant material, while in other embodiments one of or both strips (322, 326) may comprise a combination of both intumescent material and non-intumescent fire resistant material.

Similar to fire resistant material strip (122) described above, fire resistant material strips (322, 326) may comprise an intumescent tape, paint, caulk, or other similar intumescent material capable of being applied or attached to a respective leg (320, 324). The intumescent material could be any material suitable to expand and substantially seal gap (332) (described below) when exposed to elevated temperatures. Also similar to fire resistant material strip (122), fire resistant material strips (322, 326) may comprise a combination of a foam material, including but not limited to open cell foam or closed cell foam, and an intumescent material. In some embodiments, fire resistant material strips (322, 326) may comprise the same type of intumescent material, while in other embodiments, fire resistant material strips (322, 326) may comprise different types of intumescent material. By way of example only, in some embodiments, one fire resistant material strip (322, 326) may comprise intumescent tape and the other fire resistant material strip (322, 326) may comprise intumescent paint.

In some embodiments where at least one strip (322, 326) includes both foam material and intumescent material, the foam material and intumescent material may be positioned in layers arranged on top of each other or arranged in a side-by-side orientation. In embodiments where the foam material and intumescent material are positioned in layers arranged on top of each other, in some embodiments, one or both of the fire resistant material strips (322, 326) may be oriented so that the foam material is positioned between the respective leg (320, 324) and the intumescent material, while in other embodiments, one or both of the fire resistant material strips (322, 326) may be oriented so that the intumescent material is positioned between the respective leg (320, 324) and the foam material. In other embodiments, the intumescent material in one or both strips (322, 326) may be infused in or otherwise incorporated within the foam material such that they comprise a single layer of material that includes both foam and intumescent material.

In other embodiments, one or both of the strips may comprise a foam material, including but not limited to open cell foam or closed cell foam, by itself, without any intumescent material. In such an embodiment, the foam may comprise fire resistant material or non-fire resistant material. The foam material may provide sound insulating properties. In other words, the strip may comprise foam material configured to inhibit sound from traveling through the strip. For example, one or both of the strips may comprise a foam material that has a density sufficient to allow the inclusion of the control joint in the wall assembly to increase the sound transmission class (STC) rating of the wall assembly. By way of example only, the foam material may have a density of about 3.0 lbs. per cubic foot to about 4.0 lbs. per cubic foot. In an embodiment where one or both of the strips comprise a foam material with no intumescent material, the foam material may be large enough to substantially surround the flex portion of the control joint and substantially fill the gap between the inner surface of the first leg and inner surface of the second leg.

As shown in FIGS. 24-25, wall assembly (330) comprises a pair of vertically oriented studs (331, 333) and a pair of wallboard panels (334, 336), which may be supported by studs (331, 333). As is well understood within the art, wall assembly (130) may also comprise other typical wall components, such as a header track and a footer track installed opposite one another that receive studs (331, 333). In the illustrated embodiment, control joint (310) may be installed in wall assembly (330) by positioning lower flanges (346, 347) against a framing member, such as a stud, and inserting wallboard panels (334, 336) between corresponding ones of upper flanges (316, 317) and lower flanges (346, 347) such that flex portion (314) is positioned in a gap (332) between wallboard panels (334, 336). In the illustrated embodiment, first leg (320) is positioned between interior edge (334*a*) of adjacent wallboard panel (334) and flex portion (314) and second leg (324) is positioned between interior edge (336*a*) of adjacent wallboard panel (336) and flex portion (314). In addition, in the embodiment shown in FIGS. 24-25, control joint (310) is installed in wall assembly (330) such that upper flanges (316, 317) are positioned over the outer surface of each wallboard panel (334, 336). In some embodiments, upper flanges (316, 317) may be in contact with the outer surface of a respective wallboard panel (334, 336). Legs (320, 324) may be configured to facilitate installation of control joint (310) by helping the user locate control joint (310) within wall assembly (330) by positioning first leg (320) adjacent to interior edge (334*a*) of wallboard panel (334) and/or positioning second leg (324) adjacent to interior edge (336*a*) of wallboard panel (336). In some embodiments, the respective exterior surface of legs (320, 324) may be adjacent to and in contact with a respective interior edge (334*a*, 336*a*) of the corresponding wallboard panel (334, 336), while in other embodiments, the respective exterior surface of legs (320, 324) may be adjacent to and spaced apart from a respective interior edge (334*a*, 336*a*) of the corresponding wallboard panel (334, 336). Flex portion (314) can vary in width in different embodiments to create different sized reveals and/or accommodate different sized gaps within various wall assemblies.

After control joint (310) is installed in wall assembly (330), finishing material (335), such as joint compound or veneer plaster, can then be applied over flanges (316, 317) for a flush finish if desired. In embodiments where one or both flanges (316, 317) contain a plurality of openings (312), the openings (312) may facilitate application of the finishing material. Control joint (310) and removable tape (318) may be configured to prevent staining of the flex portion (314). For example, tape (318) may remain attached to control joint (310) while one or both of the wallboard panels (334, 336) are being finished (e.g., painted, plastered, etc.) so that excess finishing material (335) (paint, plaster, joint compound, etc.) may be applied to tape (318) instead of onto flex portion (314). After the finishing of wallboard panels (334, 336) is completed, then tape (318) can be removed to provide a clean finish to the joint between wallboard panels (334, 336).

In the illustrated embodiment, control joint (310) is shown being installed in a vertically oriented gap between wallboard panels (334, 336). It will be appreciated based on the teachings herein that control joint (310) may also be installed in a horizontally oriented gap between two adjacent wallboard panels in other wall assemblies.

As shown, body (301) of control joint (310) comprises a pair of upper flanges (316, 317), a pair of lower flanges (346, 347), a flex portion (314) positioned between flanges (316, 317, 346, 347), a first leg (320) extending from upper flange (316) to lower flange (346), and a second leg (324) extending from upper flange (317) to lower flange (347). In some embodiments, flanges (316, 317, 346, 347), flex portion (314), first leg (320), and second leg (324) may be of unitary construction such that they are formed from a single integral piece of material. In some embodiments, the components of body (301) may be extruded or coextruded together. However, in other embodiments, one or more of flanges (316, 317, 346, 347), flex portion (314), first leg (320), and second leg (324) may comprise non-integral, separate components that are attached to each other. It will thus be appreciated that body (301) may have a unitary construction or be comprised of various components attached together to collectively form body (301). In some embodiments, body (301), including one or more of flanges (316, 317, 346, 347), flex portion (314), first leg (320), and second leg (324), may comprise polyvinyl chloride (PVC), steel, aluminum or any other suitable material, including but not limited to other suitable plastics, metals, paper products, and composites. In some embodiments, flanges (316, 317, 346, 347), flex portion (314), first leg (320), and second leg (324), may all comprise the same material, while in other embodiments flanges (316, 317, 346, 347), flex portion (314), first leg (320), and second leg (324) may comprise two or more different materials.

Similar to body (101) described above, some embodiments of body (301) may include materials having fire resistant and/or intumescent properties. In some embodiments, at least one portion of body (301) may comprise material having fire resistant and/or intumescent properties and at least one other portion of body (301) may comprise material that does not have fire resistant and/or intumescent properties, such that body (301) includes both fire resistant portions and non-fire resistant portions. In other embodiments, the entire body (301) may comprise material having fire resistant and/or intumescent properties.

Figure 26:
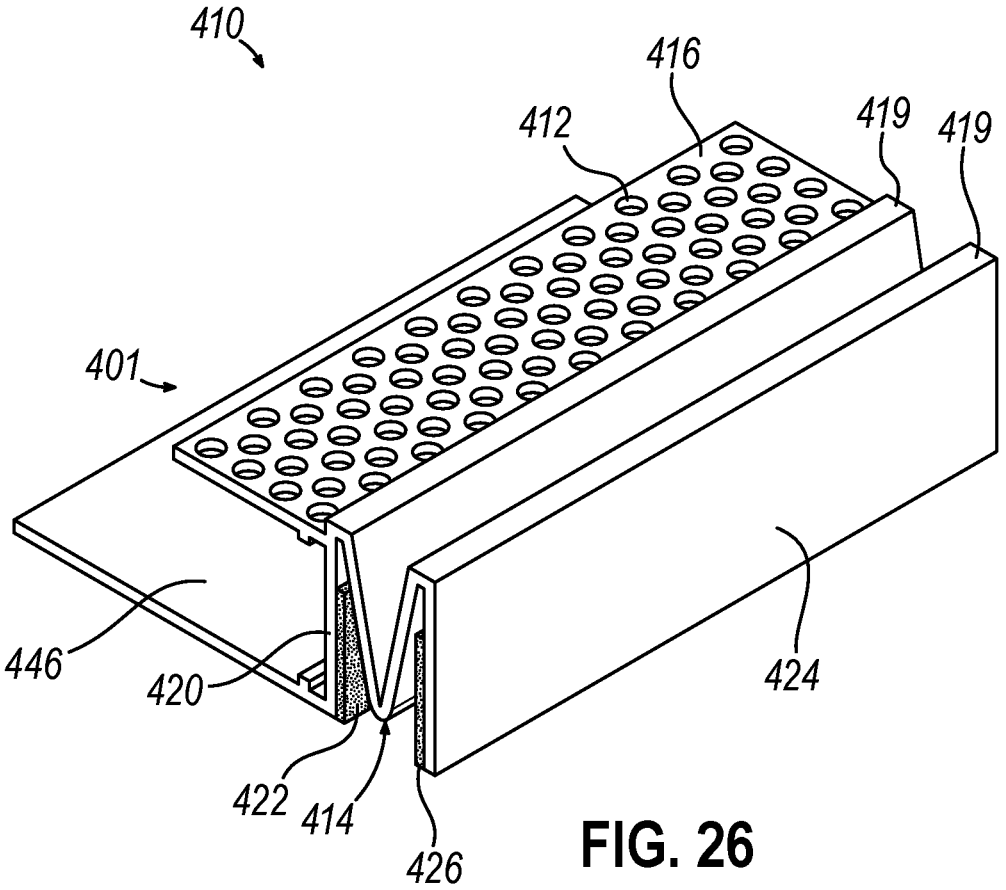
FIG. 26 depicts perspective view of another exemplary control joint.
Figure 27:
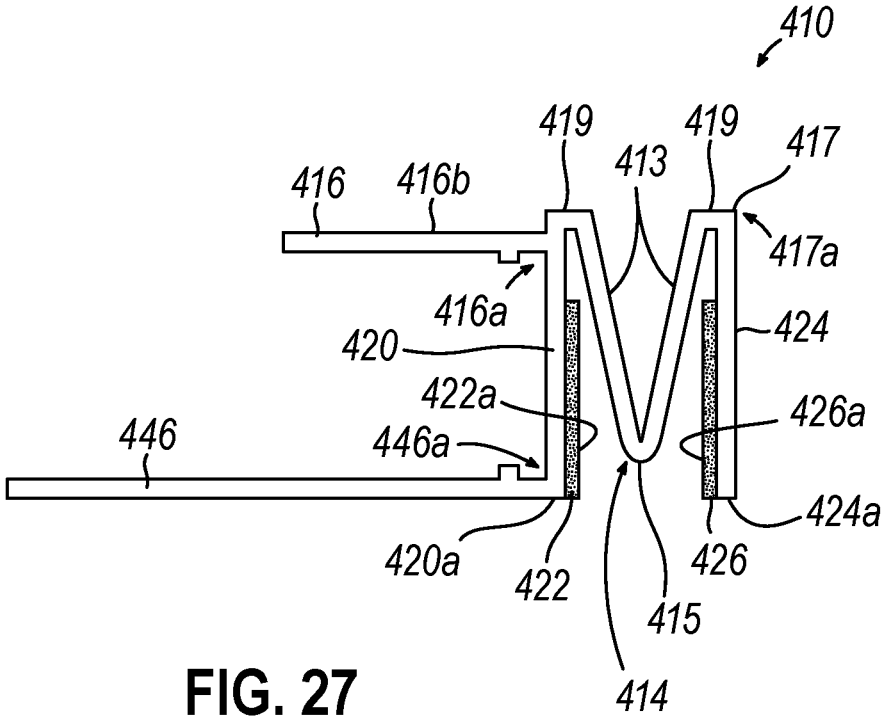
FIG. 27 depicts a front elevational view of the control joint of FIG. 26.
Figure 28:
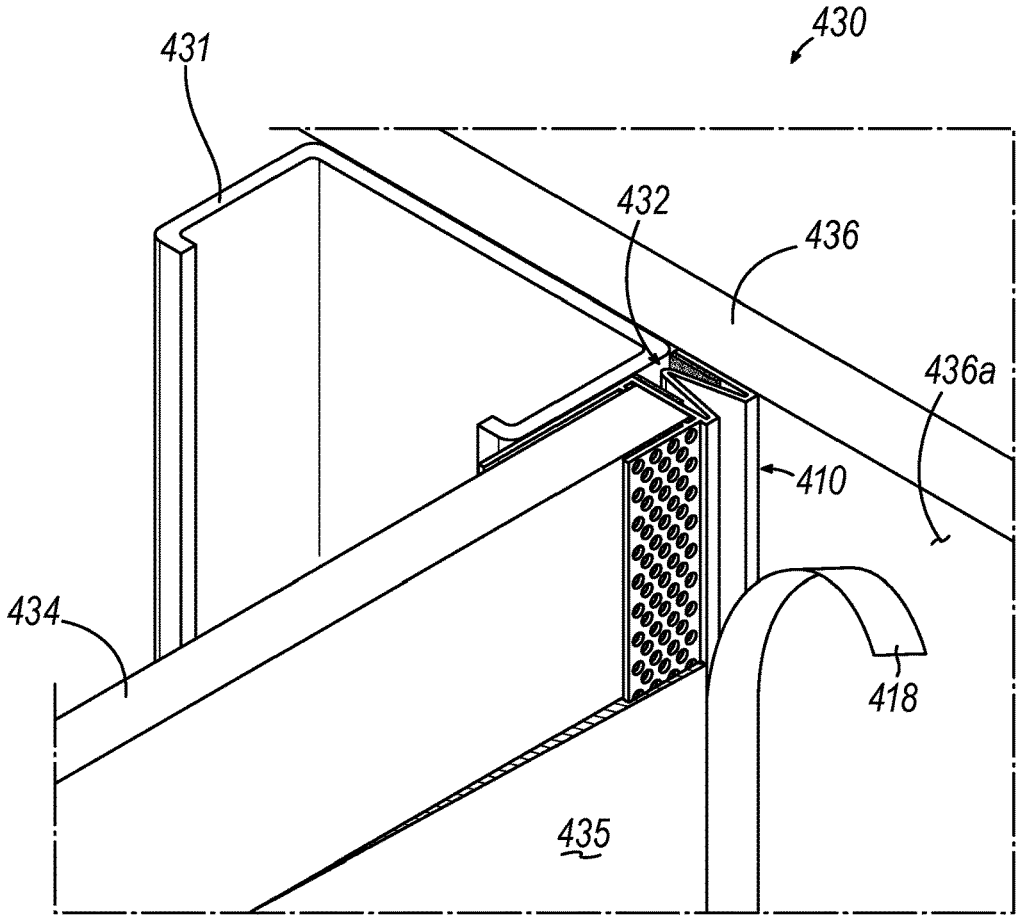
FIG. 28 depicts a front perspective view of an exemplary wall assembly that includes the control joint of FIG. 26.
Figure 29:
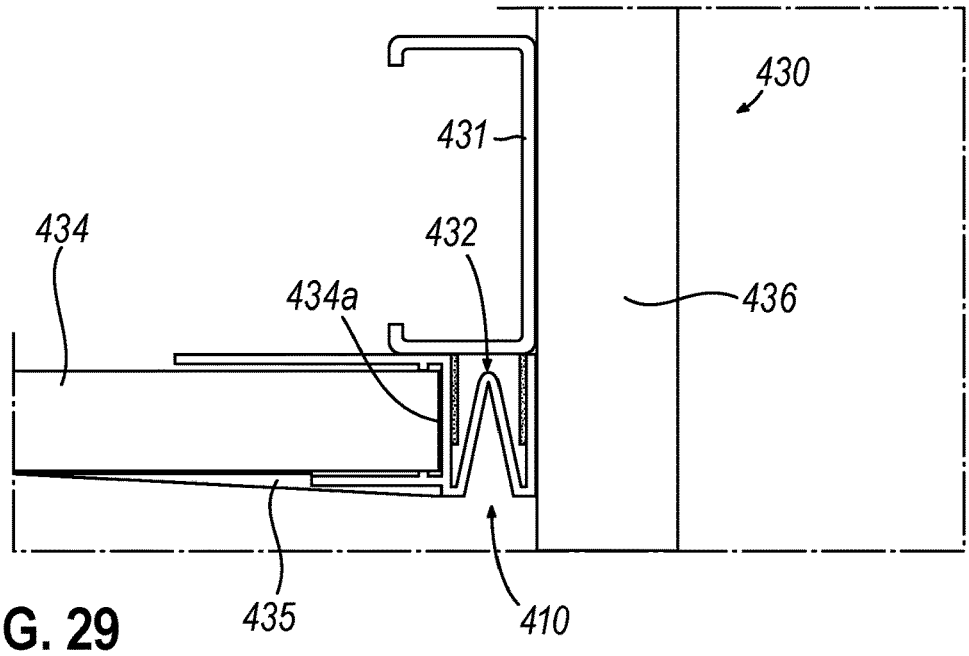
FIG. 29 depicts a top plan view of the wall assembly of FIG. 28.

FIGS. 26-27 show another embodiment of a control joint (410) configured to provide stress relief and assist in controlling cracking in large areas of wallboard. FIGS. 28-29 depict a wall assembly (430) that includes control joint (410) positioned between two wallboard panels (434, 436). As shown, control joint (410) comprises a body (401) comprising a pair of upper flanges (416, 417), a lower flange (446), a flex portion (414) positioned between upper flanges (416, 417), a first leg (420) extending from an interior edge (416*a*) of upper flange (416), and a second leg (424) extending from an interior edge (417*a*) of upper flange (417). A piece of removable tape (418) may be initially positioned over the recess of flex portion (414). As shown, upper flange (416) is perforated such that it includes a plurality of openings (412) that extend through upper flange (416) from an upper surface to a lower surface of upper flange (416). In such an embodiment, the openings (412) may be any shape and/or configuration suitable to facilitate attachment of upper flange (416) to an underlying substrate and/or application of a finishing material, such as joint compound, veneer plaster, etc. In some embodiments upper flange (416) may be solid (i.e., substantially free of any openings or perforations). In the illustrated embodiment, upper flange (416) includes an outer portion (416*b*) and a lip (419), while upper flange (417) only includes a lip (419) and does not include an outer portion. As shown, outer portion (416*b*) extends from a lip (419) to a free end of flange (416). Each lip (419) is attached to a first end of a respective side wall (413) of flex portion (414). A first portion of each lip (419) may extend in a plane that is substantially parallel relative to outer portion (416*b*) of upper flange (416), while a second portion of each lip (419) may extend from the first portion toward base member (415) in a plane that is substantially perpendicular relative to outer portion (416*b*) of upper flange (416).

As shown in FIGS. 26-27, lower flange (446) is attached to a distal end (420*a*) of first leg (420) and extends away from first leg (420) in a plane that is substantially parallel to outer portion (416*b*) of upper flange (416). In this embodiment, lower flange (446) is longer than upper flange (416) (i.e., lower flange (446) extends beyond the free end of upper flange (416)). In other embodiments, lower flange (446) may be the same length or shorter than upper flange (416).

In the illustrated embodiment, flex portion (414) comprises a V-shape. Flex portion (414) may comprise other shapes in other embodiments, such as a U-shape or other shapes suitable to provide the desired flexing capability. As shown, flex portion (414) includes a pair of angled side walls (413) and a curved base member (415), similar to sidewalls (113) and base member (115) described above. In some embodiments, the depth of flex portion (414) (i.e., the dimension from the plane containing outer portion (416*b*) of flange (416) to the bottom of base member (415)) may be substantially equal to the thickness of a single drywall panel (e.g., from about 0.5 inches to about 0.625 inches). Other suitable depths of flex portion (414) may be used depending on the particular application and in light of the teachings herein, including but not limited to a depth that is substantially equal to the thickness of two or more drywall panels.

In the illustrated embodiment, first leg (420) extends between upper flange (416) and lower flange (446) in a plane that is substantially perpendicular relative to outer portion (416*b*) of flange (416) and lower flange (446). Specifically, first leg (420) extends from interior edge (416*a*) of upper flange (416) to interior edge (446*a*) of lower flange (446) and second leg (424) extends from interior edge (417*a*) of upper flange (417) to free end (424*a*) of second leg (424). In this embodiment, first leg (420) and second leg (424) extend in the same direction as flex portion (414) and are substantially parallel relative to each other. As shown, first leg (420) and the adjacent sidewall (413) of flex portion (414) are arranged such that an acute angle is formed between first leg (420) and the adjacent sidewall (413) of flex portion (414). Similarly, as shown, second leg (424) and the adjacent sidewall (413) of flex portion (414) are arranged such that an acute angle is formed between second leg (424) and the adjacent sidewall (413) of flex portion (414). In some embodiments, the length of first leg (420) and second leg (424) (i.e., the dimension from lip (419) to the distal end (420*a*, 424*a*) of first leg (420) and second leg (424)) may be substantially equal to the thickness of a single drywall panel (e.g., from about 0.5 inches to about 0.625 inches). Other suitable lengths of first leg (420) and second leg (424) may be used depending on the particular application and in light of the teachings herein, including but not limited to a length that is substantially equal to the thickness of two or more drywall panels. In some embodiments, the lengths of first leg (420) and second leg (424) may be substantially equal to the depth of flex portion (414).

As shown, legs (420, 424) each include a fire resistant material strip (422, 426) positioned on a portion of an interior surface of a respective leg (420, 424) (i.e., the surface of leg (420, 424) facing flex portion (414)) such that the exposed or interior surfaces (422*a*, 426*a*) of fire resistant material strips (422, 426) are facing flex portion (414). In some embodiments, fire resistant material strips (422, 426) may cover a portion of the interior surface of legs (420, 424), while in other embodiments, fire resistant material strips (422, 426) may cover the entire interior surface of legs (420, 424) from the distal end (420*a*, 424*a*) of a respective leg (420, 424) to a corresponding lip (419). In some embodiments, no portion of fire resistant material strips (422, 426) is positioned on flex portion (414). In those embodiments, flex portion (414) may be substantially free of fire resistant material.

In some embodiments, fire resistant material strips (422, 426) may be positioned on at least a portion of an exterior surface of a respective leg (420, 424) (i.e., the surface of a leg (420, 424) facing away from flex portion (414)). Still other embodiments may comprise one or more fire resistant material strips (422, 426) on at least a portion of both the interior surface and exterior surface of a respective leg (420, 424). In some of those embodiments, the control joint (410) may comprise a fire resistant material strip (422, 426) that wraps around the distal end (420*a*, 424*a*) of a respective leg (420, 424) so that the fire resistant material strip extends onto both the interior and exterior surfaces of the leg (420, 424), while in other embodiments, the control joint (410) may comprise two or more fire resistant material strips (422, 426) on a respective leg (420, 424), wherein at least one such strip (422, 426) is positioned on the interior surface of the respective leg (420, 424) and at least one other strip (422, 426) is positioned on the exterior surface of the respective leg (420, 424). In the illustrated embodiment, the number, size, and positioning of fire resistant material strips (422, 426) on legs (420, 424) are the same. In other embodiments, the number, size, and/or positioning of fire resistant material strip (422) on first leg (420) may be different than the number, size, and/or positioning of fire resistant material strip (426) on second leg (424). In some embodiments, one leg (420, 424) may include a fire resistant material strip (422, 426), while the other leg (420, 424) does not include a fire resistant material strip (422, 426). In still other embodiments, one leg (420, 424) may include a fire resistant material strip (422, 426), while the other leg (420, 424) includes a strip comprising material that is not fire resistant. In some embodiments, in order to minimize the amount of fire resistant material needed, which may reduce the cost to produce control joint (410), flex portion (414) may be substantially free from fire resistant material.

Fire resistant material strips (422, 426) can be attached or applied to a respective leg (420, 424) with adhesive, mechanical fasteners, or any other suitable method of attachment. In some embodiments where the strip (422, 426) is attached with adhesive, the adhesive may be fire resistant or, in other words, able to maintain its adhesive qualities at elevated temperatures by incorporating fire resistant properties. In some embodiments, fire resistant material strips (422, 426) may be painted on, sprayed on or otherwise applied to a respective leg (420, 424). In some embodiments, fire resistant material strips (422, 426) may be attached or applied to a respective leg (420, 424) in the same manner, while in other embodiments, fire resistant material strips (422, 426) may be attached or applied to a respective leg (420, 424) in different manners.

Fire resistant material strips (422, 426) comprise a material configured to slow or stop the spread of fire and/or smoke. Similar to fire resistant material strip (122) described above, in some embodiments, the fire resistant material strips (422, 426) may comprise intumescent material. The amount of intumescent material included in fire resistant material strips (422, 426) may be sufficient to substantially seal gap (432) in assembly (430) (described below). In some embodiments, fire resistant material strips (422, 426) may comprise the same fire resistant material, while in other embodiments, fire resistant material strips (422, 426) may comprise different fire resistant material. By way of example only, in some embodiments, one fire resistant material strip (422, 426) may comprise intumescent material, while the other fire resistant material strip (422, 426) may comprise non-intumescent fire resistant material, such as mineral wool. In still other embodiments, both strips (422, 426) may comprise non-intumescent fire resistant material, while in other embodiments one of or both strips (422, 426) may comprise a combination of both intumescent material and non-intumescent fire resistant material.

Similar to fire resistant material strip (122) described above, fire resistant material strips (422, 426) may comprise an intumescent tape, paint, caulk, or other similar intumescent material capable of being applied or attached to a respective leg (420, 424). The intumescent material could be any material suitable to expand and substantially seal gap (432) (described below) when exposed to elevated temperatures. Also similar to fire resistant material strip (122), fire resistant material strips (422, 426) may comprise a combination of a foam material, including but not limited to open cell foam or closed cell foam, and an intumescent material. In some embodiments, fire resistant material strips (422, 426) may comprise the same type of intumescent material, while in other embodiments, fire resistant material strips (422, 426) may comprise different types of intumescent material. By way of example only, in some embodiments, one fire resistant material strip (422, 426) may comprise intumescent tape and the other fire resistant material strip (422, 426) may comprise intumescent paint.

In some embodiments where at least one strip (422, 426) includes both foam material and intumescent material, the foam material and intumescent material may be positioned in layers arranged on top of each other or arranged in a side-by-side orientation. In embodiments where the foam material and intumescent material are positioned in layers arranged on top of each other, in some embodiments, one or both of the fire resistant material strips (422, 426) may be oriented so that the foam material is positioned between the respective leg (420, 424) and the intumescent material, while in other embodiments, one or both of the fire resistant material strips (422, 426) may be oriented so that the intumescent material is positioned between the respective leg (420, 424) and the foam material. In other embodiments, the intumescent material in one or both strips (422, 426) may be infused in or otherwise incorporated within the foam material such that they comprise a single layer of material that includes both foam and intumescent material.

In other embodiments, one or both of the strips may comprise a foam material, including but not limited to open cell foam or closed cell foam, by itself, without any intumescent material. In such an embodiment, the foam may comprise fire resistant material or non-fire resistant material. The foam material may provide sound insulating properties. In other words, the strip may comprise foam material configured to inhibit sound from traveling through the strip. For example, one or both of the strips may comprise a foam material that has a density sufficient to allow the inclusion of the control joint in the wall assembly to increase the sound transmission class (STC) rating of the wall assembly. By way of example only, the foam material may have a density of about 3.0 lbs. per cubic foot to about 4.0 lbs. per cubic foot. In an embodiment where one or both of the strips comprise a foam material with no intumescent material, the foam material may be large enough to substantially surround the flex portion of the control joint and substantially fill the gap between the inner surface of the first leg and inner surface of the second leg.

As shown in FIGS. 28-29, wall assembly (430) comprises a vertically oriented stud (431) and a pair of wallboard panels (434, 436), which may be supported by stud (431). As is well understood within the art, wall assembly (430) may also comprise other typical wall components, such as a header track and a footer track installed opposite one another that receive stud (431). In the illustrated embodiment, control joint (410) may be installed in wall assembly (430) by positioning lower flange (446) against a framing member, such as a stud, and inserting wallboard panel (434) between upper flange (416) and lower flange (446) such that flex portion (414) is positioned in a gap (432) between wallboard panels (434, 436). In the illustrated embodiment, first leg (420) is positioned between interior edge (434*a*) of adjacent wallboard panel (434) and flex portion (414) and second leg (424) is positioned between interior surface (436*a*) of adjacent wallboard panel (436) and flex portion (414). In addition, in the embodiment shown in FIGS. 28-29, control joint (410) is installed in wall assembly (430) such that upper flange (416) is positioned over the outer surface of wallboard panel (434). In some embodiments, upper flange (416) may be in contact with the outer surface of wallboard panel (434). Legs (420, 424) may be configured to facilitate installation of control joint (410) by helping the user locate control joint (410) within wall assembly (430) by positioning first leg (420) adjacent to interior edge (434*a*) of wallboard panel (434) and/or positioning second leg (424) adjacent to interior surface (436*a*) of wallboard panel (436). In some embodiments, the exterior surface of first leg (420) may be adjacent to and in contact with interior edge (434*a*) of wallboard panel (434), while in other embodiments, exterior surface of first leg (420) may be adjacent to and spaced apart from interior edge (434*a*) of wallboard panel (434). In some embodiments, the exterior surface of second leg (424) may be adjacent to and in contact with interior surface (436*a*) of wallboard panel (436), while in other embodiments, exterior surface of second leg (424) may be adjacent to and spaced apart from interior surface (436*a*) of wallboard panel (436). Flex portion (414) can vary in width in different embodiments to create different sized reveals and/or accommodate different sized gaps within various wall assemblies.

After control joint (410) is installed in wall assembly (430), finishing material (435), such as joint compound or veneer plaster, can then be applied over upper flange (416) for a flush finish if desired. In embodiments where upper flange (416) contains a plurality of openings (412), the openings (412) may facilitate application of the finishing material. Control joint (410) and removable tape (418) may be configured to prevent staining of the flex portion (414).

For example, tape (418) may remain attached to control joint (410) while one or both of the wallboard panels (434, 436) are being finished (e.g., painted, plastered, etc.) so that excess finishing material (435) (paint, plaster, joint compound, etc.) may be applied to tape (418) instead of onto flex portion (414). After the finishing of wallboard panels (434, 436) is completed, then tape (418) can be removed to provide a clean finish to the joint between wallboard panels (434, 436).

In the illustrated embodiment, control joint (410) is shown being installed in a vertically oriented gap between wallboard panels (434, 436). It will be appreciated based on the teachings herein that control joint (410) may also be installed in a horizontally oriented gap between two adjacent wallboard panels in other wall assemblies.

As shown, body (401) of control joint (410) comprises a pair of upper flanges (416, 417), a lower flange (446), a flex portion (414) positioned between upper flanges (416, 417), a first leg (420) extending from an interior edge (416*a*) of upper flange (416), and a second leg (424) extending from an interior edge (417*a*) of upper flange (417). In some embodiments, flanges (416, 417, 446), flex portion (414), first leg (420), and second leg (424) may be of unitary construction such that they are formed from a single integral piece of material. In some embodiments, the components of body (401) may be extruded or coextruded together. However, in other embodiments, one or more of flanges (416, 417, 446), flex portion (414), first leg (420), and second leg (424) may comprise non-integral, separate components that are attached to each other. It will thus be appreciated that body (401) may have a unitary construction or be comprised of various components attached together to collectively form body (401). In some embodiments, body (401), including one or more of flanges (416, 417, 446), flex portion (414), first leg (420), and second leg (424), may comprise polyvinyl chloride (PVC), steel, aluminum or any other suitable material, including but not limited to other suitable plastics, metals, paper products, and composites. In some embodiments, flanges (416, 417, 446), flex portion (414), first leg (420), and second leg (424), may all comprise the same material, while in other embodiments flanges (416, 417, 446), flex portion (414), first leg (420), and second leg (424) may comprise two or more different materials.

Similar to body (101) described above, some embodiments of body (401) may include materials having fire resistant and/or intumescent properties. In some embodiments, at least one portion of body (401) may comprise material having fire resistant and/or intumescent properties and at least one other portion of body (401) may comprise material that does not have fire resistant and/or intumescent properties, such that body (401) includes both fire resistant portions and non-fire resistant portions. In other embodiments, the entire body (401) may comprise material having fire resistant and/or intumescent properties.

Exemplary Combinations

The following examples relate to various non-exhaustive ways in which the teachings herein may be combined or applied. The following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventor or by a successor in interest to the inventor. If any claims are presented in this application or in subsequent filings related to this application that include additional features beyond those referred to below, those additional features shall not be presumed to have been added for any reason relating to patentability.

Example 1

A construction component comprising: a. a first flange and a second flange; b. a flex portion positioned between the first flange and the second flange; c. a first leg, wherein the first leg extends from the first flange and comprises a first surface and a second surface, wherein the first surface and the second surface of the first leg face in opposite directions relative to each other; and d. a first strip positioned on at least a portion of the first surface of the first leg.

Example 2

The construction component of the preceding example, wherein the first surface of the first leg comprises an interior surface facing the flex portion.

Example 3

The construction component of Example 1, wherein the first surface of the first leg comprises an exterior surface facing away from the flex portion.

Example 4

The construction component of any one or more of the preceding Examples, wherein the first leg comprises a distal end and the first strip wraps around the distal end such that the first strip is also positioned on at least a portion of the second surface of the first leg.

Example 5

The construction component of any one or more of Examples 1-3, further comprising a second strip positioned on at least a portion of the second surface of the first leg.

Example 6

The construction component of any one or more of the preceding Examples, wherein the first strip comprises fire resistant material.

Example 7

The construction component of any one or more of the preceding Examples, wherein the first strip comprises intumescent material.

Example 8

The construction component of any one or more of the preceding Examples, wherein the first strip comprises foam material.

Example 9

The construction component of any one or more of the preceding Examples, wherein the first strip comprises foam material and intumescent material.

Example 10

The construction component of any one or more of the preceding Examples, wherein the first leg extends substantially perpendicularly relative to the first flange.

Example 11

The construction component of any one or more of the preceding Examples, wherein the first flange comprises a lip and an outer portion extending away from the lip.

Example 12

The construction component of any one or more of the preceding Examples, wherein the flex portion comprises a substantially v-shaped profile.

Example 13

The construction component of any one or more of the preceding Examples, wherein the flex portion comprises a first side wall, a second side wall and a base member, wherein the first side wall is connected to the second side wall via the base member.

Example 14

The construction component of any one or more of the preceding Examples, further comprising a second leg, wherein the second leg extends from the second flange and comprises a first surface and a second surface, wherein the first surface and second surface of the second leg face in opposite directions relative to each other.

Example 15

The construction component of Example 14, further comprising a second strip positioned on at least a portion of the first surface of the second leg.

Example 16

The construction component of Example 15, wherein the second strip comprises fire resistant material.

Example 17

The construction component of any one or more of Examples 15 and 16, wherein the second strip comprises intumescent material.

Example 18

The construction component of any one or more of Examples 15-17, wherein the second strip comprises foam material.

Example 19

The construction component of any one or more of Examples 15-18, wherein the second strip comprises foam material and intumescent material.

Example 20

The construction component of any one or more of the preceding Examples, further comprising a third flange, wherein the third flange extends from a distal end of the first leg opposite the end of the first leg attached to the first flange.

Example 21

The construction component of Example 20, wherein the third flange is substantially parallel to the first flange.

Example 22

The construction component of any one or more of Examples 14-21, further comprising a fourth flange, wherein the fourth flange extends from a distal end of the second leg opposite the offend of the second leg attached to the second flange.

Example 23

A wall assembly comprising: a. a first wallboard panel comprising a first edge; b. a second wallboard panel comprising a second edge, wherein the second wallboard panel is positioned adjacent to the first wall portion with a gap between the first edge of the first wall portion and the second edge of the second wall portion; c. a construction component, wherein the construction component is positioned adjacent to the gap and comprises: i. a first flange and a second flange; ii. a flex portion positioned between the first flange and the second flange; iii. a first leg, wherein the first leg extends from the first flange at a first end of the first leg; and iv. a first strip positioned on the first leg; wherein the construction component is positioned within the wall assembly such that the first leg is positioned between the first edge of the first wallboard panel and the flex portion.

Example 24

The wall assembly of Example 23, wherein the first strip is positioned on the first leg such that an exposed face of the first strip faces the flex portion.

Example 25

The wall assembly of Example 23, wherein the first strip is positioned on the first leg such that an exposed face of the first strip faces away from the flex portion.

Example 26

The wall assembly of any one or more of Examples 23-25, wherein the first leg comprises a distal end and the first strip wraps around the distal end such that a first exposed face of the first strip faces the flex portion and a second exposed face of the first strip faces away from the flex portion.

Example 27

The wall assembly of any one or more of Examples 23-26, wherein the first strip comprises fire resistant material.

Example 28

The wall assembly of any one or more of Examples 23-27, wherein the first strip comprises intumescent material.

Example 29

The wall assembly of any one or more of Examples 23-28, wherein the first strip comprises foam material.

Example 30

The wall assembly of any one or more of Examples 23-29, wherein the first strip comprises foam material and intumescent material.

Example 31

The wall assembly of any one or more of Examples 23-30, wherein the construction component further comprises a second leg, wherein the second leg extends from the second flange at a first end of the second leg, and, wherein the construction component is positioned within the wall assembly such that the second leg is positioned between the second edge of the second wallboard panel and the flex portion.

Example 32

The wall assembly of Example 24, wherein the construction component further comprises a second strip positioned on the second leg such that an exposed face of the second strip faces the flex portion.

Example 33

The wall assembly of Example 32, wherein the second strip comprises fire resistant material.

Example 34

The wall assembly of any one or more of Examples 32 and 33, wherein the second strip comprises intumescent material.

Example 35

The wall assembly of any one or more of Examples 32-34, wherein the second strip comprises foam material.

Example 36

The wall assembly of any one or more of Examples 32-35, wherein the second strip comprises foam material and intumescent material.

Example 37

The wall assembly of any one or more of Examples 23-36, wherein the construction component further comprises a third flange, wherein the third flange extends from a distal end of the first leg opposite the first end of the first leg.

Example 38

The wall assembly of Example 37, wherein the first wallboard panel is positioned between the first flange and the third flange.

Example 39

The wall assembly of any one or more of Examples 31-38, wherein the construction component further comprises a fourth flange, wherein the fourth flange extends from a distal end of the second leg opposite the first end of the second leg.

Example 40

The wall assembly of Example 39, wherein the first wallboard panel is positioned between the first flange and the third flange and the second wallboard panel is positioned between the second flange and the fourth flange.

Example 41

The wall assembly of any one or more of Examples 23-40, wherein the construction component is positioned within the wall assembly such that the first flange extends over an outer surface of the first wallboard panel.

Example 42

The wall assembly of any one or more of Examples 23-41, wherein the construction component is positioned within the wall assembly such that the second flange extends over an outer surface of the second wallboard panel.

Example 43

A wall assembly comprising: a. a first stud comprising a first web with a first interior surface; b. a second stud comprising a second web with a second interior surface, wherein the second stud is positioned adjacent to the first stud with a gap between the first interior surface of the first web and the second interior surface of the second web; c. a construction component, wherein the construction component is positioned adjacent to the gap and comprises: i. a first flange and a second flange; ii. a flex portion positioned between the first flange and the second flange; iii. a first leg, wherein the first leg extends from the first flange at a first end of the first leg; and iv. a first strip positioned on the first leg such that an interior face of the first fire resistant material strip faces the flex portion; wherein the construction component is positioned within the wall assembly such that the first leg is positioned between the first interior surface of the first web and the flex portion.

Example 44

The wall assembly of Example 43, wherein the first strip comprises fire resistant material.

Example 45

The wall assembly of any one or more of Example 43 and 44, wherein the first strip comprises intumescent material.

Example 46

The wall assembly of any one or more of Examples 43-45, wherein the first strip comprises foam material.

Example 47

The wall assembly of any one or more of Examples 43-46, wherein the first strip comprises foam material and intumescent material.

Example 48

The wall assembly of any one or more of Examples 43-47, wherein the construction component further comprises a second leg, wherein the second leg extends from the second flange at a first end of the second leg, and, wherein the construction component is positioned within the wall assembly such that the second leg is positioned between second interior surface of the second web and the flex portion.

Example 49

The wall assembly of Example 48, wherein the construction component further comprises a second strip positioned on the second leg such that an interior face of the second fire resistant material strip faces the flex portion.

Example 50

The wall assembly of Example 49, wherein the second strip comprises fire resistant material.

Example 51

The wall assembly of any one or more of Examples 49 and 50, wherein the second strip comprises intumescent material.

Example 52

The wall assembly of any one or more of Examples 49-51, wherein the second strip comprises foam material.

Example 53

The wall assembly of any one or more of Examples 49-52, wherein the second strip comprises foam material and intumescent material.

Example 54

The wall assembly of any one or more of Examples 43-53, wherein the stud further comprises a first leg extending substantially perpendicularly to the first web and the construction component is positioned within the wall assembly such that the first flange of the construction component extends over a first outer surface of the first leg of the first stud.

Example 55

The wall assembly of any one or more of Examples 43-54, wherein the second stud further comprises a second leg extending substantially perpendicularly to the second web and the construction component is positioned within the wall assembly such that the second flange of the construction component extends over a second outer surface of the second leg of the second stud.

Embodiments of the control joints described herein may be manufactured subject to manufacturing tolerances typically used for these types of products. In some embodiments, components of the control joints described herein may be perpendicular or parallel to each other within +/−2 degrees or +/−1 degree.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

What is claimed is:

1. A control joint comprising:

a. a first flange and a second flange;

b. a flex portion positioned between the first flange and the second flange such that the flex portion extends from the first flange to the second flange;

c. a first leg, wherein the first leg comprises a first material, wherein the first leg extends from the first flange and comprises a first surface and a second surface, wherein the first surface and the second surface of the first leg face in opposite directions relative to each other; and d. a first strip positioned on at least a portion of the first surface of the first leg, wherein the first strip comprises a second material, wherein the first material is different than the second material, wherein the first strip comprises a thickness that is measured in a direction perpendicular to a plane containing the first surface of the first leg and a height that is measured in a direction parallel to the plane containing the first surface, wherein the height of the first strip is greater than the thickness of the first strip.

2. The control joint of claim 1, wherein the first surface of the first leg comprises an interior surface facing the flex portion.

3. The control joint of claim 1, wherein the first surface of the first leg comprises an exterior surface facing away from the flex portion.

4. The control joint of claim 1, wherein the first leg comprises a distal end and the first strip wraps around the distal end such that the first strip is also positioned on at least a portion of the second surface of the first leg.

5. The control joint of claim 1, further comprising a second strip positioned on at least a portion of the second surface of the first leg.

6. The control joint of claim 1, wherein the second material comprises fire resistant material.

7. The control joint of claim 1, wherein the second material comprises intumescent material.

8. The control joint of claim 7, wherein the intumescent material comprises intumescent tape.

9. The control joint of claim 1, wherein the second material comprises foam material.

10. The control joint of claim 1, wherein the first leg extends substantially perpendicularly relative to the first flange.

11. The control joint of claim 1, wherein the flex portion comprises a substantially v-shaped profile.

12. The control joint of claim 1 further comprising a second leg, wherein the second leg extends from the second flange and comprises a first surface and a second surface, wherein the first surface and second surface of the second leg face in opposite directions relative to each other.

13. The control joint of claim 12 further comprising a second strip positioned on at least a portion of the first surface of the second leg.

14. The control joint of claim 1, wherein the first leg extends from the first flange at a first end of the first leg and the first leg comprises a distal end that is opposite the first end, wherein the distal end of the first leg is a free end.

15. The control joint of claim 1, wherein the first material comprises plastic.

16. The control joint of claim 15, wherein the first material comprises polyvinyl chloride.

17. The control joint of claim 16, wherein the second material comprises intumescent tape.

18. The control joint of claim 15, wherein the second material comprises intumescent tape.

19. A wall assembly comprising:

a. a first wallboard panel comprising a first edge;

b. a second wallboard panel comprising a second edge, wherein the second wallboard panel is positioned adjacent to the first wallboard panel with a gap between the first edge of the first wallboard panel and the second edge of the second wallboard panel, wherein the first wallboard panel and the second wallboard panel are positioned such that the first edge of the first wallboard panel faces the second edge of the second wallboard panel; and c. a control joint, wherein the control joint is positioned adjacent to the gap and comprises i. a first flange and a second flange;

ii. a flex portion positioned between the first flange and the second flange;

iii. a first leg, wherein the first leg extends from the first flange at a first end of the first leg, wherein the first leg comprises a first surface that faces the flex portion; and iv. a first strip positioned on at least a portion of the first surface of the first leg;

d. wherein the control joint is positioned within the wall assembly such that the first leg is positioned between the first edge of the first wallboard panel and the flex portion and at least a portion of the flex portion is positioned within the gap.

20. The wall assembly of claim 19, wherein the first leg comprises a distal end and the first strip wraps around the distal end such that a first exposed face of the first strip faces the flex portion and a second exposed face of the first strip faces away from the flex portion.

21. The wall assembly of claim 19, wherein the control joint further comprises a second leg, wherein the second leg extends from the second flange at a first end of the second leg, and, wherein the control joint is positioned within the wall assembly such that the second leg is positioned between the second edge of the second wallboard panel and the flex portion.

22. The wall assembly of claim 21, wherein the control joint further comprises a second strip positioned on at least a portion of the second leg such that an exposed face of the second strip faces the flex portion.

23. The wall assembly of claim 19, wherein the control joint is positioned within the wall assembly such that the first flange extends over an outer surface of the first wallboard panel.

24. The wall assembly of claim 19, wherein the first strip comprises intumescent tape.

25. A wall assembly comprising:

a. a first stud comprising a first web with a first interior surface;

b. a second stud comprising a second web with a second interior surface, wherein the second stud is positioned adjacent to the first stud with a gap between the first interior surface of the first web and the second interior surface of the second web, wherein the first stud and the second stud are positioned such that the first interior surface of the first web faces the second interior surface of the second web; and c. a control joint, wherein the control joint is positioned adjacent to the gap and comprises i. a first flange and a second flange;

ii. a flex portion positioned between the first flange and the second flange;

iii. a first leg, wherein the first leg extends from the first flange at a first end of the first leg; and iv. a first strip positioned on at least a portion of the first leg such that an interior face of the first strip faces the flex portion;

d. wherein the control joint is positioned within the wall assembly such that the first leg is positioned between the first interior surface of the first web of the first stud and the flex portion and at least a portion of the flex portion is positioned within the gap.

* * * * *